US009388678B2

(12) United States Patent
Affholter et al.

(10) Patent No.: US 9,388,678 B2
(45) **Date of Patent: *Jul. 12, 2016**

(54) IN SITU RETORTING OF HYDROCARBONS AND A SELECTED METAL

(71) Applicants: Joseph A. Affholter, Midland, MI (US); Gilman A. Hill, Englewood, CO (US)

(72) Inventors: Joseph A. Affholter, Midland, MI (US); Gilman A. Hill, Englewood, CO (US)

( * ) Notice: Subject to any disclaimer, the term of this patent is extended or adjusted under 35 U.S.C. 154(b) by 232 days.

This patent is subject to a terminal disclaimer.

(21) Appl. No.: 14/160,651

(22) Filed: Jan. 22, 2014

(65) Prior Publication Data

US 2015/0204179 A1 Jul. 23, 2015

(51) Int. Cl.
*E21B 43/24* (2006.01)
*E21B 43/28* (2006.01)

(52) U.S. Cl.
CPC ..... *E21B 43/24* (2013.01); *E21B 43/281* (2013.01)

(58) Field of Classification Search
USPC ..... 166/268, 272.1, 272.2, 272.3, 272.4, 166/272.5, 272.6, 272.7, 245, 52, 50, 302, 166/303
See application file for complete search history.

(56) References Cited

U.S. PATENT DOCUMENTS

| | | | | | |
|---|---|---|---|---|---|
| 2,796,129 | A * | 6/1957 | Brandon | 166/249 |
| 4,020,901 | A * | 5/1977 | Pisio et al. | 166/50 |
| 4,410,216 | A * | 10/1983 | Allen | 299/2 |
| 4,685,515 | A * | 8/1987 | Huang et al. | 166/50 |
| 4,832,122 | A * | 5/1989 | Corey et al. | 166/266 |
| 4,982,786 | A * | 1/1991 | Jennings, Jr. | 166/50 |
| 5,016,709 | A * | 5/1991 | Combe et al. | 166/245 |
| 5,520,247 | A * | 5/1996 | Gmelig Meyling et al. | 166/245 |
| 5,915,477 | A * | 6/1999 | Stuebinger et al. | 166/245 |
| 7,909,093 | B2 * | 3/2011 | Brown et al. | 166/245 |
| 8,132,620 | B2 * | 3/2012 | Hanna | 166/245 |
| 2003/0098605 | A1 * | 5/2003 | Vinegar et al. | 299/14 |
| 2008/0087427 | A1 * | 4/2008 | Kaminsky et al. | 166/272.1 |
| 2010/0206555 | A1 * | 8/2010 | Menard et al. | 166/245 |

* cited by examiner

*Primary Examiner* — Angela M DiTrani
(74) *Attorney, Agent, or Firm* — Edwin H. Crabtree; Ramon L. Pizam

(57) ABSTRACT

A method of producing hydrocarbons and a selected metal in situ from a fixed-bed hydrocarbon formation disposed below a ground surface and having a higher permeability zone substantially parallel to, and between a top lower permeability zone and a bottom lower permeability zone. The steps include providing at least one injection well and first and second production wells in the higher permeability zone, injecting a heated thermal-energy carrier fluid (TECF) into the injection well, circulating the carrier fluid through the zone and creating a substantially horizontal situ heating element (ISHE) between the injection well and the production wells for mobilizing the hydrocarbons and the selected metal.

20 Claims, 17 Drawing Sheets

IN SITU RETORTING OF HYDROCARBONS AND A SELECTED METAL

This non-provisional, Divisional patent application claims the benefit of a CIP patent application Ser. No. 13/471,862, filed on May 16, 2012. This CIP patent application claims the benefit of a non-provisional CIP patent application Ser. No. 13/317,604, filed on Oct. 25, 2011 and a CIP patent application Ser. No. 13/068,423, filed on May 11, 2011. These two prior CIP patent applications claim the benefit of an earlier filed Parent patent application Ser. No. 11/455,438, filed on Jun. 19, 2006, now U.S. Pat. No. 7,980,312 and published on Jul. 19, 2011. The Parent patent application claims the benefit of an earlier filed Provisional patent application, Ser. No. 60/692,487, filed on Jun. 20, 2005, by the subject inventors.

BACKGROUND OF THE INVENTION

1. Field of the Invention

The present invention relates generally to methods and systems for the production of hydrocarbons, hydrogen, water, industrial raw materials, as well as rare earth and precious metals, basic chemicals and other products from various carbonaceous formations, such as those containing petroleum, oil sands, kerogen, bitumen, oil shale, lignite or coal.

2. Description of Related Art

Carbon-rich deposits found in subterranean (e.g. sedimentary) formations are commonly used as energy resources, raw materials and chemical feed stocks. In recent years, concerns over depletion of available hydrocarbon resources and the declining quality of hydrocarbons produced by traditional methods have led to development of processes that allow for more efficient recovery, processing and/or use of geologically derived hydrocarbon resources. Work conducted over the last century established the possibility of producing liquid or gas hydrocarbons from mineralized and entrained sources. With a few exceptions, the work largely failed the test of practicality.

Conventional crude oil deposits normally contain oil, water, and gas as three separate phases that are produced by multiphase fluid flow. In such multiphase fluid flow, the volumetric content, as well as differences in adherence, hydrophobic attraction, viscosity, surface area, interfacial tension, surface tension and solubility of materials plays an important role in the recoverability of the various materials. For example, differences in interfacial or surface tension between any two phases (and/or the materials within them) may interfere with the fluid flow of materials in one or more of these or other phases. This impedance may result in reduced relative permeability of the formation to at least one fluid phase. It may also reduce the effective permeability of the formation as a whole.

Other physical forces acting upon the multi-phase formation fluids also may impede mobility of such fluids in the formation. For example, interfacial tension between an oil droplet within the formation fluid and the mineral structure surrounding it acts to create a substantial capillary force that may act to retain the droplet in position. Acting across a formation, these localized interfacial behaviors may result in substantial non-recoverable, residual oil saturation left behind after the relative permeability to oil has been reduced to a low value. In addition, the differential viscosity and capillarity of each phase may cause interfingering (e.g. 'channeling') of flowing water and gas phases, thereby bypassing large segments of oil-saturated reservoir rock. This interfingering of flow is believed to account for a portion of the large residual, non-producible oil saturations remaining after depletion of most oil fields. Even after secondary and tertiary oil recovery technologies have been used, large volumes of oil, well over 50% of original oil-in-place, may remain in the depleted reservoir rock as non-recoverable oil. The methods of this invention apply to enhancing the recovery of hydrocarbon from these and other recalcitrant deposits.

In heavy oil and tar sand deposits, differential viscosity and capillarity problems in multiphase flow are often even more significant than conventional formations, resulting in both very slow production rates and very high residual oil left behind after depletion, even when the formation is relatively porous or permeable. Steam injection is often used to heat the heavy oil or tar/bitumen to reduce oil viscosity, increase the oil production rate and decrease the bypassed residual, non-recoverable oil saturation. Chemical agents that reduce interfacial tension and related capillary forces are also used to reduce the non-recoverable, residual oil left behind after depletion and abandonment. Even after reducing interfacial tension and decreasing viscosity by steam heating, substantial volumes of this oil still remains non-recoverable at economic rates, based on such multiphase fluid flow. The methods of this invention provide the means to enhance recovery of hydrocarbons from both conventional and nonconventional resources by use of formation permeability and an injected thermal energy carrier fluid (TECF) to mobilize hydrocarbons and establish both stable and transient in situ heating zones within target formations. In many cases, the heating zones comprise in situ heating elements described herein and in our previous applications.

Methods that reduce interfacial or surface tension, and the resulting impedance of flow that stems from it, are highly desirable in the field of hydrocarbon recovery and production. In situ methods for consolidating formation hydrocarbons into a single mobile fluid phase are of immense interest in the field of fuel and chemical production. It is also highly desirable to employ in situ methods that allow for production of formation hydrocarbons having a substantially narrower, and/or more defined, and/or more controlled range of compositions than is found using conventional petroleum and natural gas production technologies. Generally, methods that allow an operator increased control over the physical chemistry (including phase behavior) of formation fluids are of value in enhancing or enabling economic production. Similarly, methods that provide an operator with increased control of the chemical composition of the produced formation fluids are of great value provide opportunities to increase the value of the produced products.

The subject of this invention is the mobilization, transformation and recovery of carbon-based materials from various geological formations. While the focus of the present invention is recovery of hydrocarbons from carbonaceous resources having limited mobility, these methods apply equally to conventional gas and liquid petroleum formations as well. While not limited to solid phase deposits (such as oil shale and other kerogen-containing deposits) or high-viscosity (e.g. bitumen-rich) oil and tars, the present invention focuses on these as models of what is generally referred to herein as substantially immobile (or "fixed-bed") carbonaceous materials. The formations or lithologic layers containing such materials may be referred to as containing fixed bed carbonaceous deposits; or as fixed bed hydrocarbon formations. Often, methods for developing formations containing substantially immobile hydrocarbon deposits fail the test of economic viability because they are not: a) effective at achieving high volumetric productivity, b) flexible with respect to in situ hydrocarbon chemistries and recovery methods, c) predictable and effective across a broad range of common geological formation conditions, or d) compatible with the effective protection of the surrounding environment and/or ecosystems. Nevertheless, recovering hydrocarbon products from mineral deposits such as oil shale, without costly and environmentally challenging mining operations remains a desirable objective in the field. The methods of the present invention focus broadly on the mobilization, fluidization, and in situ modification of carbonaceous deposits so as to provide an efficient means of producing useful fluid hydrocarbon products. Accomplishing this objective often requires methods that cause limited, but important changes in the chemical structure and/or physical state of the deposited resource in situ, i.e. in the formation. The present invention employs a variety of strategies to achieve economic productivity including in situ chemical reactions that change the structure or molecular weight of the carbonaceous material, changes in the solubility, density, viscosity, phase state, and/or physical partitioning of the hydrocarbon material within the formation or formation fluids. For the purposes of this invention a fluid may be, but is not limited to, a gas, a liquid, a supercritical fluid, an emulsion, a slurry, and/or a stream of solid particles or gelatinous materials that has flow characteristics similar to liquid or gas flow.

The methods of this invention provide a means to produce fluid hydrocarbon from formations comprising one or more fixed bed carbonaceous deposits (FBCD), and for extending high levels of protection to the surrounding environment by a combination of aquifer and water management methods, low-impact surface processing facilities, and a low-density distribution of surface wells and equipment. The invention further comprises both methods and systems that enable physicochemical transformation of a wide range of carbon-rich deposits in situ followed by recovery of at least a portion of the produced hydrocarbons and/or other product materials at the surface. The methods allow production of various categories of products including: linear and cyclic hydrocarbons, linear and cyclic olefins, aromatic hydrocarbons, and other non-hydrocarbon products derived from formation minerals. For example, molecular hydrogen, metals (e.g. rare earth, precious and others) and metal salts, and other non-carbonaceous products also may be produced.

The methods of this invention apply to any carbon-rich geological formation, including but not limited to those containing deposits of: kerogen; bitumen; lignite; coal (including brown, bituminous, sub-bituminous and anthracite coals; liquid petroleum; depleted oil fields; tar or gel phase petroleum; and the like. Preferred applications include those wherein the carbonaceous materials are either mineralized (e.g. largely fixed in position), highly viscous, or rendered substantially immobile by entrainment in soils, sands, tars and other geological configurations that reduce transmissibility. For the purposes of this invention, all of these embodiments are said to represent fixed-bed hydrocarbon formations (FBHFs). The carbonaceous material itself may be referred to as fixed-bed hydrocarbon (FBH) even though it may exist in many forms, such as a soil-entrained fluid, a high-viscosity gel or fluid (e.g. tar), a mineralized, non-hydrocarbon solid (e.g. kerogen, lignite, coal, etc). Formations containing deposits such as these may be found at depths ranging from surface formations to tens of thousands of feet. FBH formations may be found under both land and sea surfaces.

Figure 1:
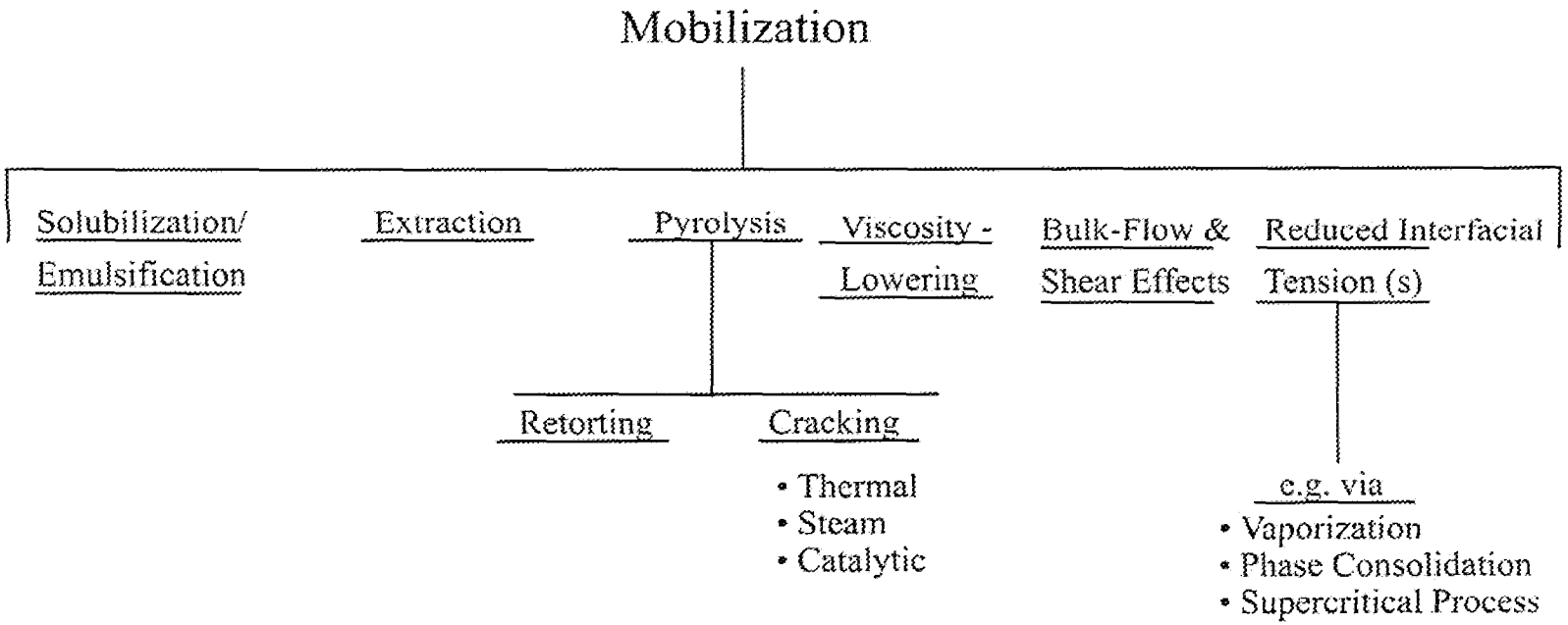
FIG. 1 illustrates various terms used in the mobilization of hydrocarbons in situ in a stratigraphic column of a preferred oil shale deposit.

DETAILED DESCRIPTION OF THE TECHNICAL TERMS USED AND RELATED TO THE PREFERRED EMBODIMENTS OF THE INVENTION

The mobilization and pyrolysis of hydrocarbons play key roles in the operation of the present invention. The conceptual relationships between several closely related mobilization terms (mobilization (e.g. mobilize), pyrolysis (e.g. pyrolyze) and cracking) are illustrated schematically in FIG. 1 and discussed in great detail herein. To summarize, mobilization of carbonaceous materials from geological formation refers to a transition whereby a substantially immobile material becomes substantially more mobile, especially within an in situ fluid hydrocarbon or a thermal energy carrier fluid (TECF) stream. In the context of the present invention, mobilization of a material may result from any number of in situ physical processes including, but not limited to: a) pyrolysis, b) molecular displacement, c) adsorption or desorption from a matrix, d) extraction, e) emulsification, f) solubilization, g) ultrasonic stimulation, h) vibrational stimulation, i) microwave stimulation, j) stimulation with other forms of radiation (e.g. x-ray, gamma, beta, etc), k) a shear (e.g. frictional drag or shearing) force, l) capillary action, m) oxidation, n) chemical activation, o) vaporization, p) chemical decomposition, q) a bulk flow effect, r) reduction or elimination of surface or interfacial tension between at least two formation fluids (or, optionally, between a formation fluid and a formation solid), s) cracking (e.g. thermal, catalytic etc) retorting, u) thermal decomposition, v) displacement, w) abrupt, local changes in formation pressures or temperatures, or x) abrupt, local changes in hydrocarbon composition or partial pressures. Several aspects of mobilization important to the present invention are shown in hierarchical form in FIG. 1.

Pyrolysis represents an important subset of mobilization methods in the present invention. It refers to the thermally-induced chemical decomposition (carbon-carbon bond scission) that occurs when certain organic materials are heated to high temperatures in the absence of sufficient oxygen to support combustion. When applied to a solid material or other substantially immobile resource so as to produce a substantially mobile fluid, a pyrolysis reaction may be referred to as retorting. A thermal "front" at which pyrolytic mobilization is occurring in a formation may be referred to herein as a "retort front". A hydrocarbon pyrolysis reaction occurring within a mobile fluid generally reduces the molecular weight of at least one species of hydrocarbon present in the mobile fluid is referred to herein as a cracking reaction. A cracking reaction may be a thermal or steam cracking reaction, a catalytic cracking reaction, a hydrocracking reaction, or any combination of these or other bone fide cracking reactions known in the art of petroleum refining. Many different cracking reactions are possible and are described in this and other applications in the art. Often, a cracking reaction may be assisted by steam, catalysts, hydrogen and other agents. Most commonly, pyrolysis, retorting and cracking involve the scission or rearrangement of carbon-carbon bonds within carbonaceous materials and result in release of carbonaceous materials that are of lower molecular weight than the original carbonaceous feedstock. Very high temperatures and very high levels of pyrolysis can favor deposition of insoluble, immobile and heat stable graphite and other carbon-rich structures that both enhance the thermal conductivity and improve its adsorption properties. As such, the post-treatment formation can serve a variety of municipal, environmental and industrial purposes. Moreover, the carbon deposits themselves represent a series of structures that have commercial value for use in composite materials, advanced electronic components and other high-value commercial and defense applications.

Economically recalcitrant high-carbon formations include tar and oil sands (e.g. bitumen), oil shale(s) (e.g. kerogen), certain coal formations (e.g. bituminous coal, lignite, etc) and petroleum fields at or beyond their secondary stage of recovery. These formations may contain mineralized or liquid carbon compounds, or both, but share the feature that the carbon present in the field is difficult (or impossible) to recover economically using methods known in the art. Whether liquid, gel or solid in form, the entrained carbon materials behave more as fixed-bed, than as flowing resources. For the purposes of the present invention, a resource of this kind is referred to as a fixed-bed hydrocarbon field or fixed-bed hydrocarbon formation (FBHF). In plural form, they may further be designated as FBHFs. The relative immobility of the carbonaceous resource contained in an FBHF maybe referred to generally as recalcitrance (as in a recalcitrant hydrocarbon). A material having such recalcitrance has limited fluid recoverability under normal formation conditions, and may further be designated as "substantially immobile".

The term hydrocarbon is also used throughout this disclosure to refer to molecular entities comprised primarily of carbon and hydrogen atoms, having a backbone comprised substantially of covalent carbon-carbon bonds. Although some carbon-containing deposits may also contain carbonaceous materials with other elements, such as nitrogen, phosphorous, sulfur, oxygen, and others. These hetero-atoms are typically present in low abundance and have little impact on the bulk properties of the deposit, or of the fluids released upon heating or mobilization of the materials present in the deposit. For this reason, such resource beds may still be referred to generally as "carbonaceous" or as hydrocarbon deposits, or as recalcitrant hydrocarbon formations. Likewise, it is recognized that some mineralized organic matter targeted by the methods of this invention that may be referred to as "hydrocarbon deposits" (e.g. coal, oil shale, etc) may not qualify as hydrocarbons under a strictly technical definition of the term. However, in the context of this invention, it is understood that such deposits, when heated to pyrolysis temperatures, release of a variety of hydrocarbons into the formation fluids. For the purposes of this invention, all such deposits may be referred to as "hydrocarbon" resources, deposits, material or beds, or more generally, as carbonaceous materials or deposits, or other similar terms.

The present invention provides a series of methods and systems useful in mediating, modulating, controlling, collecting and otherwise impacting the distribution of hydrocarbon products produced from a carbonaceous geological formation. Generally, the targeted carbonaceous formation will be one containing one or more substantially immobile carbonaceous resource deposit, referred to herein variously as a fixed-bed hydrocarbon (FBH) or fixed bed carbonaceous deposit (FBCD). The hydrocarbon products produced using the methods and systems often will be derived, directly or indirectly, by pyrolysis or by other means of mobilization from one or more of these carbonaceous resource deposits. Many of the methods and systems described herein rely in part on injection into a formation of one more specialized heated fluids, referred to as thermal energy carrier fluids (TECF). Typically, a series of wells are introduced into a given formation (e.g containing FBCD). Some wells are used to inject TECF (e.g. injection wells), while others are used to produce formation hydrocarbons and fluids. Still other injection and production wells may be used to modulate pressure and/or potentiometric surfaces in the formation, introduce additives, control formation fluid flow, modulate potentiometric gradients, allow for formation monitoring or measurements, and other uses.

The methods apply to a wide variety of carbonaceous deposits. They apply to coal formations that can have permeabilities ranging from very high to very low. They apply to oil shale formations which have traditionally been described as having very low permeability The methods also are applicable to various hydrocarbon deposits in which hydrocarbon-rich layers having low permeability or low transmissibility are positioned between higher permeability zones on two sides, such as above and beneath the hydrocarbon-rich, pay zone. Generally, the methods use natural permeability to advantage for the mobilization and production of hydrocarbons from such recalcitrant carbonaceous deposits. However, the methods are also equally applicable to deposits in which permeability has been enhanced artificially, such as through hydraulic fracturing or other formation fracturing methods.

Permeability suggests that there is, or can be, fluid transmission (i.e. communication) between two laterally or vertically separated points in a formation. Most often, such points in a formation are openings or wells installed in the formation by a skilled drilled crew using methods well known in the art. In permeable zones, fluid communication can be established between wells separated by distances of >100 ft. In many cases, communication can be established over much larger distances, such as 330, 660, 1320, 2640 and 5280 ft. Preferred formats for the present invention are those in which there is measurable fluid communication between wells positioned at least 50 ft apart within a formation, and more preferably, between wells positioned >100 ft apart and most preferably >500 ft. Often, injection and production wells are separated by at least about a half a mile (2640 ft) or more to achieve economic productivity while minimizing surface footprint. In treating multi-layer FBH formations, the methods of this invention are preferentially applied between or within the substantially permeable layers of the formation; and often target resource deposits in the lower permeability zones between them. When applied to low permeability formations, distances between injection and producing wells may be small (e.g. <50 ft, and often, <30 ft), unless artificial permeability is introduced. Without increased permeability, low permeability zones allow for only moderate volumetric productivity for a given well pair and may prove uneconomical. In such situations, well drilling, environmental stabilization and materials costs can be prohibitive.

In preferred embodiments, the methods of this invention are applied to a formation having multiple, permeability-differentiated zones. At least one injection opening and one production opening are introduced into the higher permeability zones of the formation and fluid communication established between them. The fluid communication thus established is used to advantage to mobilize hydrocarbons from at least one lower permeability zone within the formation. Hydrocarbons mobilized from the lower permeability zone(s) may be produced from the producing well, or from a second producing well that exhibits little or no fluid communication with the injection well. As such the carrier fluid injection and production methods of this invention are preferably applied to the higher permeability portions of multi-strata formations in which one or more adjacent zones exhibit lower permeability and higher hydrocarbon content than the higher permeability zone(s). In some embodiments, high permeability formations (and/or lithologic layers) are employed to treat adjacent, low permeability formations (and/or lithologic layers).

In same embodiments, both injection wells A and production wells B, as shown in the drawings, are positioned in a substantially horizontal and parallel orientation within a higher permeability zone in the formation, and at similar vertical depths within the formation. Introduction of perforations, or use of perforated casing, across a substantial portion of the horizontal segments of the wells allows for a broad, high-volume flux of TECF between the wells. Such a design can allow for very rapid heating of both the permeable zone and neighboring zones. In such embodiments, the broad, lateral flow of hot TECF within a permeable zone may serve to mobilize hydrocarbon from one or more adjacent lower permeability zone, and may also mobilize residual hydrocarbons within the more permeable zone.

In an example, a first substantially horizontal well is installed in a formation at a first vertical depth in a permeable stratigraphic layer within a multi-strata FBH formation. A second substantially horizontal well is installed in a second permeable zone at a second vertical depth in the formation, the first and second wells positioned over and under one another in parallel or nearly parallel orientation. Heated TECF is injected into the first horizontal well and circulated through one or more hydrocarbon-rich horizontal layer(s) so as to heat and mobilize hydrocarbon from the hydrocarbon-rich zone(s) and produce mobilized hydrocarbons fluid in the second horizontal well. The cross-zone permeability may be either natural or artificial. In preferred embodiments the permeability of one or both permeable zones is naturally occurring. In some embodiments, at least one lower permeability hydrocarbon-rich zone is positioned in substantially horizontal strata between the substantially horizontal injection and production wells. In other embodiments, a plurality of lower permeability hydrocarbon-rich zones are positioned in substantially horizontal strata between the substantially horizontal, permeable injection and production wells. Establishment of TECF flow between the intervening layers allows for mobilization and production of hydrocarbon from one or more substantially horizontal, low permeability strata. At least one mobilized hydrocarbon is removed from the produced fluids. In many embodiments, TECF is co-produced with mobilized hydrocarbon and at least a portion of TECF is recycled and/or recycled into the formation.

In several preferred embodiments, at least a portion of the hydrocarbon co-produced with TECF is used to heat TECF for subsequent injection into the formation. In some preferred embodiments, a hydrocarbon-rich formation fluid is produced from a production well that lacks substantial fluid communication with the TECF injection well. Such production wells are said to produce low-TECF hydrocarbon fluids. In some cases, low-TECF hydrocarbons lack injected TECF altogether. In others, they contain less than 20% of the TECF content that is found in production wells that comprise a functioning (flowing) in situ heating element.

In another example, a first series of substantially horizontal wells is installed in a formation, each at a similar first vertical depth as the others, so as to position the wells in a common, permeable stratigraphic layer within the formation. A second series of substantially horizontal wells is installed in a second permeable zone within the formation, each at a similar second vertical depth, and positioned in the formation so as to substantially overlap laterally the (stratigraphic) area in which the first series of horizontal wells were installed. Heated TECF is injected into the first series of horizontal wells and circulated in a plurality of zones so as to heat the intervening hydrocarbon-rich zones, mobilize hydrocarbons from said zones and produce mobilized hydrocarbons in the second series of horizontal wells. The cross-zone permeability may be either natural or artificial. In preferred embodiments the permeability of one or both zones is naturally occurring. In some embodiments, at least one lower permeability hydrocarbon-rich zones is positioned in substantially horizontal strata between the two sets of substantially horizontal, permeable injection and production wells.

In other similar embodiments, a plurality of lower permeability, hydrocarbon-rich zones are positioned in substantially horizontal strata between the two sets of substantially horizontal, permeable injection and production wells. In such embodiments, the establishment of TECF flow between the intervening layers allows for mobilization and production of hydrocarbon from a plurality of substantially horizontal, low permeability strata. At least one mobilized hydrocarbon is removed from the produced fluids. In many embodiments, TECF is co-produced with mobilized hydrocarbon and at least a portion of TECF is recovered and/or recycled into the formation.

While prevailing flow and pressure gradients will often favor flow of formation and injected fluids from higher depth (i.e. lower) layers toward lower depth (i.e. upper) layers, such prevailing flow patterns can be systemically and easily altered using the methods of this invention. In many examples, the natural flow direction is reversed using the methods of the present invention. As such, reversal or alternation of injection and production wells and layers can be adjusted during the course of operation of the methods and systems of the present invention. Likewise, potentiometric surfaces in the treated area and surrounding water control area can be adjusted so as to modulate, manage and reverse formation fluid flows.

In the methods and systems of this invention, injection wells play a key role in heating a formation. In some embodiments, super-heated steam or other hot fluid TECFs (including gases) flow from injection wells directly into the permeable zones of a formation as a means of delivering heat energy. A down hole combustion chamber may be used to produce the super-heated mixture that is then released into the formation. In other embodiments, a thermal carrier fluid is heated at the surface or within a subsurface heat exchanger. Heated thermal transfer fluid TECF is introduced into the permeable zones of the FBHF through one or more injection wells. In still other embodiments, the thermal energy source is in direct contact with the thermal carrier fluid. In preferred embodiments, TECF comprises: water or steam; a mixture having at least 50% water (or steam); a mixture comprising water (or steam) and hydrocarbon; a mixture of hydrocarbons; or a mixture comprising any one or more of the following hydrocarbons: methane, ethane, propane, butane, ethene, propene, butene, benzene, toluene, xylene, methylbenzene or ethylbenzene. TECF may also, at times, contains a variety of alkyl, alkene and phenyl substituted derivatives of the foregoing compounds.

The TECF is injected into the FBHF formation through one or more injection openings, and typically wells. In some preferred embodiments a surface or downhole (e.g. subsurface) combustion chamber is used to heat the TECF. In one example, heating occurs first through downhole combustion and is followed by injection of a separate mobile phase through the well bore such that the heating and mobility are communicated through different agents. In a more typical example, combustion products and other TECF components form an operational fluid mixture which is injected as the TECF from the injection well into the formation. In other embodiments, heating occurs in a plurality of distinct stages under operator control. The stages are characterized by distinct geochemistry and/or hydrocarbon chemistry that is detectable by analysis of one or more formation fluids produced in each heating stage. Analysis may be conducted using a wide range of analytical instruments or devices capable of assessing chemical or physical properties of produced fluids. These may include, among other tools, gas or liquid chromatography, spectroscopy, photometric scanning, and measurements employing conductivity, refractance, reflectance, circular dichroism, pH, ultrasonic and sonar detection, infrared, x-ray and other forms of illumination and detection. At times, analysis of the fluids produced in the various stages of heating is used by the operator or intelligent operating system to alter the product mix such as by varying one or more flow parameter, heating rate, well pressure, a TECF flow path or distance between the injection well and producing well, or diverting flow from substantially horizontal to substantially vertical, or vice versa. Chemistry may also vary in response to TECF or hydrocarbon residence time or by adjusting the time-temperature history accumulated by a hydrocarbon migrating through the formation.

Preferred embodiments comprise one or more injection wells operating continuously (e.g. continuously meaning heat injection operations are sustained for at least 8 hr per day for at least about 7 days consecutively or at least one interval of 3 days of non-stop operation) at temperatures exceeding 750° F. More preferred embodiments comprise one or more injection wells operating about continuously at temperatures exceeding about 1000° F. Most preferred embodiments comprise one or more injection wells operating about continuously and injecting TECF at temperatures in the range of 250-500° F., 501-750° F., 751-1000° F., 1001-1250° F. and 1250-2000° F. depending upon the thermal stability of the inorganic minerals of the rock, the recalcitrance of the hydrocarbon and the stage of heating.

In one example, each of the defined temperature ranges in the previous paragraph represents a distinct stage of heating. In this example, the TECF injection temperature is held in the defined range until there is a substantial drop in production of a least one hydrocarbon species that is mobilized and produced from the formation when it is heated to temperatures within the defined range.

In an embodiment, hydrocarbons are mobilized and converted within the formation to a mixture of hydrocarbons that is beneficially enriched in one or more hydrocarbon having energy or industrial value. Typically, enrichment is observed as an increase in proportion, partial pressure, mole-fraction or mass-fraction of a given substance in produced fluids over what is detected in produced formation fluids prior to start of hot TECF injection. In preferred embodiments, the produced hydrocarbon population is enriched in at least one of the following hydrocarbon products (or isomeric groups, where isomeric variation occurs in the formation): methane, ethane, propane, butane, pentane, hexane, heptane, octane, nonane, decane, ethene, propene, butene, pentene, hexane, heptane, octane, nonene, decene, benzene, toluene, xylene, methylbenzene, ethyl benzene, naphthalene, naphthalene or phenanthrene. In an embodiment, at least one produced formation fluid or fluid-derived residue is enriched in hydrogen, sodium or calcium salts or hydroxides; industrial, precious or rare earth metals, or the carbonate, sulfate, chloride, or other salts or oxides thereof; and/or other non-hydrocarbon mineral products. To enable this conversion(s), one or more heated TECF may be used to heat a portion of the fixed bed hydrocarbon formation to temperatures that allow pyrolysis of one or more hydrocarbons comprising the formation. Saturated and unsaturated hydrocarbons, hydrogen, and other formation fluids may be removed from the formation through one or more production wells. In some embodiments, formation fluids may be removed in a vapor phase. In other embodiments, formation fluids may be removed as liquid, vapor, or a mixture of liquid and vapor phases. Temperature and pressure in at least a portion of the formation is generally controlled during formation heating so as to improve yield of hydrocarbons and other products from the formation. Condensation, extraction, distillation, crystallization, evaporation or precipitation may be used to obtain one or more chemical product from the produced fluids. Such methods may also be applied to select product or fractions derived from produced fluids. Such operations may occur at or near to one or more to producing well(s), or in a central surface facility that is in fluid communication with one or more producing wells, or via an off-site operation.

In this invention, one or more heated TECF is circulated in a formation between at least one injection well and at least one producing well to heat the formation by a method comprising fluid communication between said injection and producing wells. Wells may be drilled into the targeted circulation zone in either vertical or horizontal orientation. In many examples, drilling and completing wells and casing of wells is done using conventional methods, equipment and tools. Typically, openings are formed in the formation using a drill. Initial well bores are typically vertical. When horizontal wells are desired, the turn toward horizontal generally occurs over several hundred vertical feet, and usually takes place along a turning radius of <20° of turn per 100 ft of depth. A steerable downhole motor is typically used to conduct the drill toward the horizontal orientation. A wide range of steerable drilling motors and bits are available in the drilling industry and may be selected based on the geology and other properties of the formation to be drilled. Well bores may be introduced into the formation by geo-steered and other drilling techniques. In some examples, openings are formed by sonic, laser or microwave-based drilling; electro-crushing or other electro-destructive techniques; and/or pulsed power drill bits or drilling systems. In preferred embodiments, communication between at least one injection well and at least one producing well is established within the boundary of a given carbon-rich seam (e.g. oil shale, etc), among a plurality of such carbon-rich seams in a given formation. In some embodiments, a plurality of wells is introduced into a formation, each in a horizontal or near-horizontal orientation and all contacting a common carbonaceous seam. TECF flow through the wells is used to advantage to mobilize hydrocarbon from the seam using one or more of the techniques described herein.

In some embodiments, one or more TECF injection wells may be placed in a defined two-dimensional or three-dimensional pattern within the formation to establish the rate or pattern of heating. Such patterned layout of injection wells may be matched with a corresponding pattern of producing wells. Regular, patterned placement of injection and/or producing wells may be used for a variety of purposes including, but not limited to: controlling the rate and/or pattern of heating; modulating or controlling progression of the retort front; modulating the population of hydrocarbons being produced at one or more of the producing wells within the formation; and the like. For example, in one embodiment, an in situ conversion process for hydrocarbons comprises heating at least a portion of an oil shale formation with an array of heat sources disposed within the formation. In some embodiments, an array or plurality of heat sources can be positioned substantially equidistant from a production well.

In one example, a formation bearing recalcitrant heavy oil in a permeable sand zone at depths of 1400-1600 ft is sealed by cap-rock above and below the target zone. To produce hydrocarbon from the formation, a single injection well is drilled from a first drill site into the permeable FBH formation to a depth of 1500 ft in the permeable formation. The well is cased with high temperature steel and cemented using tools well known in the art. Surface equipment necessary to heat and supply TECF, pressurize and regulate the injection well performance and flow are installed at the first drill site. A series of six producing wells are installed in a six point pattern around the central injection well using six additional drill sites. Each of the six producing wells is completed in the permeable zone at depths of 1500+/−25 ft. Surface equipment necessary to regulate pressure and fluid flow is installed at each producing well drill site. Produced fluids are conducted from producing wells by insulated surface pipe to a central surface facility where at least one non-condensable hydrocarbon is removed from the circulating fluid and at least a portion of the fluid is returned to the injection well for reheating and re-injection at the first drill site. Heated TECF at an initial temperature of about 250-400° F. is injected into the formation through the injection wells, allowing formation fluids comprising mobilized hydrocarbons to be produced from the producing wells. Following a period of initial production, injection temperature is increased to about 600° F. to provide for production of formation fluids comprising mobilized hydrocarbon from the producing wells. Following a period of production at about 600° F., the injection temperature is increased to 750° F. to provide for additional hydrocarbon mobilization and production from the formation. Following a period of production at about 750° F., injection temperature is increased to 900° F. to provide for additional hydrocarbon mobilization and production from the formation. Heating may increase either continuously or in step-changes, and may extend well above 900° F. in subsequent heating stages. Pyrolysis and pyrolytic mobilization of hydrocarbons in the formation increase with injection temperature.

Certain patterns (e.g. circular or elliptical arrays, triangular arrays, rectangular arrays, hexagonal arrays, or other array patterns) of wells may be more desirable for specific applications. Preferably, the thermal energy carrier injection wells are placed such that the distance between them is generally greater than about 100 ft and, more preferably, the distance between them is greater than about 150 ft. In some most preferred embodiments, the array of thermal energy carrier injection wells are placed such that the average distance between injection wells within the array is >300 ft. An array of injection wells may surround a single central production well, or a plurality of production wells. In some cases, multiple horizontal production openings extend outward from a single common vertical production well bore. In some cases, the configuration of injection and production wells is reversed, such that a single injection well bore feeds multiple production wells.

Further, the in situ conversion process for hydrocarbons may include heating at least a portion of the formation such that the thermal energy injection wells are disposed substantially parallel to a boundary of the hydrocarbons or, when environmentally preferable, to be substantially parallel to the major drainage pattern. Regardless of the arrangement of or distance between these injection wells, in certain embodiments, the ratio of heat sources (e.g. injection wells) to production wells disposed within a formation may be generally less than, or equal to, about 10, 6, 5, 4, 3, 2, or 1. As a general rule, the ideal spacing between heat injection wells is determined by a variety of factors, including the need(s) for: a) effective and controlled heating of the formation, b) sustainable/predictable economic productivity in a selected section of a formation, and c) minimizing the environmental 'footprint' of the operation.

Certain embodiments of this invention comprise designing, or otherwise allowing, heating zones associated with two or more thermal energy carrier fluid injection wells (e.g. heating zones) to overlap and thereby create superheated zones within the formation. Such super-positioning of thermal inputs may help to increase the uniformity of heat distribution in the segment of the formation selected for treatment. Moreover, superheated zones may be used to enhance production of desired products. For example, in addition to rapidly liberating light olefins and saturated light and liquid hydrocarbons from within these zones, mobile hydrocarbons generated elsewhere in the formation may be conducted transiently through these superheated zones to elicit further chemical conversion (for example, to bring about thermal cracking, chain rearrangement, and other desirable hydrocarbon chemistries). In an embodiment, a portion of a formation may be selected for heating, said portion being disposed between a plurality of injection wells. Heat from a plurality of thermal energy carrier fluid injection wells may thereby combine to bring about the in situ pyrolysis or other desired chemical conversion(s). The in situ conversion process may include heating at least a portion of an FBH formation above a pyrolyzation temperature of at least some of the hydrocarbons in the formation. For example, a pyrolyzation temperature for oil shale may include a temperature of at least about 520° F., or more preferably, at least about 700° F. For other carbonaceous materials, pyrolysis may begin at somewhat higher or lower temperatures. Heat may be allowed to transfer from one or more of the formation thermal energy carrier fluid flow paths to the selected section substantially by conduction outward from the primary fluid flow path of TECF injected from the injection well. More preferably, substantial heating occurs within the formation by direct transfer from the mobile carrier fluid to the formation rock.

In a simple form, the methods of this invention for producing hydrocarbon from a FBHF comprise: a) identifying and selecting of one or more fixed bed hydrocarbon formations; b) establishing one or more openings, typically, providing at least one functional injection well and at least one functional producing well; c) establishing a pathway of fluid permeability between one or more injection wells and one or more producing wells; d) injecting a heated thermal energy carrier fluid through an injection opening in the formation; e) providing for flow of injected fluid such that it flows from the injection opening toward one or more fluid production openings, f) establishing both a fluid heating zone and hydrodynamic communication between said openings; g) producing thermal energy carrier fluid from said one or more producing wells and h) producing mobilized hydrocarbon from at least one producing well in the formation. The methods may further comprise pyrolysis in one zone of the formation and subsequent non-pyrolytic mobilization from a second zone within the formation. The methods may further comprise the production of said hydrocarbons from producing wells in both zones the fluids having substantially different hydrocarbon or TECF content. In further optional methods, a single well bore may perform as both an injection and producing well by alternatingly increasing pressure to cause TECF to injection and then reducing pressure to cause production of the TECF and retorted products.

In some embodiments, the injection and production wells are installed at a similar depth in the formation. In others, they are offset vertically. Often, a vertical offset is used to target production of a hydrocarbon rich deposit or layer positioned substantially between the depth of a first injection well (or series of injection wells) and first production well (or series of production wells). Within a targeted resource formation, the depths of various injection and production wells may be varied so as to optimize thermal treatment of the targeted deposit. In addition, the function of injection and production wells may be reversed periodically during the treatment of a targeted zone within a formation. Generally, there is substantial lateral separation between injection and production wells, often exceeding about 300, 600, 900 or 1200 ft. Most preferably, separation between injection and production wells is at least about one-quarter mile, or 1320 ft. When a plurality of injection wells and/or production wells is used, the average separation between the plurality of injection wells (or associated production wells) is generally less than the average separation between the injection wells and their corresponding production wells.

In some examples the same drill site is used to establish both injection and production wells. This is particularly useful when installing horizontal wells at different depths from that drill site. In one such embodiment, a plurality of horizontal wells are drilled in a permeable portion of formation at substantially similar depths to one another and in a symmetrical arrangement around a common vertical well bore from which the plurality of horizontal well bores emerge into the formation. In one example, the vertical well segment provides a source of injection fluid to each of the several horizontal well emanating from it. The injection fluid is often a heated TECF supplied from the surface or heated by means of one or more down hole heaters positioned in the vertical portion of the well. In another example, each horizontal segment provides producible fluid to the vertical segment, from which fluids are produced at the surface.

The methods of this invention apply to any carbon-rich geological formation, including but not limited to those comprising the following carbonaceous resources: kerogen, bitumen, lignite, coal (including brown, bituminous, sub-bituminous and anthracite coals), liquid petroleum, tar, liquid or gel-phase petroleum, natural gas; shale gas; and the like. While applicable to liquid hydrocarbon formations, preferred applications include those wherein the carbonaceous materials are either mineralized (e.g. largely fixed in position), highly viscous, or rendered substantially immobile by entrainment in soils, sands, tars and other geologic materials.

While FBHFs may be found at any depth, preferred applications of this invention are those in which they occur beneath a substantial surface soil, mineral or oceanic over-burden. In preferred embodiments, the method comprises FBHFs found substantially at depths of >50 ft and <20,000 ft below a ground surface or an ocean floor. In more preferred embodiments, the method comprises FBHFs found substantially at depths of >500 ft and <10000 ft below a ground surface or an ocean floor. In the most preferred onshore embodiments, the invention comprises FBHFs found substantially at depths of >500 ft and <7500 ft. In preferred offshore embodiments, the combined earth and water overburden will generally be at least 1000 ft and, more preferably, at least 5000 ft. In other preferred offshore embodiments, the target formation and well openings are at least 2000 ft below the sea floor.

Methods and systems such as those outlined also differ substantially from methods currently known and/or used in the art of petroleum, natural gas and/or coal extraction. For example, in traditional oil and gas operations, injection of steam and/or other heated fluids is used to advantage to lower viscosity, overcome interfacial tension and elicit changes of phase within of certain formation fluids within a target formation. The heat so applied may elicit one or more changes in the physical properties of formation fluids. As used in the art, however, the injected heat is insufficient to cause hydrocarbon pyrolysis or to consolidate producible hydrocarbons into a mobile fluid phase. Hydrocarbon mobilization is enabled by the systems and methods of the present invention, such methods generally comprising: injecting hot TECF (e.g. >450° F., >550° F., or >750° F.) into a formation; flowing the TECF in the formation between at least one injection opening and at least one production opening in an in situ permeable zone to create a high-temperature, large area heating element capable of transferring pyrolysis and/or phase-consolidating heat by thermal conductivity to one or more carbonaceous deposits in the formation; producing a hydrocarbon-enriched or non-hydrocarbon mineral-enriched fluid; and removing at least a portion of the hydrocarbon or other minerals produced from the formation fluid. Typically, TECF is heated prior to injection to a temperature sufficient to cause substantial and/or controllable changes in the chemical compositions of one or more formation fluid, fixed-bed hydrocarbon (e.g. transformations in chemical structures due to one more intra- or inter-molecular chemical reactions) or inorganic mineral or rock matrix material. The instant invention provides for beneficial use of natural and man-made formation permeability to elicit substantial alteration in the hydrocarbon composition(s) or mineral content of one or more produced formation fluid.

Among the methods disclosed in this invention are some that provide for differential heating within an FBH formation, and the establishment of controlled, directional flow of materials through distinct hot-zones established within the formation. Hot zones may comprise one or more in situ heating elements, or may be established by conduction of heat through the rock matrix of the formation. Heat from one or more hot zones or in situ heating elements may be conducted in this way to a carbonaceous deposit, or to another permeable zone that is not in fluid communication with the TECF injection well or heating element giving rise to the conducted heat. Hydrocarbons and other products are produced from the alternative permeable zone. In most cases, such hydrocarbons contain little, if any, TECF. Establishing chemical and production control over a carbonaceous formation is a key objective of the present invention. The control is established by a combination of fluid and thermal circulation in the formation. Fluid control is exhibited, in part, in the circulation of injected hot TECF from one or more injection wells to one or more production wells to establish one or more in situ heating elements in the formation. Thermal control is established, in part, by this means and by the communication of heat from one or more in situ heating elements to the carbonaceous deposit(s) in the formation, and using such heat to mobilize hydrocarbons from the deposit(s). Hydrocarbon production control is established, in part, by conducting mobilized hydrocarbons from the site of mobilization to one or more production wells. Discussion of such controlled, in situ chemical processing is largely lacking in the prior art references cited herein, and from the larger body of publicly available literature. The present invention comprises tools and processes for mobilizing and transforming hydrocarbons from FBHF sources via a semi-controlled, thermal, catalytic and/or other reactive processes; and then producing the resulting materials through a series of one or more producing wells operationally linked to one or more surface transport pipes, condensers, collection vessels, distillation units, catalytic reactors, separators, compressors, evaporation or precipitation vessels, electrochemical separators, and or downstream separations and/or recycling operations.

Unlike traditional fire floods and/or steam floods, the methods of this invention provide for both temperature and flow control in an actively treated FBHF. Whereas traditional methods rely largely on random fractures and permeability within a target formation, the present methods are directed to substantially permeable formations in which material flow toward one or more producing openings is assisted or enabled, in whole or in part, by the directed flow of bulk phase TECF. In the methods of this invention, it is essentially the flow-rate, pressure, temperature, heat capacity, heat transfer and heat exchange properties of the TECF and other fluids that determine the rate and pattern of heating within the formation. Often, it is heat transfer from the mobile carrier by contacting at least a first porous or semi-porous portion of the FBHF with a heated TECF that provides for the primary heating of the FBH formation. Contacting a high-permeability, rapid-heating zone with at least about one or more additional low permeability zones allows for convective or conductive heat transfer due to the thermal conductivity of the rock. Said contact provides a second means of heating the targeted segment of the formation. In such an arrangement the mobile TECF creates a first heated FBHF zone. This first zone may provide the means of supplying thermal energy to a second zone. This secondary heating may be by way of a conductive and/or radiative process, transfer of thermal energy carrier fluid to a second zone, or other transfer methods.

Heat contained in produced formation fluids may be captured in the form of TECF and re-used for further heating within formation. Such heat capture may be done through any number of heat transfer devices and media, or by recirculating hot fluid into a heating chamber for heating and re-injection. Alternatively, excess heat may used for any number of purposes including electrical power generation, water purification, surface and building heat, and other purposes. In one example, the heat is transferred, directly or by heat exchanger, to water for the purpose of purifying the water. In a simple embodiment, water that is contaminated with formation salts, organic compounds, or various other forms of mineral, municipal, microbial or process contamination is heated by formation-recovered heat and the steam allowed to condense on a surface, or in any applicable condensing unit or on an applicable metallic surface, so as to produce and collect a large volume-rate of purified, distilled water. Water thus produced may be useful for municipal use, surface irrigation, pond or stream formation, and other uses. In some cases, water from aquifer control well surrounding the targeted formation is treated in this manner. In other examples, some or all of the water contained in the TECF recycle stream is removed by condensation, and optionally, subjected to additional cycles of distillation as described here. Combustion-derived water may be condensed from combustion exhaust using a similar strategy. Regardless of the origin of the water, formation heat may be applied to advantage to purify or separate process water from hydrocarbons and other minerals. Moreover, residues collected in the distillation process may be collected and further refined.

In one general form, the present invention employs one or more thermal energy carrier fluid (TECF) for a plurality of purposes. The first and most typical use is in the creation of a mobile, fluid (fluid flux) heating element extending through a region of substantial permeability from at least one point of injection to at least one point of production within a formation. This is often referred to herein as an in situ heating element. The mineral and carbonaceous materials in direct contact with the flowing heating element provide a secondary conductive and/or radiant heating surface. The carbonaceous materials in close proximity to the principle flux of TECF often undergo rapid retorting and/or mobilization such that permeability increases over time, as does the area of direct contact between the TECF and the formation solids. As such, the flux-based, fluid heating element is neither fixed in dimension nor in its maximal effective energy transfer by the distance between the injection well and the retort (or mobilization) front. Moreover, efficiency of hydrocarbon tends to increase with local increases in permeability. Importantly, a given hydrocarbon mobilization front often advances in a direction outward from, and largely perpendicular to, the principal axis(es) of the specific TECF flux vector(s) in the in situ heating element most directly associated with in the formation. Exceptions may occur when the injection and production wells associated with a given hydrocarbon mobilization front are housed in the same well bore, or when a secondary fluid is used to transfer heat from an in situ heating element to a portion of the formation that is not in direct, stratigraphic contact with the permeable zone containing the heating element.

In some embodiments, the in situ heating element is established in one zone within the formation, producing TECF with a mixture of formation fluids from the heating element production well. The heat conducted to a second zone mobilizes hydrocarbon from the second zone. Formation fluids produced from the second zone are produced from a second well and are substantially free of injected TECF. In certain preferred embodiments, at least a portion of the hydrocarbons produced from the heating element producing well provide fuel for a subsequent round of heating and reinjection of TECF into the heating element via the heating element injection well. In some embodiments a portion of hydrocarbons from the low TECF producing well may be added used to heat TECF for injection into the formation. Production of hydrocarbon-rich, low-TECF formation fluids using the methods of this invention are particularly applicable to heavy oil and secondary/tertiary oil recovery operations.

The methods of this invention provide for the control of formation water using a plurality of barriers. Often, at least one barrier is created by one or more naturally occurring low permeability zones located within close proximity to the region being actively treated (e.g. retorted). Often, at least one barrier comprises establishing one or more hydrodynamic boundaries between one or more actively treated areas and one or more surrounding (e.g. untreated) portions of the formation. In preferred methods, the methods of this invention employ a plurality of hydrodynamic barriers and/or methods to establish elevated potentiometric surfaces within the formation surrounding an active retort segment. Such elevated potentiometric surfaces dramatically slow or eliminate egress of formation fluids from the contained treated zone. In some embodiments, a hydrodynamic containment barrier may comprise the migration of one or more fluids from at least one untreated portion of the formation (e.g. areas outside the containment barrier) into the treatment area. In some embodiments, a hydrodynamic barrier may comprise the injection of water or thermal energy carrier fluid. While the specific methods and well configurations are highly varied, they generally involve use of well defined formation engineering tools to establish local hydrodynamic control of fluids within a formation.

In some embodiments, an elevated potentiometric surface is established by drilling/developing a series of 'outer' (e.g. distal) water injection wells and one or more series of concentric 'inner' (e.g. proximal) injection and/or producing wells. The wells may be directional in orientation, such that injection occurs in an inward direction. Typically, the outer wells are operated at a supra-formation pressure and provide for a net inward flow of aquifer water into the treatment area or the water-producing wells surrounding it. Horizontal water control wells may also be established above or below a treated area so as to further enhance water control around a treatment site. Such wells may provide a supply of mineral-rich water that may be treated using other methods known in the art of solution mining to isolate, concentrate or purify valuable minerals from the formation fluids, such as by distillation, evaporation, precipitation. To this end, heat from TECF or produced fluids may be used to enhance rate and efficiency of such purification. These methods may be used in produce industrial metals and salts from target formations, and to release purified water in or around the formation. Within the treatment area, bulk flow of thermal energy carrier fluid from injection wells to producing well is substantially higher than the inward flow of formation water such that there is a net 'dragging' of water into the thermal energy carrier fluid stream and little diffusion of hydrocarbon fluids into the surrounding water. What hydrocarbon does diffuse into the treatment aquifer is captured at the inner water-producing wells. Hydrocarbon may be stripped from the produced waters under vacuum, distilled, evaporated, incinerated, biotreated, or removed using any of the many hydrocarbon removal methods known in the art.

These and many other approaches and methods for well drilling and well preparation are well known in the art. Other methods for preparing well bores suitable for use in the present invention are also described in one or more of the working examples described in this invention.

DETAILED DESCRIPTION OF THE PREFERRED EMBODIMENTS SHOWN IN THE DRAWINGS

In FIG. 1, a relationship between certain forms of in situ mobilization are illustrated and discussed above.

Figure 2:
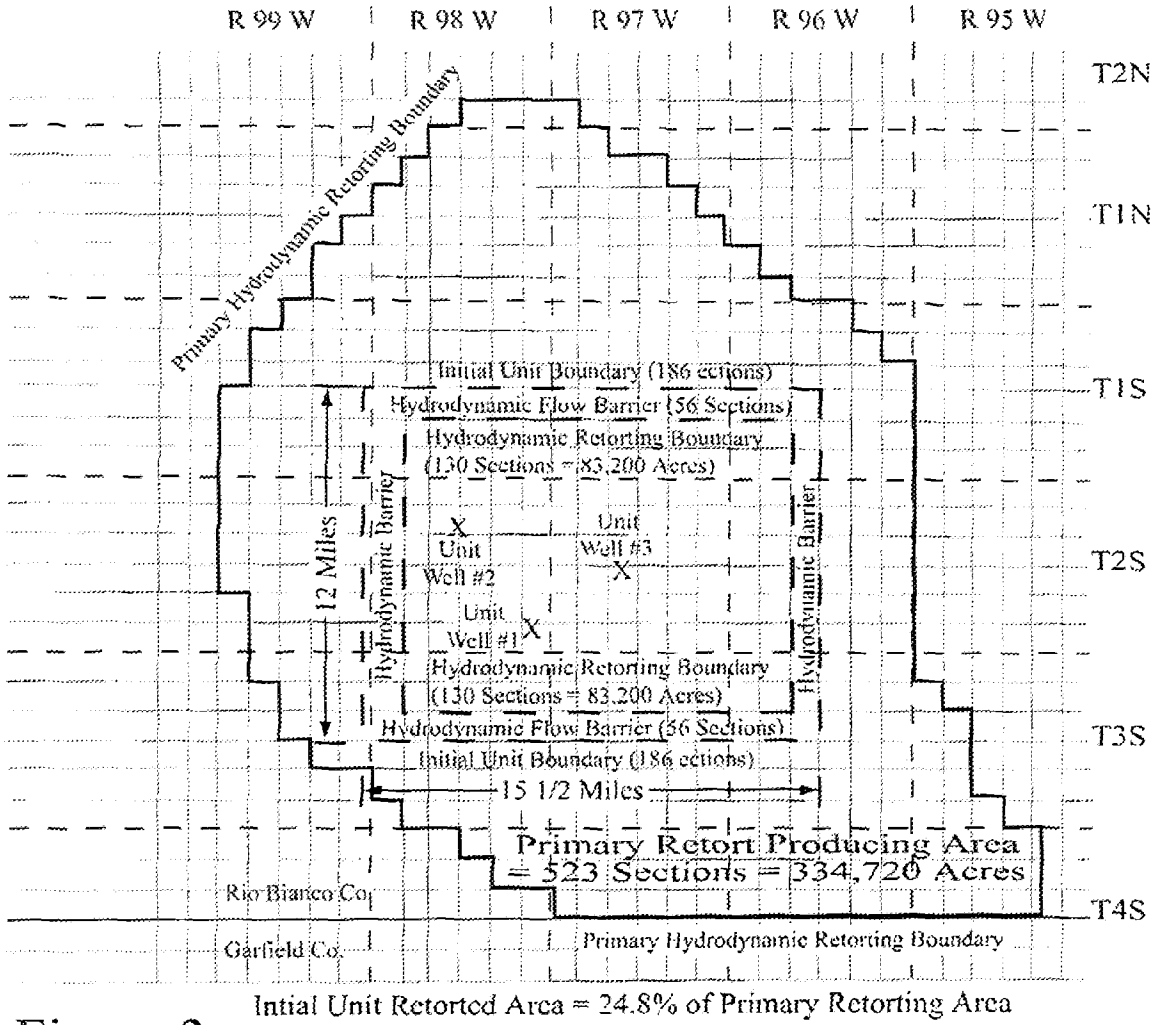
FIG. 2 is a map of a hydrocarbon production area found in Garfield county and Rio Blanco county, in western Colorado.

In FIG. 2, a comprehensive, large-area development plan is shown for production of hydrocarbon from a preferred oil shale resource in Garfield County and Rio Blanco County, in western Colorado. This figure illustrates both the scale and limits of formation development using the methods described herein and the essential nature and positioning of hydrodynamic control boundaries established using the methods of this invention.

Figure 3A:
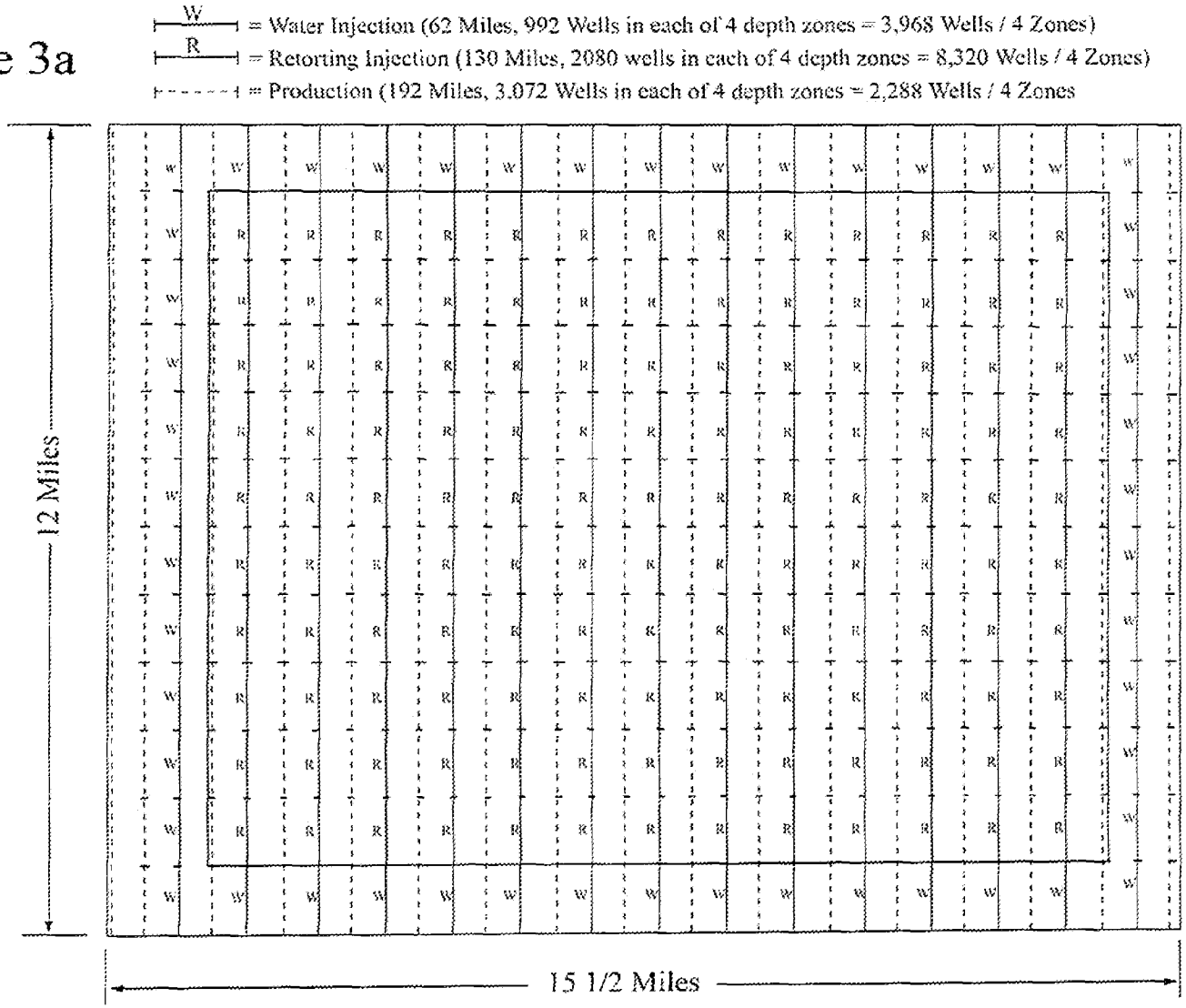
FIG. 3*a* is a grid map illustrating Stage A of the use of water injection wells and production wells used in the subject method of hydrocarbon retorting and extraction.
Figure 3B:
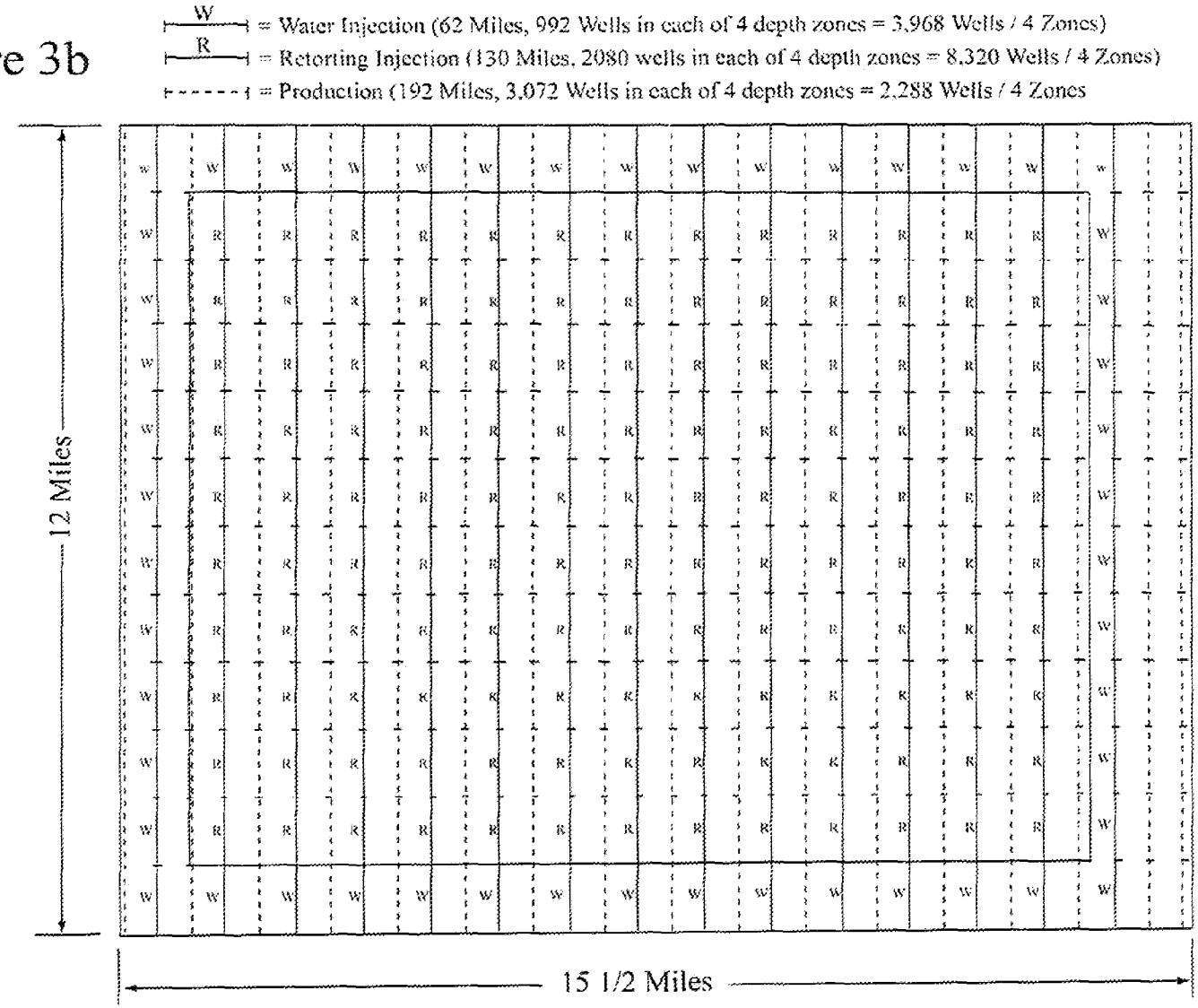
FIG. 3*b* is another grid map illustrating Stage B using water injection wells and production wells used in the method of hydrocarbon retorting and extraction.

In FIGS. 3*a* and 3*b*, interchanging roles between various lines of injection wells and production wells are shown for incorporating the development plan, shown in FIG. 2. The locations of lines of water injection wells for hydrodynamic perimeter control are indicated by the letter, "W". For each 1 mile segment, there is at least one and as many as sixteen water control wells, depending on the hydrodynamic control requirements in the formation. Solid lines labeled with the letter "R" indicate lines of injection wells used for treatment of a formation with the thermal energy carrier fluid (TECF). Typically, hot TECF is injected into the formation, causing mobilization of hydrocarbon, and allowed to circulate to one or more production wells. Lines of production wells are indicated by dashed lines in the site development grid. Typically, an injection well is paired with at least one production well, and the lines of production and injection wells have similar spacing. Typically, individual injection wells within a one mile segment of injection wells are separated by a spacing of 300 to 1000 ft. Also, complementary segments of production wells are spaced at distances of 300 to 1000 ft. Separation between injection and production lines is typically at least 1000 ft to 11000 ft, or more preferably, ¼ mile, ½ mile, 1 mile or 2 miles. In this and other examples, the function of injection and production wells may be reversed periodically during a hydrocarbon recovery operation. This interchangeable role is illustrated by the differences between FIGS. 3*a* and 3*b*. In preferred oil shale applications, injected TECF supplies pyrolysis heat to the formation, resulting in mobilization of the hydrocarbons from the fixed bed hydrocarbon deposits.

Figure 4:
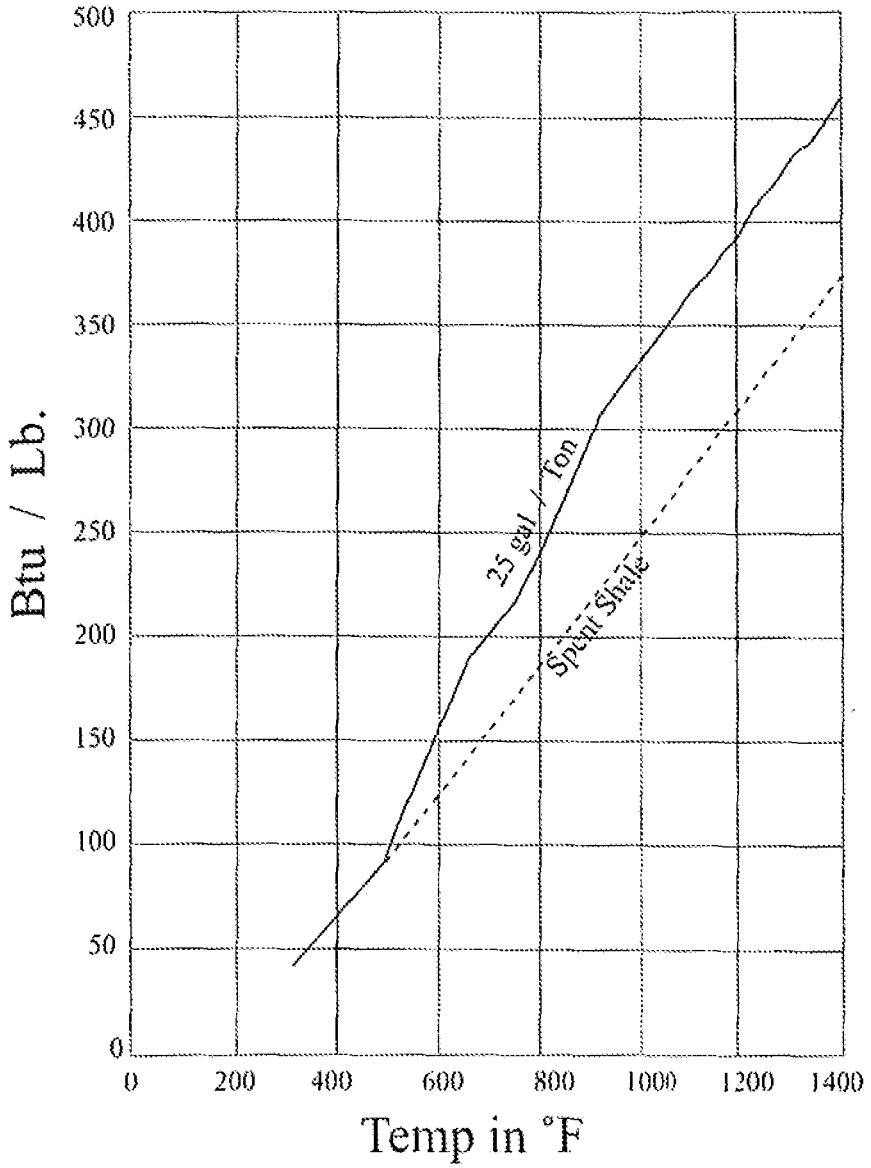
FIG. 4 is a plot graph for estimating energy, in BTU per lb. of rock, recoverable from a preferred oil shale deposit.

In FIG. 4, a plot showing the estimated energy (in BTU per lb of rock) recoverable from a preferred oil shale deposit at various retorting temperatures is shown. Similar plots can be produced for other resource formations and may be refined to a high degree of precision by characterization of core samples from target formations.

Figure 5:
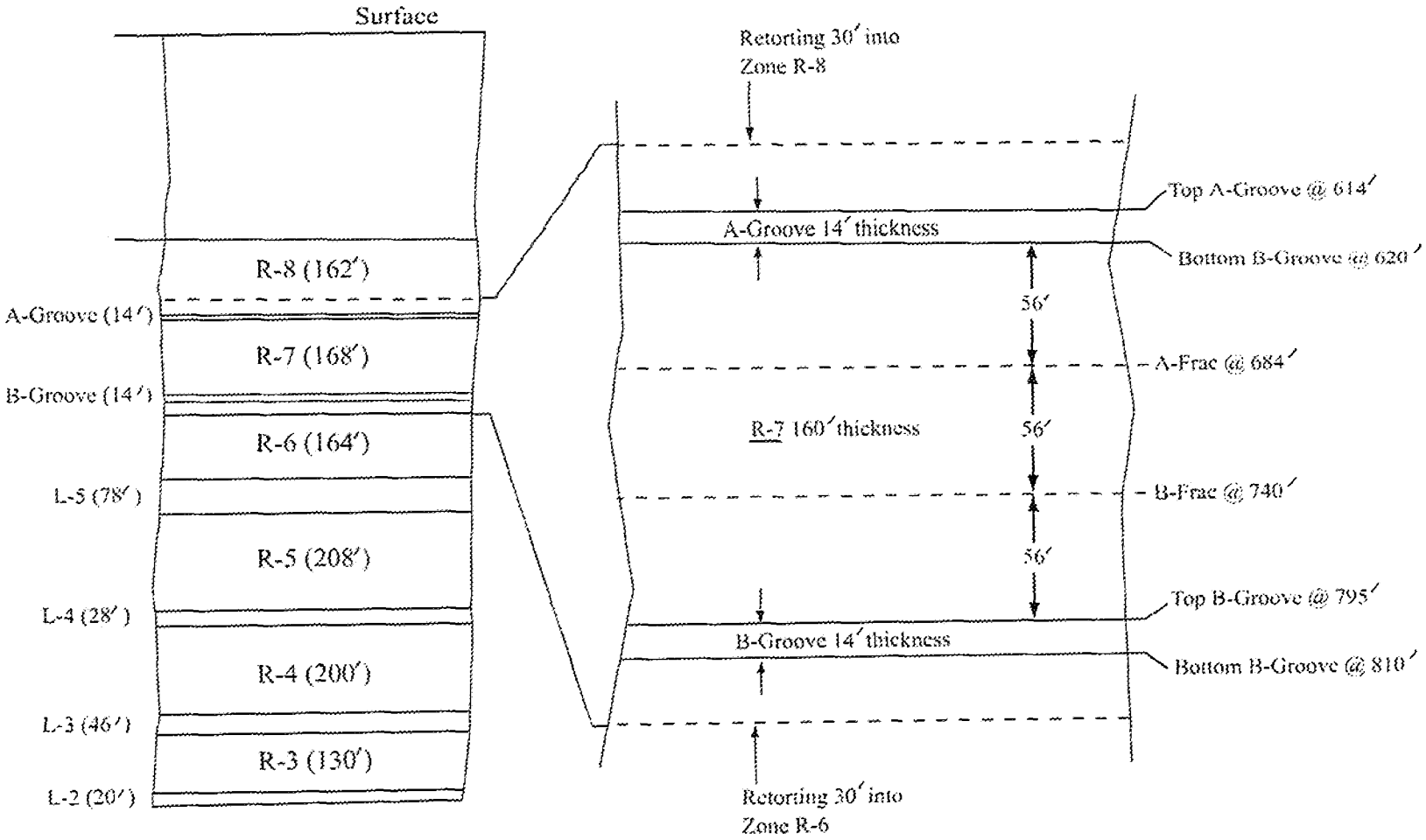
FIG. 5 illustrates a stratigraphic column in a preferred in situ oil shale retorting formation.

In FIG. 5, alternating high and low permeability layers found in many fixed bed carbonaceous deposits are illustrated. This figure illustrates a stratigraphic column from a preferred in situ oil shale retorting formation. Such geological layering is common in many fixed bed hydrocarbon formations. In the present invention, higher permeability layers are used to an advantage in mobilizing the hydrocarbons in lower permeability zones. In deposits such as shown in FIG. 5, mobilization typically includes pyrolytic decomposition and other means.

Figure 6A:
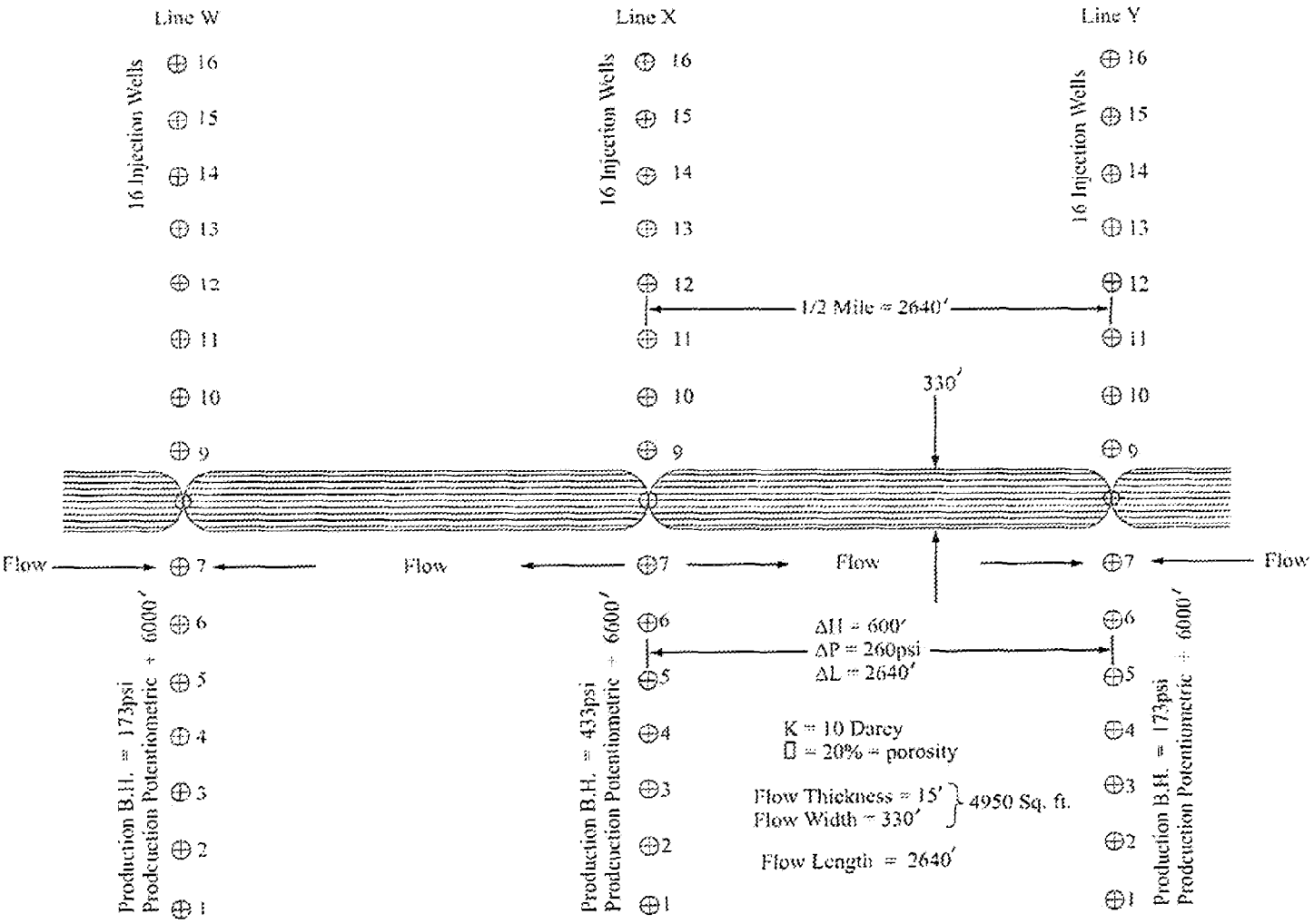
FIG. 6*a* shows the direction of TECF flow from a line of injection wells to a line of production wells. The wells completed in the B-Groove and B-Frac, illustrated in the stratigraphic column in FIG. 5.
Figure 6B:
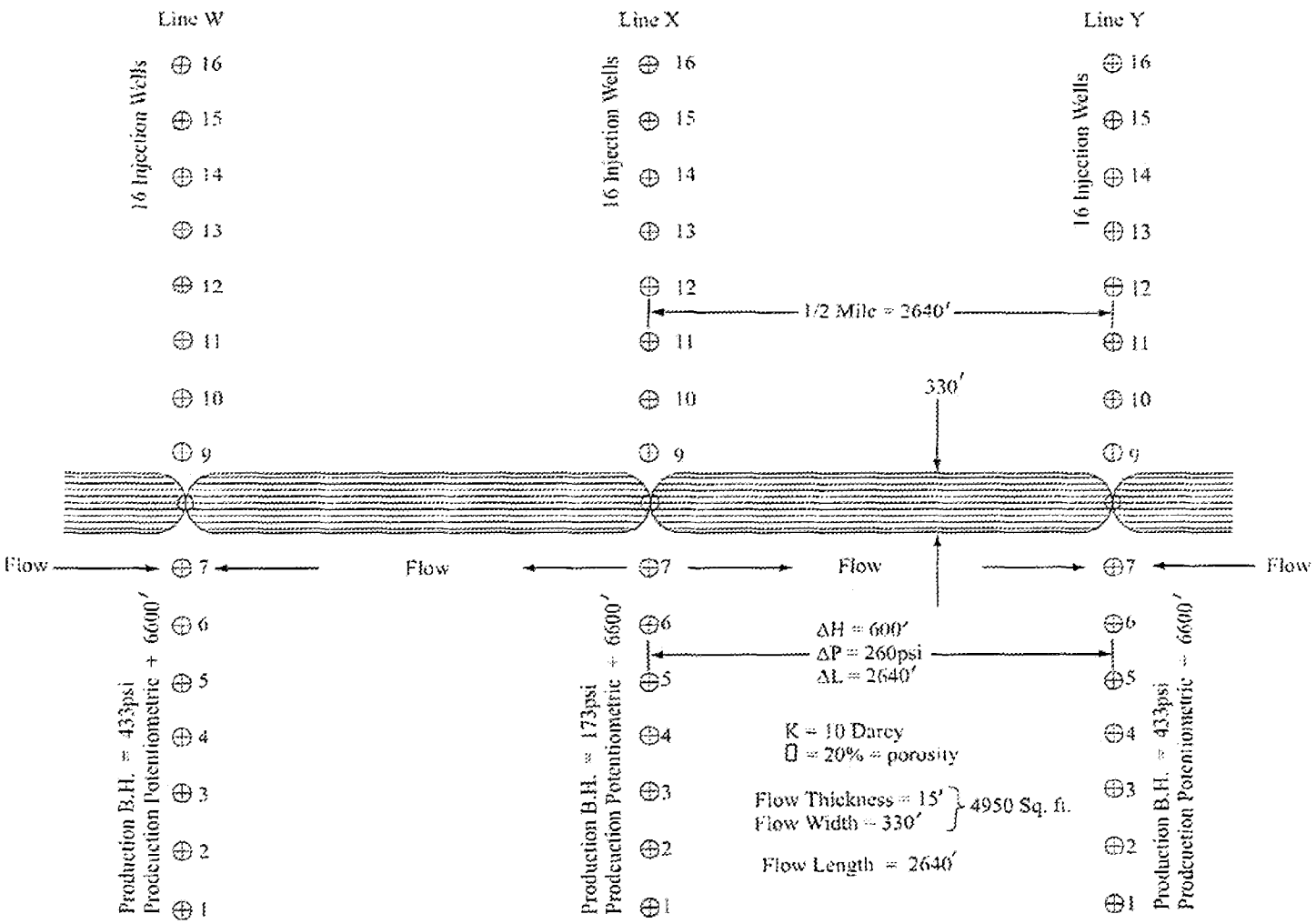
FIG. 6*b* shows the reversing of the TECF flow from the injection wells to the production wells shown in FIG. 6*a*.

In FIGS. 6*a* and 6*b*, three lines (W, X and Y) of 16 wells are illustrated and completed into both a B-Groove and a B-Frac, shown in FIG. 5. FIG. 6*a* illustrates the linear flow path from one of the injection wells in the line of injection wells in line "X" to the corresponding production well in the line of production wells in lines "W" and line "Y," respectively. This geometry of injection and production wells creates a dominantly linear flow for the TECF from the line of injection wells (X) to the lines of production wells (W and Y). In this example, the linear-flow, hydrodynamic gradient is a 600-ft head loss over 2,640 ft, or 0.227 ft/ft, which would be equivalent to 0.098 psi/ft in a horizontal aquifer. In Stage 1, the hydrodynamic flow in aquifers "B-Groove" and "B-Frac" is linearly away from the injection wells in line "X" and toward the producing wells in lines "W" and "Y." In Stage 2, illustrated in FIG. 6*b*, the hydrodynamic flow is in the opposite direction from the injection wells in lines "W" and "Y" and toward the production wells in line "X."

Figure 7:
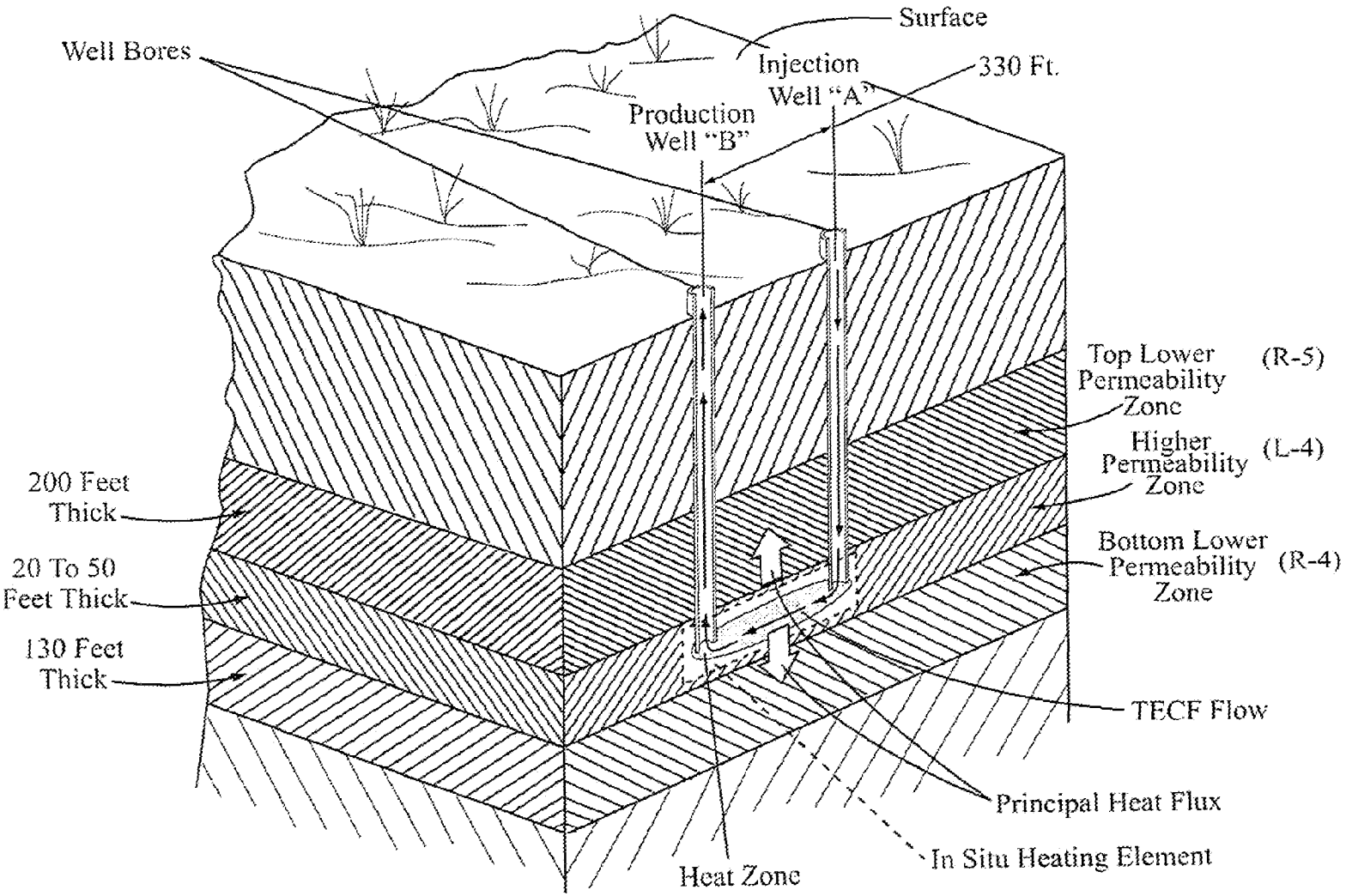
FIG. 7 is a perspective view of an injection well and a production well used for circulating TECF through a higher permeability zone disposed between a top and a bottom lower permeability zone.

In FIG. 7, a perspective view of an in situ heating element (ISHE) is shown inside dotted lines. The ISHE uses a higher permeability zone (L-4) to mobilize hydrocarbons from an adjacent bottom lower permeability zone (R-4) and/or an adjacent top lower permeability zone (R-5). While these particular zones are shown in FIG. 5, it should be kept in mind that similar R zones and L zones along with A and B grooves can be used equally well for hydrocarbon extraction.

In this drawing, the large arrows indicate a direction of principal heat flux from the in situ heating element during the heating phase. The smaller arrows, in the shaded elliptical heat zone or heat bubble, illustrate a direction of principal flow of the TECF from the injection well A toward the production well B, and the direction of decreasing temperature within the heating element.

The ISHE includes a portion of the higher permeability zone (L-4) adjacent to the two lower permeability zones (R-4) and (R-5), well bore openings in the bottom of wells A and B in the higher permeability zone, fluid communication between the injection and production openings, using the higher permeability of the (L-4) zone, the TECF capable of carrying thermal energy into or out of the ISHE by means of the injection and production wells A and B, a higher temperature end (e.g. oriented toward the injection opening during the heating phase) and a lower temperature end (e.g. oriented and production opening during the heating phase).

In a more developed form, the ISHE further includes: a means to add heat to, or capture heat from, the TECF and retorted hydrocarbons received through the production well B and a means to recirculate at least a portion of the TECF and the hydrocarbons back to the ISHE in the formation. As shown in this drawing, the ISHE is preferably bounded by a lower permeability zone on two sides, such as above and below. In many applications, one or more lower permeability zone adjacent to an ISHE comprises a hydrocarbon-rich zone. Often, the lower permeability zone is a stratigraphic layer.

Figure 8:
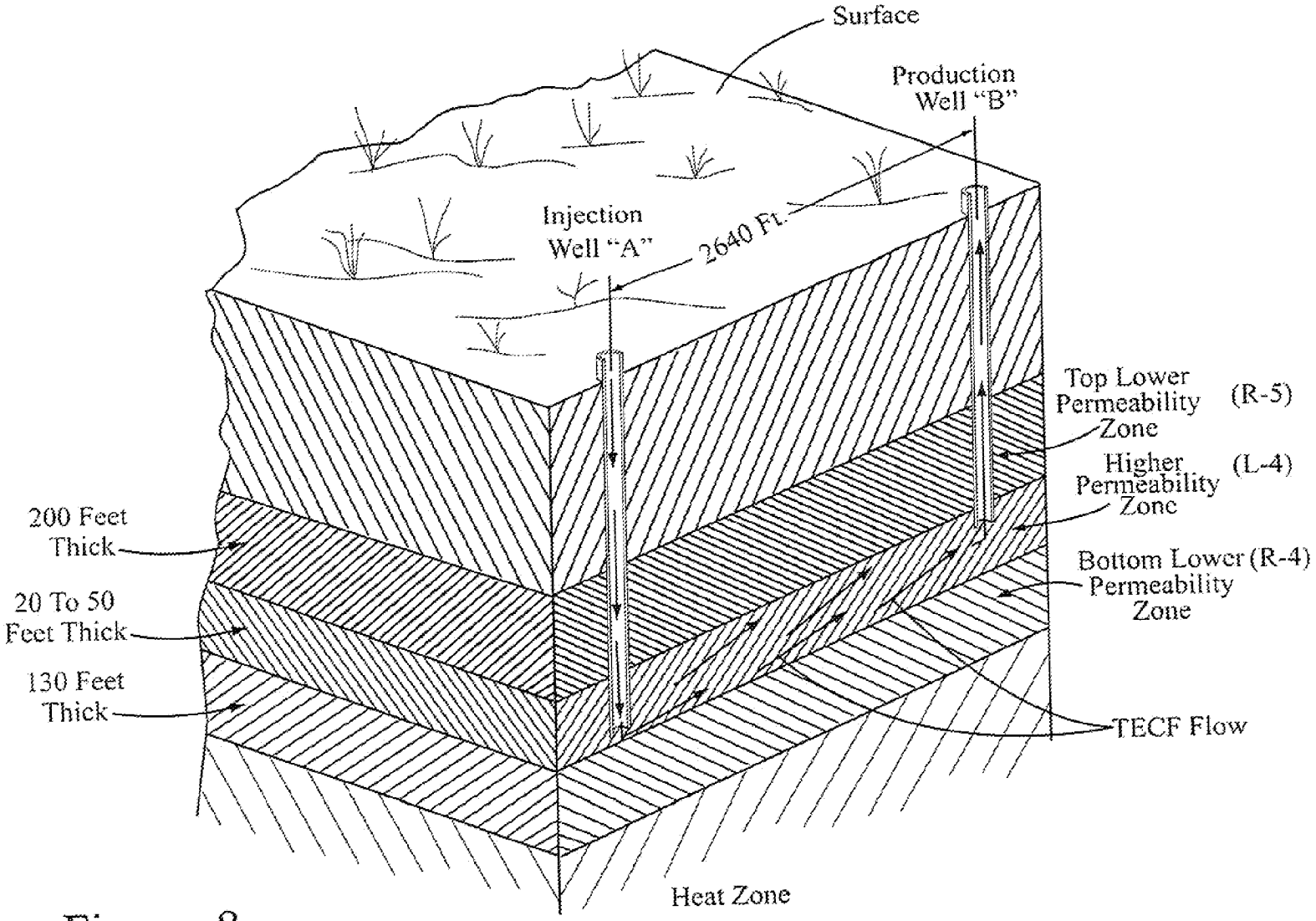
FIG. 8 is similar to FIG. 7 and illustrates the injection well and the production well with different vertical depths in the higher permeability zone and with increased well spacing between the wells.

In FIG. 8, two vertically offset openings are shown in the bottom of the vertical wells A and B and positioned in the hydrocarbon-containing higher permeability zone (L-4). The wells are shown disposed apart at a distance of 2640 ft and a vertical separation in a range of 20 to 50 feet and greater, depending on the thickness of the higher permeability zone.

In this illustration, the heated TECF is injected into the higher permeability zone through the opening in the bottom of well A and allowed to circulate upwardly and toward the upper opening in the bottom of well B. The deposition of mobilizing heat occurs as the TECF circulates in through the higher permeability zone, causing hydrocarbons to co-migrate, with TECF toward the opening in well B, as shown by arrows moving from left to right. It should be noted, the TECF flow can be reversed, with the production well B used as an injection well and the injection well A used as a production well While not illustrated here, typically, the fluid produced at well B comprises formation fluids, hydrocarbons and the TECF. Surface operations provide for removal of at least one selected hydrocarbon and the reheating and recycling of at least a portion of the TECF back into the formation through Well A, or another injection well.

Figure 9:
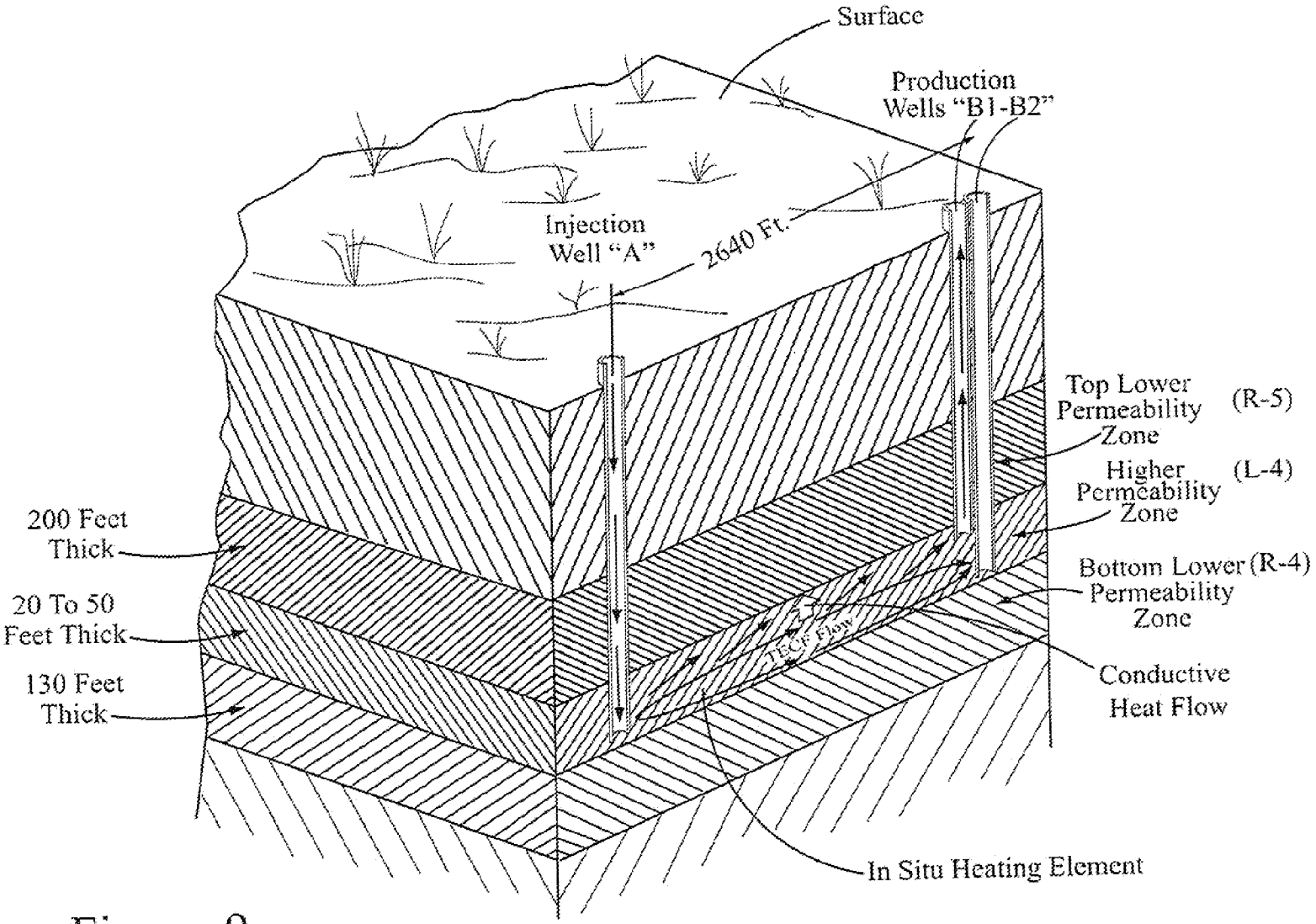
FIG. 9 is similar to FIGS. 7 and 8 and illustrates the injection well and a pair of production wells at different depths in the higher permeability zone.

In FIG. 9, a derivative of the FIG. 8 example is shown containing at least three openings in the higher permeability zone L4. Specifically, FIG. 9 illustrates a version of the invention in which at least three openings are introduced into the higher permeability zone through injection well A and production wells B1 and B2. In the illustration, well A remains unchanged from FIG. 8. But at the production site, the opening in the bottom of well B1 is disposed near the top of the higher permeability zone and the opening in the bottom of well B2 is disposed near the bottom of the higher permeability zone.

The horizontal permeability between the opening in well A and the opening in well B2 exceeds that between well A and well B1, thus limiting fluid communication from the openings in well A to well B1. This limitation allows the operator to establish the in situ heating element, ISHE, between openings in well A and well B2. As illustrated, TECF provides for mobilization and production of hydrocarbons from the lower portion of the higher permeability zone. By contrast, conductive heat flow (indicated by the large, upward pointing arrow) from the ISHE, provides for mobilization of hydrocarbons from the upper portion of the higher permeability zone. Production of the mobilized hydrocarbons from opening in well B1 can occur without co-production of TECF. In another similar derivative of this model, a second opening can be introduced in the upper portion of the higher permeability zone from the well site A, and used to produce hydrocarbons from the upper portion of the higher permeability zone.

Figure 10:
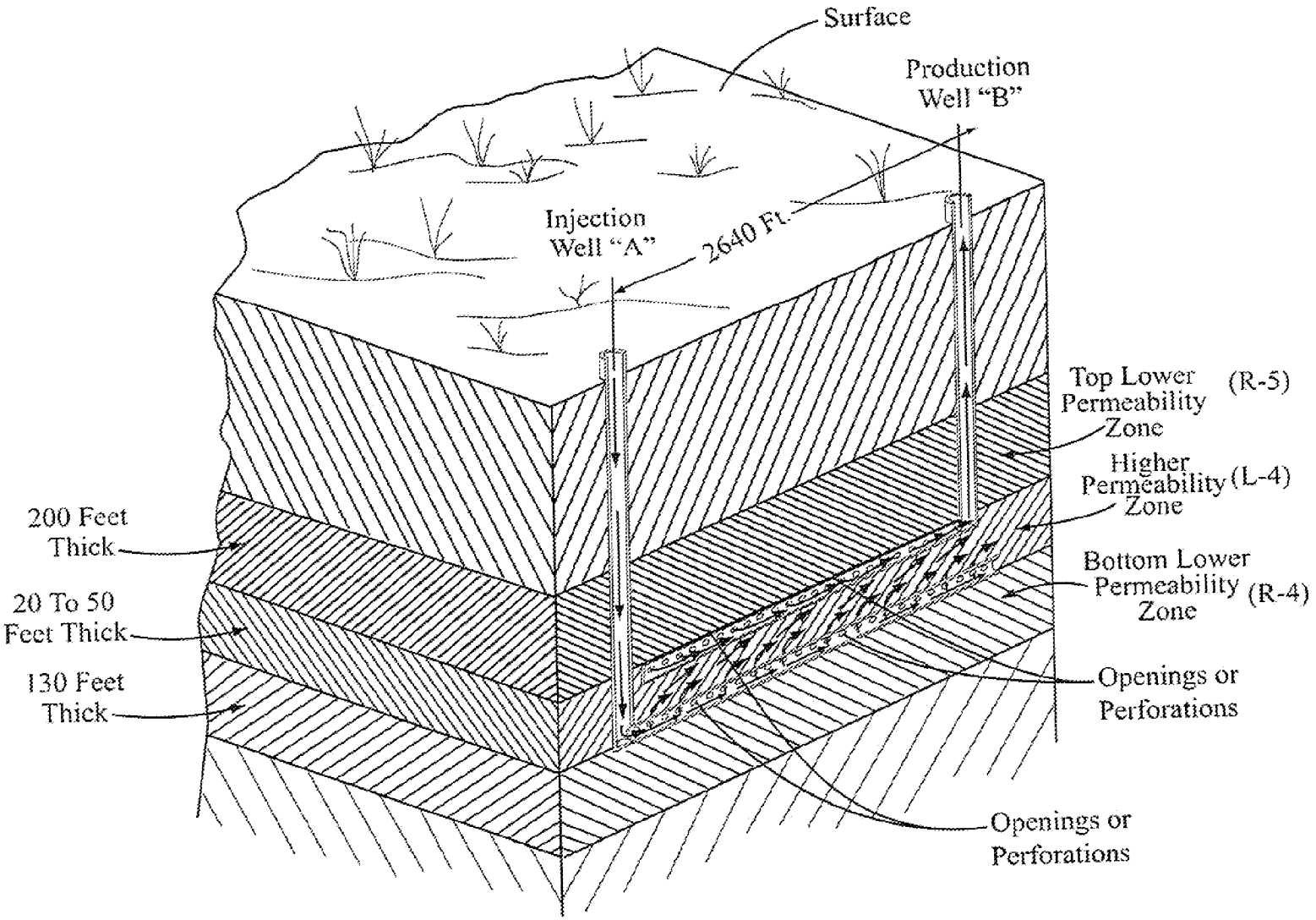
FIG. 10 is similar to FIG. 8 but with the injection and production wells drilled horizontally along a portion of the length of the higher permeability zone.

In FIG. 10, vertical wells A and B are shown with a lower portion of the wells directionally drilled horizontally into and along a portion of the higher permeability zone (L-4). In this drawing, the horizontal portion of well A is shown disposed along a length of a lower portion of the zone for injecting the TECF through holes or perforations into the zone. The horizontal portion of well B is shown disposed along a length of an upper portion of the zone. As the TECF migrates upwardly under fluid pressure, the hydrocarbons are mobilized, as indicated by arrows. The mixture of hydrocarbons and TECF is then received through holes or perforations in the horizontal portion of well B and moved upwardly to the production site on the ground surface.

Figure 11:
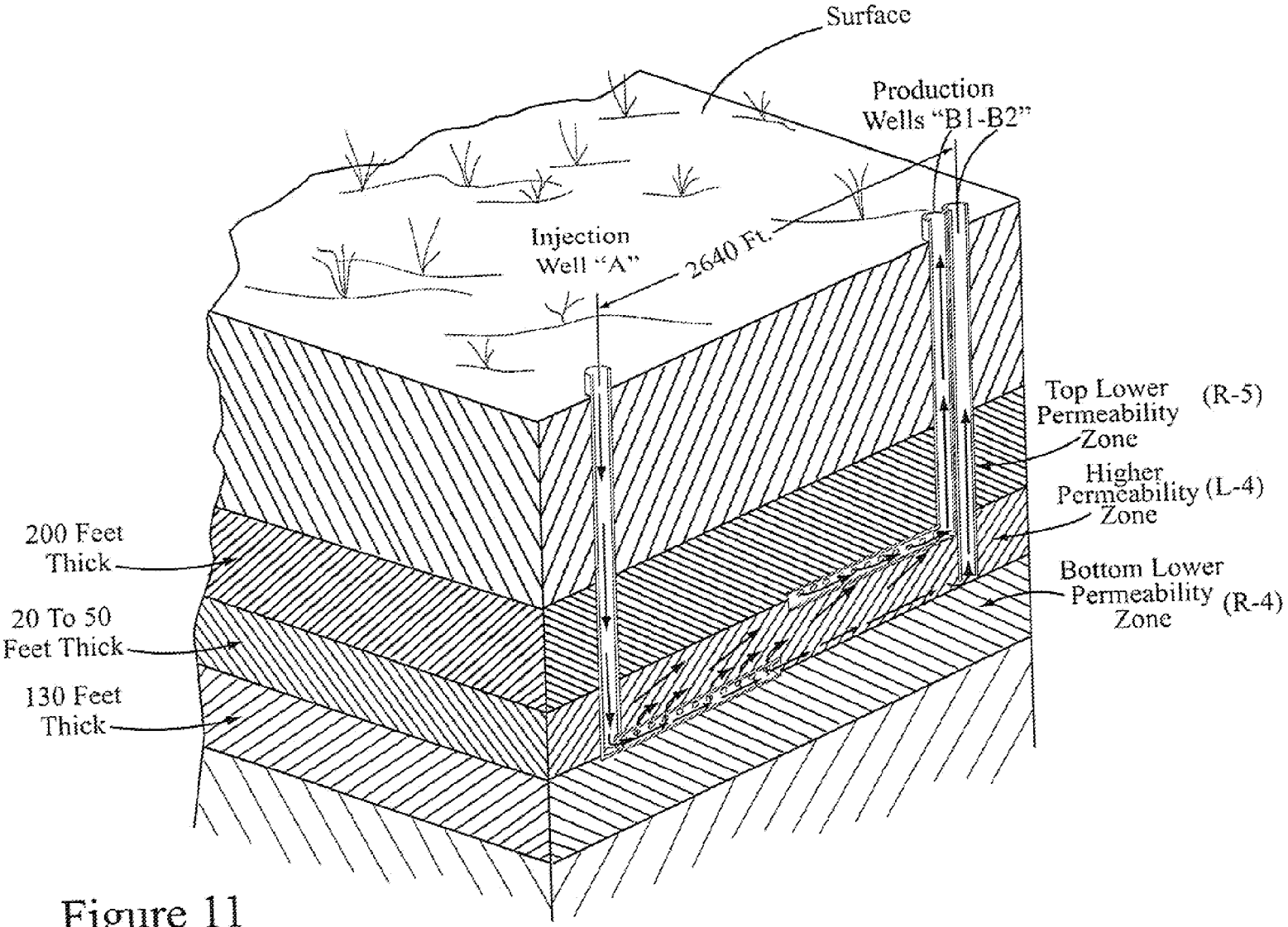
FIG. 11 is similar to FIG. 9 but with the injection well and one of the production wells drilled horizontally along a portion of the length of the higher permeability zone.

In FIG. 11, injection well A and production wells B1 and B2 are shown and similar to the wells shown in FIG. 9. But in this embodiment of the subject invention for extracting hydrocarbons in situ, wells A and B1 include a directionally drilled horizontal portion along a length of the higher permeability zone at the bottom and the top of the zone. As shown by the arrows, representing the flow of the TECF, the fluid flows upwardly from the holes in the horizontal portion of well a to the horizontal portion of well B1.

Also shown in this drawing is the TECF flowing outwardly and horizontally from the opening in the end of well A to the opening in the end of vertical well B2, the opening in the end of wells A and B2 are at the same depth near the bottom of the higher permeability zone. From reviewing this drawing and the other drawings shown herein, it can be appreciated that various configurations of vertical injection and production wells and vertical injection and production wells including directionally drilled horizontal portions of the wells can be used to extract hydrocarbons throughout the higher permeability zone and lower permeability zones adjacent above and below the higher permeability zone, as described herein.

Figure 12:
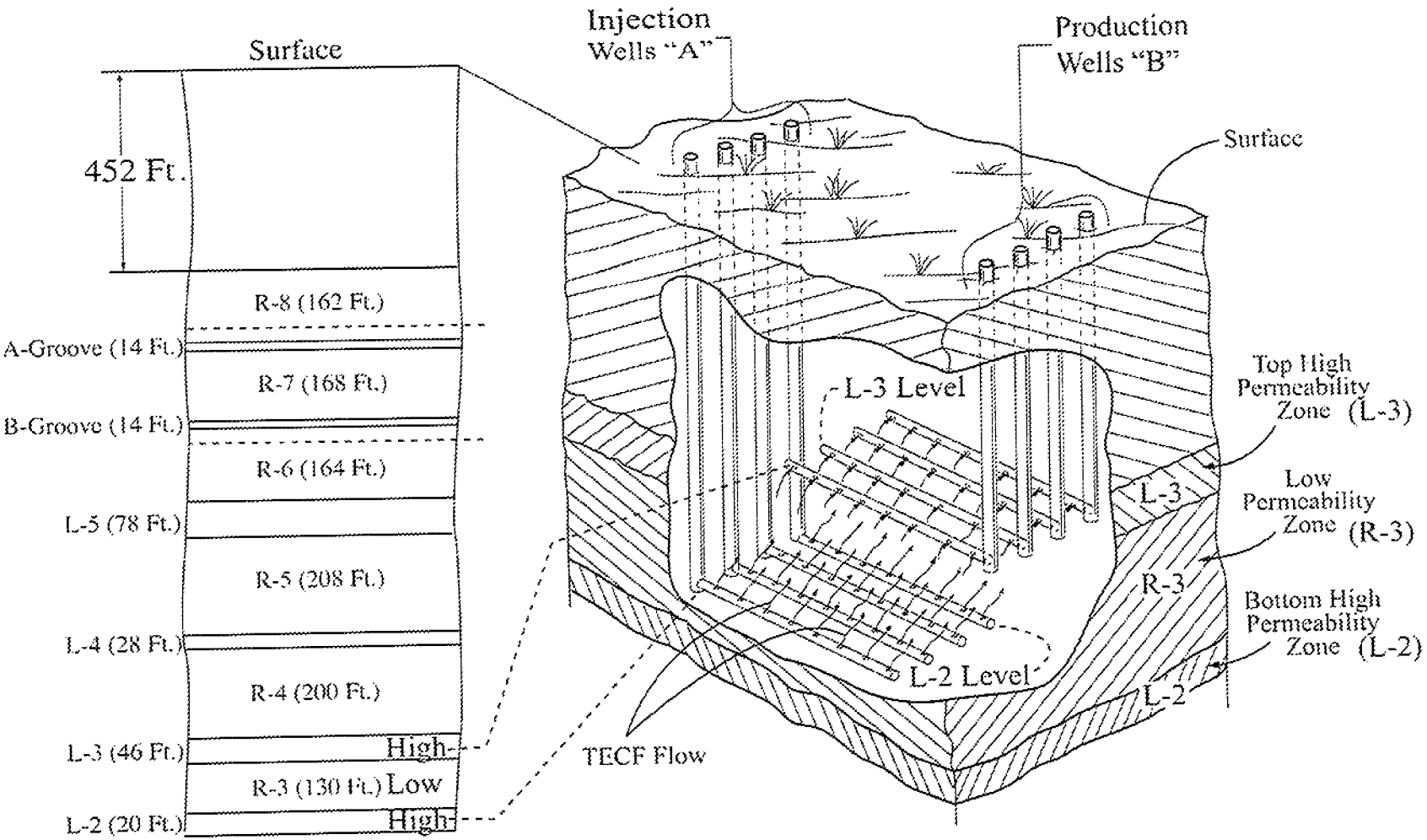
FIG. 12 is a perspective view of a plurality of vertical and horizontal injection wells in a bottom high permeability zone and a plurality of vertical and horizontal production wells in a top high permeability zone with a lower permeability zone disposed therebetween.

In FIG. 12, another embodiment of the subject invention is shown for extracting hydrocarbons from a lower permeability zone disposed between a top and bottom higher permeability zone. In this example, the lower permeability zone R-3 is shown disposed between a top higher permeability zone L-3 and a bottom higher permeability zone L-2. Obviously from looking at the stratographic column on the left side of this drawing, the A-Groove and the B-Groove can be used for extracting hydrocarbons from the lower permeability R-7 or the B-Groove and higher permeability zone L-5 used for extracting hydrocarbons from the low permeability zone R-6, etc.

In this drawing, a plurality of spaced-apart injection wells A are drilled into the bottom of the higher permeability zone L-2 with the horizontal portion of the wells discharging TECF upwardly, as indicated by arrows, for heating and mobilizing the hydrocarbons found in the lower permeability zone R-3. The travel of the TECF and the extraction of the hydrocarbons is enhanced by fissures and fractures found in this particular zone. As the mixture of the TECF and the mobilized hydrocarbons travel upward, the mixture is received through the holes in the plurality of horizontal portions of production wells B extending along a length of the higher permeability zone (L-3) next to the top of the R-3 zone.

Figure 12A:
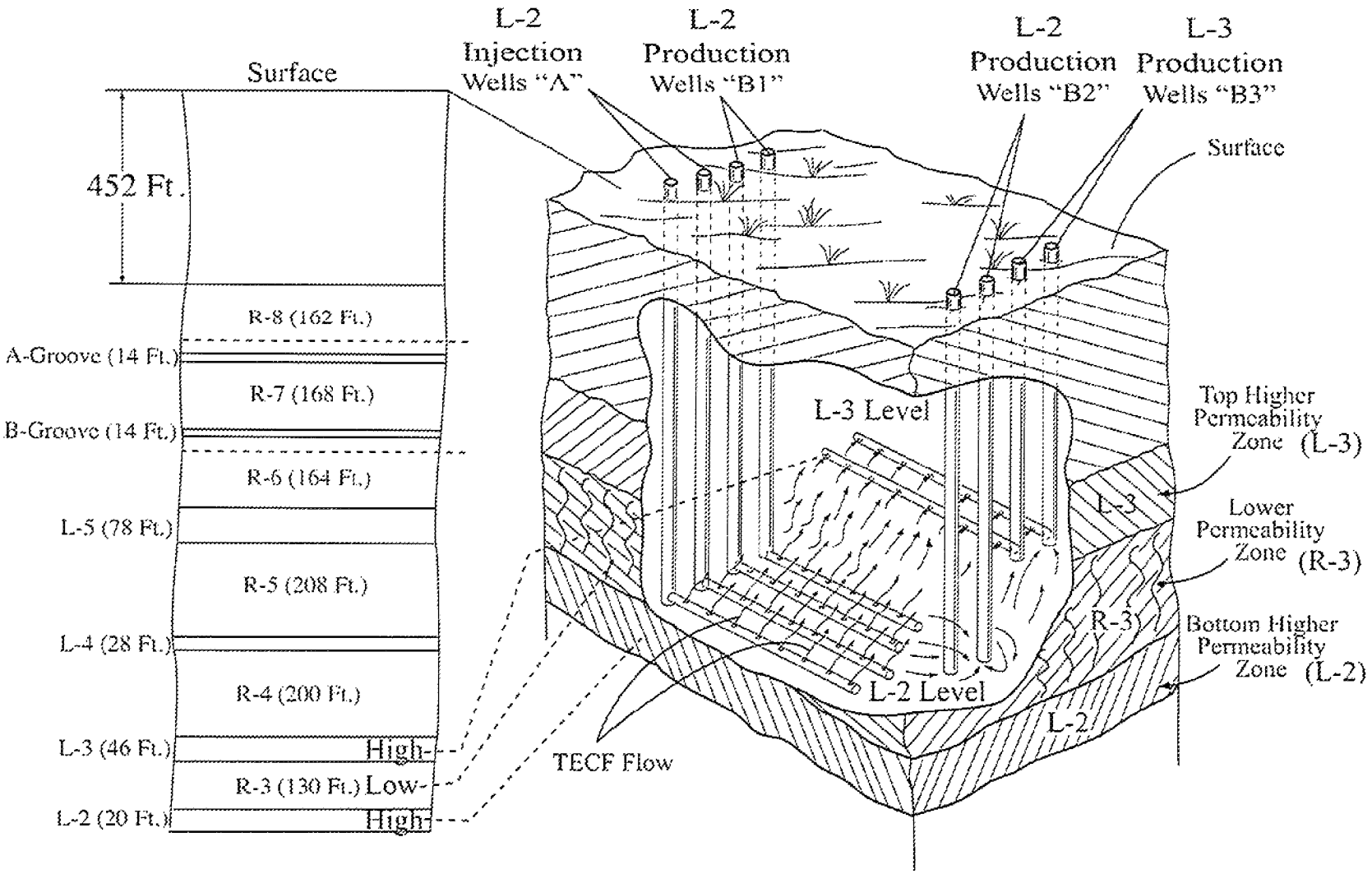
FIG. 12A is another perspective view of a plurality of vertical and horizontal injection wells and production wells in a top and bottom higher permeability zone with a lower permeability zone disposed between to the two higher permeability zones.

In FIG. 12A, a pair of injection wells "A" are shown on the left side of the drawing with a vertical portion of the wells extending into a bottom, higher permeability zone (L-2). The A wells include, optionally, a horizontal portion with perforations for injecting TECF into the zone. The A wells can be used for circulating the carrier fluid throughout the L-2 zone and creating the ISHE and heating the adjacent lower permeability zone (R-3). Circulation of TECF may be from the A wells into a set production wells that comprise a vertical well bore, a horizontal well bore, or both in the L-2 zone.

In this drawing, a pair of production wells "B1" are shown on the left side of the drawing with a vertical portion of the wells extending into the L-2 zone. As drawn, the B1 wells include a horizontal portion with perforations therein. The B1 wells can be disposed above or at the same depth in the L-2 zone, for receiving the carrier fluid and the mobilized hydrocarbons in this zone. In addition, the B1 wells may be at about the same depth as the A wells, or may be at a different depth in L-2 than the A wells. As mentioned herein, the B1 wells can be switched periodically to injection wells and the A wells switched to production wells with the direction of the carrier fluid reversed for increased production of the mobilized hydrocarbons in the L-2 zone.

Shown on the right side of the drawing is another pair of L-2 production wells "B2", with a vertical portion only. These B2 wells can extend to various depths in the L-2 zone for receiving the carrier fluid and the mobilized hydrocarbons from the ISHE area created in the L-2 zone. The B2 wells may operate as an alternative to, or in addition to the B1 wells illustrated on the left portion of FIG. 12A. One or more of the B2 wells illustrated on the right of FIG. 12A may, alternatively, have a perforated horizontal segment positioned in the L-2 zone and be used to produce. In some embodiments, the horizontal wells A and B1 on the left of the figure may alternate independently between injection and production wells, or all operate together as either injection or production wells. As illustrated, the primary purpose of the wells positioned in zone L-2 is the establishment of an ISHE capable of mobilizing hydrocarbons from a neighboring lower permeability zone (e.g. R-3), and producing at least a portion of the mobilized hydrocarbons in a separate set of production wells located in a third zone (e.g. L-3).

Also shown in FIG. 12A is the lower permeability zone (R-3), which may be heated by thermal conductivity from the ISHE or by direct fluid contact with TECF from the ISHE. R-3 is shown to have vertical fractures and fissures, which may or may not provide for fluid communication from L-2 to L-3. However, such fissures can be used effectively for circulating a mobilized hydrocarbon-containing fluid upwardly from the R-3 zone to mobilize hydrocarbons in the L-3 zone. The hydrocarbons, with or without carrier fluid are then produced into the top higher permeability zone (L-3).

Yet another pair of production wells "B3" are shown on the right side of the drawing with a vertical portion extending into the top higher permeability zone (L-3). The B wells include a horizontal portion extending along a length of this zone. These B3 wells are used for extracting the mobilized hydrocarbons (and, optionally, the carrier fluid) circulated upwardly through the fractures and fissures in the R-3 zone, and then into the L-3 zone. Fluids produced in the upper B3 wells comprise hydrocarbons derived from the L-3 zone. The roles of the L-2 and L-3 zones may also be reversed provided an ISHE is established in the L-3 zone.

A primary feature of this example is the potential to produce hydrocarbon-enriched fluid by a method that employs heat from an ISHE while minimizing or eliminating co-production of TECF with the hydrocarbon.

From reviewing FIG. 12A, it can be appreciated by those skilled in the art of extracting hydrocarbons in situ from various types of geological formations that various combinations of vertical wells and vertical wells with horizontally drilled portions of the wells disposed in a higher permeability zone can be used interchangeably as injection or production wells for effective mobilization and extraction of hydrocarbons found therein.

Figure 13:
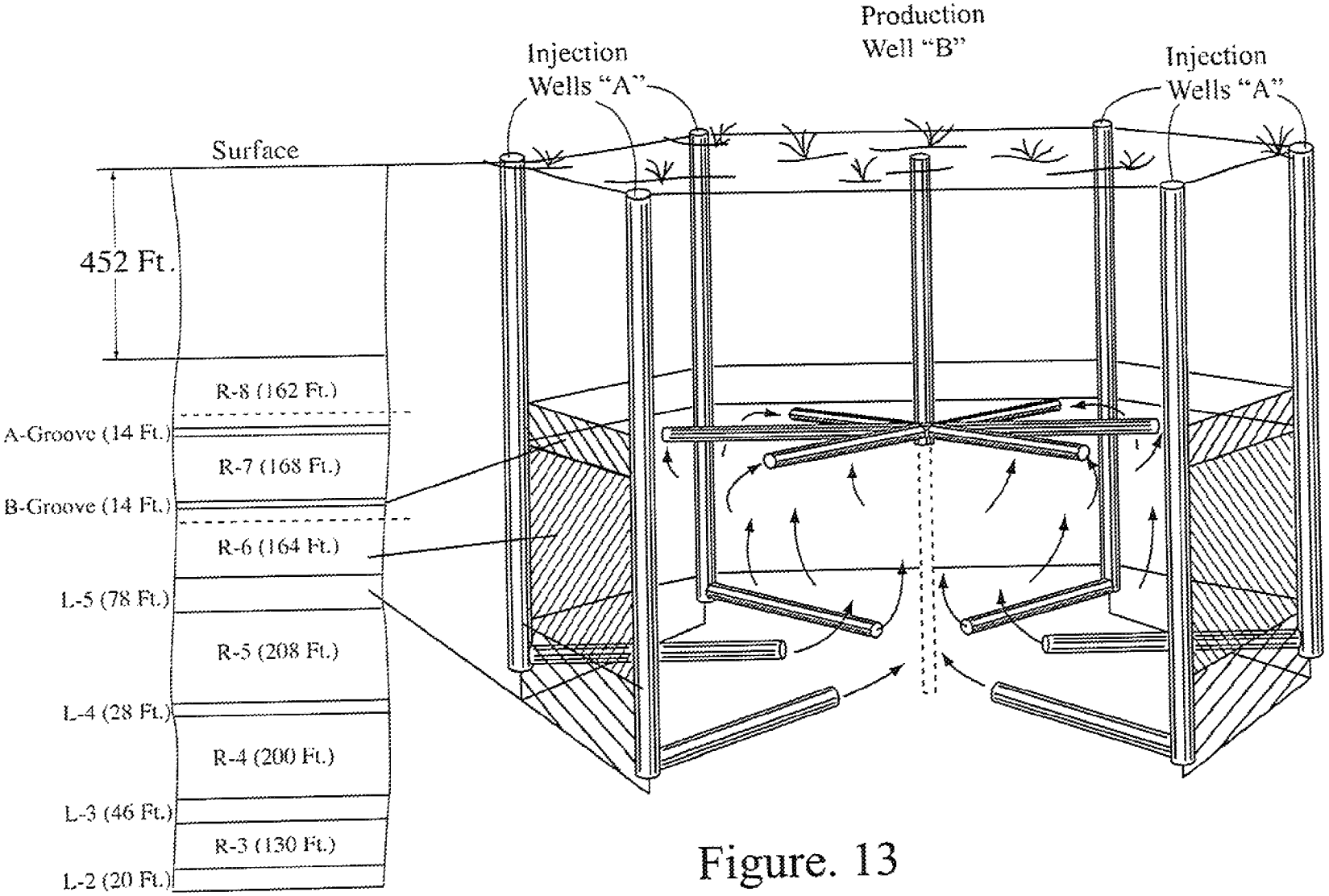
FIG. 13 is a perspective view of a plurality of vertical and horizontal injection wells in a bottom high permeability zone and a vertical and horizontal production wells disposed in a top permeability zone with the lower permeability zone disposed therebetween.

In FIG. 13 a perspective view of a central production well B is shown surrounded by a set of six injection wells A. In this example and similar to what is shown in FIG. 12, the injection wells A and the production well B are used for extracting hydrocarbons from a lower permeability zone R-6 by using higher permeability zones B-Groove and L-5 on opposite sides of R-6.

The six injection wells A include horizontal portions or arms of the wells extending inwardly into the highly permeability zone L-5. The TECF is injected under pressure upwardly from the horizontal portion of the wells into and through the lower permeability zone R-6 for mobilizing hydrocarbons therein. The production well B is shown with six horizontal portions or arms extending outwardly into the bottom of higher permeability B-Groove. The six horizontal portions are used to receive the TECF and hydrocarbon mixture therein, which is pumped to the ground surface through the vertical portion of well B. It should be noted and after a period of time, the roles of the central production well B and the perimeter wells A can be reversed in function, such that TECF injection occurs through the horizontal arms of well B and the production is of the hydrocarbons and the TECF is though the lower horizontal portions of the wells A.

Figure 14:
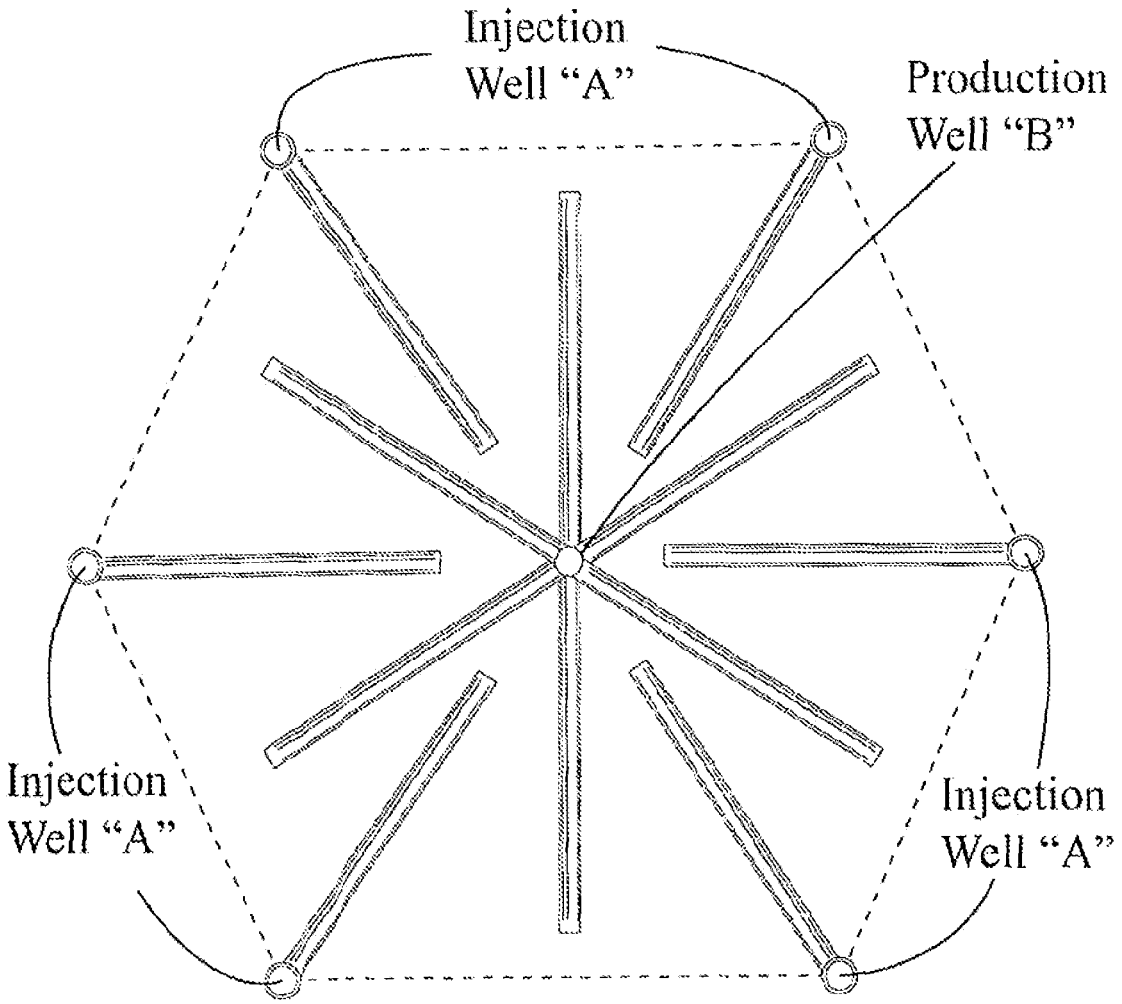
FIG. 14 is a top view of the injection wells and the production well shown in FIG. 13.

In FIG. 14, a top view of the vertical and horizontal portions of the wells A and the central production well B is shown. In this drawing, arrows illustrate the flow of TECF upwardly toward the horizontal arms of production well B.

EXAMPLES RELATED TO THE SYSTEMS AND METHODS USING THE SUBJECT INVENTION

Example 1

Identification of Several Oil Shale Resource for Development Using the Systems and Methods of this Invention Hydrodynamically-modulated, in-situ retorting of oil shale and other hydrocarbon formations may be conducted using the methods of this invention. In an embodiment, successful retorting of an oil shale formation may be accomplished while simultaneously protecting surrounding formation water from leakage of fluids from the retort-treated portion of the formation. In one embodiment, surrounding aquifers may be protected using hydrodynamic-flow barriers. Use of such containment methods are preferred in areas where the natural aquifers' potentiometric surface is at least 200 ft higher than the elevation of the aquifers in the target formation. To this end, preferred, oil shale resource area selected for in situ retorting and/or treatments comprising this invention are those containing high-permeability, natural aquifers through which thermal-energy carrier fluid (TECF) may be easily circulated, as described in this invention. Preferred oil shale and hydrocarbon resource formations for treatment using the methods of this invention further comprise such areas in which the natural potentiometric surface is at least 200 ft higher than the elevation of such high-permeability, natural aquifers. In oil shale and hydrocarbon resource areas lacking high-permeability, natural aquifers, man-made, frac-created aquifers may be installed in the formation using methods known in the art and/or otherwise described herein. Man-made fractures may be used for the hydrodynamic in situ retorting and/or petrochemical operations described in this invention. In such formations, less significance is attached to the natural, potentiometric-surface elevation due to the extremely limited leakage potential.

Based on these criteria, some of the most preferred areas for economic development of retortable oil shale are:

1) The Eureka Creek/Piceance-Basin, located primarily in Garfield and Rio Blanco Counties of Colorado;
2) The Uinta-Basin, located primarily in Uinta County, Utah; and
3) The Washakie-Basin formation, located primarily in Southwestern Wyoming. Each of these areas are well characterized in the geological records.

The methods and systems of the present invention can be illustrated by a selected focus on one of these key North American oil shale formations. Such a formation serves to illustrate the operational principles of the invention as they may be applied toward oil shale and other complex, unconventional and/or multi-strata formations. For example, a central feature of the present invention is the control of heat deposition and fluid flow within a targeted formation. Methods herein provide for the transfer of sufficient heat to mobilize target hydrocarbons within formation. In traditional methods for secondary oil recovery small amounts of heat may be injected so as to decrease viscosity of hydrocarbons. In the present invention, fluid control parameters and TECF properties provide much greater, focused heat deposition within the formation than traditional methods, resulting in multi-modal mobilization of mineralized or entrained deposits. For example, in a secondary or tertiary oil recovery application, it is often the retorting and/or thermal cracking of formation hydrocarbons—along with their consolidation into a single fluid phase that assures a dramatically enhanced recovery of hydrocarbon from the formation. So, while there may be a significant change in the viscosity of some formation materials, the direct impact of the heat deposition on the hydrocarbon structure plays a far more significant role in the increased transmissibility and recovery of hydrocarbons from such a deposit.

The following example describes the application of the present invention to a well-defined oil shale formation.

Example 2

Characterization and Development of a Carbonaceous Oil Shale Formation Exemplified in the Piceance Basin of Colorado In a specific embodiment, the methods of this invention are applied to the development and in situ retorting of the oil shale formation in the Piceance Basin. As shown in FIG. 2, a preferred portion of the basin is located substantially within Rio Blanco County Colorado, between coordinates ranging from R 99 W-to-R 95 W, and T 2 N-to-T 4 S. FIG. 1 illustrates an approximately 12 mile by 15½ mile segment of this basin representing the core unitized (e.g. target) area for application of this in situ retorting method. As shown in the FIG. 1 (inner-most dashed box), this target area comprises approximately 130 sections, or about 83,200 acres. This propped, unitized, active retort area is surrounded by a hydrodynamic barrier (shown as the outer-most dashed box) comprising about an additional 56 sections, of the resource area. Within the unitized retort area, proposed locations of Unit Wells 1-3 are also shown. FIG. 2 also illustrates the aerial extent of the preferred Piceance Basin oil shale resource (outer-most solid line, containing section boxes), which covers about 523 sections (334,720 acres).

FIGS. 3*a* and 3*b* illustrate, as an important type-example, a most preferred area of about 83,200 acres selected for unitization as the initial development part of an in-situ-retort and refining development of the Piceance Basin using the methods of this invention. In FIG. 3*a*, the letter "R" indicates a row of 16 injection/production wells spaced at roughly equal distances from one another along a 1 mile section of the selected Unitized Area. The letter "W" signifies a row of water and/or other hydrodynamic barrier wells. The thermal-energy carrier fluid (TECF) is injected so as to flow away from each of the 16 wells on each of the 1-mile-long line of wells labeled "R" (i.e. half of the injected volume is flowing to the right and half to the left) and into the corresponding wells on the 1-mile length of 16 producing wells on each side (i.e. right and left) of the "R" lines shown as dotted lines in this FIG. 3*a*. As shown in this FIG. 2*a*, there are 16 TECF injection wells in each of the 130, 1-mile lengths of injection wells, labeled "R," resulting in 2,080 injection (R) wells completed in each of the aquifers being injected with TECF for retorting in the 130 sq miles (i.e. 83,2000 acres) of this unit's retorting operations.

Only about 5% to 15% of the surface is disrupted through applications of this development sequence described herein. As such, the natural surface will remain largely undisturbed by the hydrodynamic, in situ retorting and refining operations of this invention. This low-level environmental impact represents an important feature of this invention over other proposed methods that would require a more substantial surface footprint.

Periodically, the directional flow of TECF and formation fluids between injection wells and production wells is reversed as determined by the operator. Typically, after a time interval comprising about half a complete cycle, the injection wells (R) are changed to production wells and the injection wells changed to production wells. Likewise, the production wells are changed to injection wells. The configuration of the two half cycles are illustrated in FIG. 3*a* and FIG. 3*b*. Many other configurations and alteration patterns are possible, such as alternating injection and production well along the solid (R) vertical or dashed lines in FIGS. 3*a* and 3*b*.

At each of the 16 drill sites on each mile of wells, in this example, two or more well bores are drilled with each such well completed into a separate zone of the oil shale formation. Consequently, at each such drill site, one well completed in a lower zone is used as an injection well, while another well at the same drill site, completed in a higher zone, is used as a production well during the same half cycle. On the second half of the time-cycle, the well completed in the lower zone is converted to a production well, and the well completed in the higher zone is converted into an injection well. Consequently, all of the injection equipment and the production equipment, at each drill site, will be continuously used as "injection" and "production" of the 2 zones which are alternatively reversed on a half-cycle-timing basis.

In this site development example, each drill site is equipped with TECF heaters and pressure-injection equipment for injecting about 4 billion Btu's/d (i.e. about 167 million Btu's/hr) of TECF through one or more injection wells completed into one or more high-permeability, natural aquifer (or frac-created aquifer) for flow through the aquifer to a producing well.

FIG. 4 shows a typical, average plot of the thermal energy required for retorting each pound of 25 gal/ton oil shale rock, at increasing temperatures. At an average temperature of 1,000° F., for example, about 330 Btu's of thermal energy is required to retort each pound of average, 25 gal/ton, oil-shale rock.

The tools described in this invention provide for energy-productivity ratios (i.e. the ratio of heat of combustion of produced hydrocarbons to thermal energy content injected) example provide for energy-productivity ratios of well over 1, and typically about 2-6. In the present example, the retorted products of oil, gas, and petrochemicals, mobilized in each such injection well site injecting about 4 billion Btu's/d, comprise about 3,500 barrels of oil-equivalent per day (i.e. 3,500 boe/d). The energy content of produced, retorted products associated with each injection well is about 20 billion Btu's/d/4 billion Btu's of energy delivered into the oil-shale formation by TECF. This provides an energy-productivity ratio in the range of about 5 Btu's of energy and petrochemical products per each Btu of TECF absorbed by the oil-shale rock. When ratios fall below 2, the in situ retorting and refining methods described herein may become uneconomical.

In the present oil shale example, about 2,080 wells are completed in a lower zone at the 2,080 drill sites labeled "R" in FIG. 3*a*. Each such well injects TECF into an oil-shale aquifer with the oil-shale rock absorbing about 4 billion Btu's/d. Also, another 2,080 wells are completed in a higher zone at the 2,080 drill site labeled "R" in FIG. 3*b*, with the same TECF injection rate and the consequent absorption of about 4 billion Btu's/d per well site.

Operationally, as the oil-shale rocks within or adjacent to the aquifers being injected with high-temperature TECF are gradually depleted of their retortable organic (kerogen) content, the rate of thermal energy absorbable by these aquifers and their adjacent rocks will gradually decline. The methods of this invention provide for a controlled shifting of heat flux and fluid flow through various lithologic layers within the formation so as to provide for sustained hydrocarbon production as one layer or heating zone begins to deplete. In this example, when the TECF flowing from each such TECF injection well to its corresponding production well transfers less than the designed about 4 billion Btu's/d of thermal energy to the formation, then the rate of TECF injection into that well is decreased or shifted in flow pattern until retorting efficiency, energy-productivity or heat deposition rate is restored. Typically, when production rate begins to fall irrecoverably, the surplus, available heated TECF recovered from one heating zone is injected into another TECF injection well at a different well site, or at the same drill site but into a different permeable zone.

As the initial, retortable injection zones are gradually depleted of nearby, retortable, organic (kerogen) content, resulting in a decreased rate of thermal-energy absorption, new wells are drilled and completed in new zones for injection of the surplus TECF, thereby maintaining the full utilization of the 4 billion Btu's/d, TECF capacity installed at each drill site. This production can be maintained until most of the retortable oil shale, in most lithologic layers below this initial 83,200-acre unit area, has been depleted.

As observed in FIG. 2, this most preferred 83,200-acre, initial, hydrodynamic-retortable, unit area in the Piceance Basin area of N.W. Colorado can be incrementally expanded, as needed, up to about 334,720 acres of preferred retortable area. This optional expansion of the initial unitized area may be used (a) to expand the oil, gas, and petrochemical net production rate, (b) to extend the production life based on the initial, designed, net-production rate, or (c) to increase both the net-production rate and extend the production life of the unit. Oil-shale resources present in the Uintah Basin of N.E. Utah and the Washakie Basin of S.W. Wyoming may be similarly unitized and developed for hydrodynamic retorting using approaches substantially similar to those described here for the Piceance Basin. The methods, flow rates, heating rates, developmental footprints and other parameters illustrated in the development of the Piceance Basin resource may be varied substantially without impacting the overall success of the retorting and production processes.

Example 3

Mobilization of Hydrocarbon and Other Materials from Various Lithologic Layers FIG. 5 illustrates the approximate stratigraphic column of the oil-shale zone as typically occurring at locations near the center and deeper portion of the Piceance Basin (i.e., Sect. 36, T2 S, R98W). A cross-section of the formation showing depths and thicknesses of various deposits is shown on the left of FIG. 5. An expanded view of the portion of the formation (e.g. depths of about 590 ft to about 840 ft) containing the A-Groove, B-Groove and R-7 stratigraphic zone is shown on the right. The zones labeled R-8, R-7, R-6, R-5, R-4, R-3, etc. are relatively rich zones containing relatively large quantities of kerogen and relatively small amounts of porous zones or "voids" (open holes) left in the rock after the soluble minerals have been dissolved by hydrodynamically flowing formation water. Consequently, these "R"-designated (i.e., "R-rated"), oil-shale zones have relatively few aquifers, and any existing aquifers are generally very thin and/or of relatively low permeability.

The zones labeled A-Groove, B-Groove, L-5, L-4, L-3, L-2, etc. are relatively lean zones containing somewhat smaller quantities of kerogen and very large percentage amounts of precipitated minerals, both marlstone and/or soluble sodium salts (i.e. nahcolite, trona, halite, and others). Some of these "L-rated" zones contain significant natural aquifers, and are therefor useful for the injection and flow of large volume rates of thermal energy carrier fluids (TECF) as used in this invention.

In these L-zone aquifers, the thermal-energy carrier fluids, injected at pressures exceeding the normal, aquifer-formation-water pressure, will flow outward from the injection well bore by displacing the formation water from that portion of the aquifer. Since these permeable aquifers contain very large volumes of water extending over long distances, very large volume rates of thermal-energy carrier fluid can be injected, thereby displacing this formation water outwardly at substantially the normal, formation-water pressure. In this example, these natural aquifer zones are effectively dewatered by displacement with the injected TECF. In using this invention, the operator evaluates each aquifer encountered, usually in the "L-rated" zones, to determine the fluid-flow characteristics of each such aquifer. From this aquifer, fluid-flow data, the TECF injection program for each aquifer can be optimally designed to allow for: a) initial displacement of formation fluids and b) sustained, progressive heat deposition from flowing TECF to the formation materials.

In the thick "R-rated" zones, thin man-made aquifers of high to very high permeability may be created by hydraulic fracturing of the rock at locations such as indicated by the "A-Frac" and "B-Frac" labels in the R-7 zone as shown along the right edge of FIG. 4, and represented by the dot-dash lines extending. These propped, horizontal, hydraulic fractures will create thin aquifers (i.e. 0.5" to several inches) of high to very high permeability (e.g. over 1000 Darcys), extending outward over very large areas from each, frac-injection well bore. The injection-program design for injecting this invention's thermal-energy carrier fluid into these thin, high-permeability hydraulic fractures, extending over large horizontal areas, can provide very effective means of heating large volumes of this oil-shale rock to retorting temperatures for economic production of oil, gas and petrochemical products. These very thin, highly contained frac-mediated heating zones provide a highly effective means of enhancing the rate of hydrocarbon mobilization from low permeability lithologic layers. Preferably, thin fractures of this type are used where the thickness or permeability of the depositional layers limits hydrocarbon recovery through other means described herein.

In the Piceance Basin example, the natural, hydrodynamic fluid flow of formation water is predominantly along the bedding plane of depositional/leaching porosity within the major aquifer zones. Even so, sufficient cross-formational leakage along the relaxed, open, narrow (i.e., generally under 0.1" wide) fractures occurs so as to minimize differences in the potentiometric surface elevations between neighboring aquifer beds, and between aquifer beds separated by substantial depths (distances) but in fluid communication with one another. When retorting using this example, TECF is injected at an elevated potentiometric surface elevation (i.e. increased pressure) into one aquifer, and the formation fluid is produced at a decreased potentiometric surface elevation (i.e. reduced pressure) from either the same or another aquifer in the formation. Optionally, the formation fluids may be produced from another layer accessed from the same drill-site location.

The methods of the present example provide for significant, hydrodynamic, cross-formational flow via open fractures from aquifers having high potentiometric surface elevations to those having low potentiometric surfaces. The significance of this cross-formational fracture flow of formation fluid in the oil shale retort example is illustrated in FIGS. 6-8. Prior to any fluid injection or production, the pre-existing, natural-state, potentiometric-surface elevation is approximately 6,400 ft in all of these aquifers, as shown in FIG. 6. With no potentiometric-surface elevation difference between these aquifers, there will be little to no significant cross-formational fluid flow along the thin, open fractures present in the formation. This provides the operator with significant flexibility in controlling heat deposition in the formation by means of controlling TECF flow. In the first stage of heating under this example, heated TECF is injected into the "B-Groove" and "B-Frac" aquifers at a potentiometric-surface elevation of 6,600 ft, as illustrated in FIG. 8*a*. Simultaneously, fluid is produced from corresponding wells at the same drill site out of the "A-Groove" and "A-Frac," at a potentiometric-surface elevation of 6,000 ft. As illustrated in FIG. 8*c*, is a 600-ft difference in potentiometric-surface elevation (i.e. hydraulic head) over the vertical distance of 55 ft between the "A-Frac" and "B-Frac" aquifers. Typically, this strong, hydrodynamic gradient of 600-ft head difference over 55 ft (i.e. 10.9-ft head/ft distance) will cause fluid flow from the "B-Frac" to the "A-Frac" through any preexisting, tectonically relaxed, open fracture which may exist in this area. However, if this cross-formational fluid flow through the open (i.e., under $1/10^{th}$" width) natural fracture is a high-temperature (i.e. 700° to 1,000° F.), TECF, or even steam at about 500° F., then this cross-formational fluid flow will create a thermal expansion of the adjacent rock. This expansion will close some or all of the fracture openings. Also, it will facilitate retorting of the rock walls to create some new porosity and a low-permeability path of about 1 to 10 md for a very shallow depth from the frac wall. This closure of the natural fracture opening and the partial retorting the rock walls reduces the high-velocity fluid flow through the prior open fracture and provides only a low-volume-rate flow path through the narrow, low permeability (1 md to 10 md), retorted matrix in the walls of the closed fracture.

In the second stage of the TECF injection cycle for this example, the wells completed in the "B-Groove" and "B-Frac" aquifers, are placed on production by reducing their potentiometric-surface elevation to 6,000 ft. Simultaneously, the corresponding wells at this location that are completed in the "A-Groove" and "A-Frac" aquifers become TECF injection wells with a potentiometric surface of 6,600 ft. In this stage, the cross-formational flow through natural fractures will be from the "A-Groove" and "A-Frac" toward the "B-Groove" and "B-Frac." Again, the high-temperature, TECF injection causes closure of some or all of the natural fracture openings and replaces them with a narrow, porous, low-permeability (i.e., 1 to 10 md) path along the path of the prior fracture opening.

Closure of the prior open fractures by hot TECF injection serves to minimize the cross-formational, TECF flow and consequently cause most of the TECF flow to be through the high-permeability, depositional/leaching, bedding-plane aquifers or the propped frac aquifers. The hydrodynamic gradient is defined by the slope of the potentiometric-surface elevation along the bedding-plane, aquifer flow path. FIG. 6*a* illustrates the linear flow path from one of the injection wells in the long line of injection wells in line "X" to the corresponding production well in the long line of production wells in line "W" and line "Y," respectively. This geometry of injection and production wells creates a dominantly linear flow far the TECF from the line of injection wells (X) to the lines of production wells (W and Y). In this example, the linear-flow, hydrodynamic gradient is a 600-ft head loss over 2,640 ft, or 0.227 ft/ft, which would be equivalent to 0.098 psi/ft in a horizontal aquifer. In Stage 1, the hydrodynamic flow in aquifers "B-Groove" and "B-Frac" is linearly away from the injection wells in line "X" and toward the producing wells in lines "W" and "Y." In Stage 2, illustrated in FIG. 6*b*, the hydrodynamic flow is in the opposite direction from the injection wells in lines "W" and "Y" and toward the production wells in line "X." When averaged over the full cycle, or over several cycles, the average potentiometric-surface elevation would be 6,300 ft. The hydrodynamic flow in the "A-Groove" and "A-Frac" aquifers is in the opposite direction of the flow in the "B-Groove" and "B-Frac" aquifers in each stage.

In this example, the injection head of 6,600 ft is 200 ft above the pre-retorting, normal hydrostatic head of 6,400 ft. However, the hydrodynamic head of 6,300 ft, averaged over the retorting area and averaged over multiple cycles of time, is 100 ft below the normal 6,400-ft hydrostatic head existing over the non-retorted area and in the non-retorted zones. Consequently, averaged over time and area, the direction of hydrodynamic flow along the hydrodynamic-head gradient will be from the perimeter of non-retorted areas and the non-retorted zones inward toward the retorting zones. Thus, the products of this retorting operation will not escape by flowing outward from the retorting zone but will always be flowing inward for production from the retorting zones.

In this example, the hydrodynamic flaw direction and the potentiometric-surface-elevation gradient when the TECF injection head is 6,300 ft and the production well head is 6,000 ft. This lower injection pressure, lower hydrodynamic-head gradient, and the lower volume rate of TECF flow are the consequence of the diminished rate of absorption of thermal energy (heat) during the time of flow from the injection well to the production well, which, thereby, decreases the retorting rate. The injection head of 6,300 ft is 100 ft below the pre-retorting, normal, hydrostatic head of 6,400 ft, and the hydrodynamic head of 6,150 ft, averaged over the retorting area, is 250 ft below the normal, hydrostatic head of 6,400 ft existing over the non-retorted area and in the non-retorted zones. Consequently, the products of this retorting operation cannot escape by flowing outward from the retorting zone but will always be flowing inward for production through the producing wells in the retorting zone.

To prevent any of the products of this retorting operation from escaping upward into the groundwater in any of the aquifers above the retorted zones, a hydrodynamic-controlled, leak-proof caprock can be established. This hydrodynamic-controlled, leak-proof caprock can be established by injecting fluids with a higher potentiometric-surface elevation into a natural, permeable aquifer, or into a bedding-plane, propped, hydraulic-frac-created aquifer at a shallower depth above the highest zone being in-situ retorted. In this example, the retorting operations in the R-7 zone (i.e., "A-Groove," "A-Frac," "B-Groove," and "B-Frac") are protected by hydrodynamic, caprock aquifers (i.e. either or both natural aquifers or propped, bedding-plane, hydraulic-frac aquifers) in the R-8 zone. These R-8, caprock aquifers are injected with a hydrodynamic control fluid whose potentiometric head elevation is significantly higher than the potentiometric head elevation of any retorting fluids in the aquifers of the R-7 retorting zone.

By way of illustration, if the caprock, hydrodynamic control fluid injected into the R-8, caprock aquifers has a potentiometric-surface elevation of about 7,000 ft, then there will be a strong hydrodynamic gradient and fluid flow from the R-8, caprock aquifers downward through any open, natural fractures and into the R-7 retorting zone. This downward hydrodynamic gradient and fluid flow from the R-8 caprock aquifers, downward through rock fractures and into the R-7 retorting aquifers will prevent escape of any retorted products from the R-7 zone upward into the R-8, hydrodynamic-controlled caprock aquifers.

If the hydrodynamic control fluid injected into the R-8 caprock aquifers is steam at about 450° F. to 550° F., then the heat from this steam will create a thermal expansion of the rocks adjacent to any natural fractures which had provided fluid leakage paths away from the R-8 caprock aquifers. This thermal expansion of adjacent rocks will reduce or close the fracture width, thereby reducing, or nearly preventing, any fluid leakage out of these R-8 aquifers through such preexisting fractures. Also, this 450° F. to 550° F. heating of the rock, along the prior, open-fracture path, will create a weakness of the rock's strength, a reduction of the rock's brittleness, and an increase of the rock's plastic deformation (or rock flowage) so as to close the opening of such preexisting rock fractures. Furthermore, if any bedding-plane zone has a very high kerogen content (i.e. possibly about 40 to 60 gal/ton), then at these elevated temperatures of 450° F. to 550° F., this kerogen is softened and may flow by plastic deformation into these fractures, and thereby plug the fractures which would prevent any further leakage. Any remaining, minor, fluid leakage along such natural fracture planes would have a high-hydrodynamic head gradient from the R-8 caprock aquifers toward the R-7 retorting aquifers which would thereby prevent any loss of retorted products out of the retorting R-7 zone and into the R-8 caprock.

Note that this 450° F. to 550° F. steam, or the hot water condensed therefrom, will not cause substantial retorting of any oil-shale kerogen and, therefore, will not introduce any new porosity from retorting along this preexisting-fracture leakage path. The injected steam and the hot water condensed will flow outward from the injection wells to displace the preexisting formation water within these R-8 caprock aquifers. This condensed hot water may be produced from these R-8 caprock aquifers just beyond the outer perimeter of the retorting R-7 (or deeper) zones. This produced water may be reheated and reinjected into the R-8 caprock aquifers inside the perimeter of the R-7 (or deeper) retorting zones.

Whereas the operations discussed in this example focus on developing an oil shale fixed bed formation, the principles of heating and producing hydrocarbons from other hydrocarbon and recalcitrant hydrocarbons formations will be apparent to one of skill in the art.

Example 4

Heat Injection and Pressure Control Using Downhole Combustion and Other Methods The application of the down hole combustion chamber, as described in U.S. Pat. No. 7,784,533, to the present invention is best seen in reference to a specific set of retorting conditions, such as those seen in the Eureka Creek area of the Piceance Basin. As discussed elsewhere in this disclosure, an approximately 14-ft-thick, "B-groove," permeable zone in the formation is located between 796-ft and 810-ft depths at this location. In this example, a 12¼"-diameter hole is drilled to a depth of about 825 ft, or about 15-ft below the bottom of the "B-groove," Then, a 10.75"-OD×9.85"-ID casing is set to a depth of about 780-ft (i.e., about 16 ft above top of "B-groove") and cemented from there to the surface. The inner casing (i.e. 7"-OD), with the downhole combustion chamber, is run in the hole and hung with the bottom of the combustion chamber about 5 to 15 ft above the bottom of the cemented, 10.75"-OD casing.

With one or more B-groove wells in place, the zone is prepared for initial heating and retorting. Other fixed-bed hydrocarbon zones (e.g. "A-groove", etc) are also present in the Eureka area, and can be developed subsequently or in conjunction with B-groove development. In this example, the downhole combustion chamber of this combustion-injection well is flooded with steam, combustion-gas, and air. Compressed air and water are injected so as to establish a combustion-chamber, exit temperature of about 1,000° F. (±200° F.), and a pressure of about 600 psi (±100 psi). This provides a pressure differential of about 250-psi to drive the TECF containing steam plus combustion products into the "B-groove," permeable, porosity zone. After a steady-state injection rate is established by operations, either injection rate, injection pressure or both, may be adjusted to match the hydrodynamic-performance capability of this "B-groove," injection-well permeability. Under conditions such as those in the B-groove, material flow depends primarily on naturally-occurring matrix-porosity, permeability and thickness.

Under conditions in which the maximum, matrix-porosity injection rate established for a given well is substantially less than the designed, air-compressor rate, the operator may elect either to establish a sand-propped, hydraulic fracture in this porosity zone, increase the formation injection pressure, or drill an adjacent second injection well to split the injection rates between two wells.

Once satisfactory injection rates, temperatures, pressures and other production parameters have been defined for one segment of the "B-groove", permeable reservoir, a larger field-development, well-drilling/operating pattern may be established for the much larger area in which B-groove production parameters apply. Similarly, production parameters established for a small segment of any other permeable zones, may be extended to a much larger production area and used to developed an integrated site development plan. The well spacing, pattern and locations illustrated in FIGS. 3*a* and 3*b* are but one of many configurations possible for the Piceance Basin formation. However, the illustration serves as one example of how a large treatment area, oil shale or other carbonaceous deposits may be developed over time.

While this present example uses a down hole combustion unit to integrate temperature, pressure and flow rates, the regulation of injection need not occur through down hole means; nor are combustion-based methods of TECF required hereunder. Rather, pressure, temperature and injection rates may be established by any means or equipment suitable to the task. For example, surface equipment such as compressors, regulators, electrical heaters, heat exchangers, boilers, pumps and many other tools are available to assist in such tasks. As such, many other methods and variations of the methods will be evident to one of skill in the art.

In further considering the specific and general embodiments of the present invention, a variety of important features can be illustrated and evaluated using diagrams and figures. The following figures draw out additional important and often general features of the present invention as applied to a variety of formations and fixed-bed carbonaceous resources.

Example 5

An Application of the Method to Secondary and Tertiary Oil and Gas, Heavy Oil and Tar Sands In the preceding example, the directional flow between sell series W, X and Y (illustrated in FIGS. 6*a*-6*b*) is substantially horizontal, the cross-formational flow between two or more permeable zones (i.e. B Groove, B-Frac, A Groove and A-Frac) provides an important vertical component to the heat flux and flow pattern. The impact of this cross-formational flow, especially in the early stages of the process, is to improve the extent of hydrocarbon recovery within the formation. In many multi-strata oil shale applications the cross-formational flow will decrease substantially as the low permeability rock heats and closes most of the naturally occurring vertical fractures. At such a point, the flow within a given permeable layer becomes almost completely horizontal. So, over the course of an oil shale retorting and refining operation, horizontal flow within the formation plays a dominant role in the production process.

In this example, a permeable formation having substantial quantities of heavy, entrained or otherwise unrecoverable hydrocarbon is identified through production analysis and/or other reservoir characterization records. At least one well is installed and completed in a permeable hydrocarbon formation so as to provide an opening into the formation at or below a depth near the bottom of the targeted deposit. In a typical example, the permeable deposit is at least about 100 ft in vertical thickness. A second well (or, optionally, set of wells) is installed at a substantial lateral distance from the first and completed so as to provide at least one opening above or near the top the targeted deposit in the substantially permeable zone. Preferably, lateral separation between the wells is at least about 300 ft, or more preferably, at least about 600 ft, or at least about 900 ft or at least about a quarter mile (1320 ft). Heated TECF is injected into one of the wells (or sets of wells) and conducted by the hydrodynamic control methods of this invention to the other well (or set of wells). Vertical separation is typically at least 30 ft, and preferably over 50 ft. In the example illustrated in FIG. 12, the lateral separation is 2640 ft and vertical separation is 100 ft. The initial heat flow is from the lower well to the upper. Such flow ca be reversed at a future time. In this example, hydrocarbons along the TECF flow path are mobilized by a plurality of physical and chemical transformations which may include emulsification, pyrolysis, extraction, bulk-flow "sweeping" effect, phase changes or solubility enhancement. The mobilized, in situ processed hydrocarbons are conducted toward the production well and produced from the formation. At least a portion of the produced hydrocarbons are selectively removed from the produced fluids. In most embodiments, at least a portion of the TECF is also recovered. Recovered TECF is typically reheated and reinjected in the formation for the purpose of mobilizing yet more of the formation hydrocarbon.

In a modification of the example of the previous paragraph, shown in Figure xx, two wells are located at the drill site B, completed into the upper and lower portions of the permeable zone. Principal circulation of TECF is between the lower well openings. Principal flow of mobilized hydrocarbons is toward the upper well in the hydrocarbon-rich permeable zone.

In the forgoing examples, TECF is heated to temperatures above about 500° F. prior to injection into the formation; and may be heated to temperature well above 700° F., or in excess of 1000° F. When injected into the formation, the hot TECF circulates within the proximity of the substantially immobile hydrocarbons, transferring substantial heat—directly, indirectly, or both—to the entrained hydrocarbons, resulting in mobilization of a substantial portion of the hydrocarbons. The mobilized hydrocarbon is produced through a production opening. In this example, at least a portion of the substantially immobile hydrocarbons undergo pyrolytic transformation, vaporization, emulsification or solubilization. Pyrolytic mobilization results in a reduction in the average molecular weight of the product hydrocarbons, resulting in increases in vapor pressure and mobility of the product hydrocarbons over the source deposit. Fluids produced from the formation comprise hydrocarbon products, which may include pyrolysis products, vaporized, emulsified or solubilized products.

In the methods of the present invention, pyrolysis generally acts to increase the average mobility of formation hydrocarbons. This is due, in part, to the fact that pyrolysis reduces the average molecular weight of hydrocarbons undergoing chain scission, increasing the abundance of low molecular weight species. Lower molecular weight species, on average, exhibit higher mobility and vapor pressure under formation conditions.

Increased mobility may also occur by any number of other mechanisms. These include, among others: increasing solubility, increasing local pressure or partial pressure, bulk flaw effects, reducing surface or interfacial tension, extraction, displacement, and other alterations in the physical or chemical properties of the hydrocarbons, formation fluid(s) or rock matrix. For example, the sudden appearance of substantial concentrations of low molecular weight hydrocarbons in a local micro environment may serve to solubilize, emulsify or extract higher molecular weight species present in the same vicinity. Likewise, a sudden, dramatic increase in the mobility or partial pressure of certain lower molecular weight components of an oil droplet or globule may serve to destabilize the droplet structure and increase the transmissibility of many of the molecular constituents of the droplet.

Hydrocarbon chain scission will result in a local increase in the hydrocarbon vapor pressure within the formation. This pressure may provide a transient or sustained pressure difference between the site of mobilization (e.g. in the hydrocarbon deposit) and the production opening. This pressure differential may provide a means for fluid displacement and production within the formation, and may be applied to advantage for production or circulation of hydrocarbons and other fluids in the formation. A pressure differential between the hydrocarbon mobilization site and the production opening may also be established by under-pressuring the production opening using techniques and equipment well known in the art. Using such methods, a skilled operator may conduct heat from an in situ heating element, through an intervening rock layer, to a substantially immobile carbonaceous material within a formation. The heated material may release mobile hydrocarbons that may be produced at a site that is not in fluid communication with the injection or production openings associated with the in situ heating element. In one example, the intervening rock has low permeability orno permeability to hot TECF but exhibits higher permeability to the mobilized hydrocarbons.

As described in this example, the application of the methods of this invention to heavy oil, tar sand or partially depleted hydrocarbon formations differs slightly from the oil shale application. One important difference is in the directional flow and permeability aspects. In the present (heavy oil, tar sands and partially depleted hydrocarbon) example, the selected deposit exhibits considerable permeability above, below and within the targeted depositional hydrocarbon layer. In the present example, TECF flow across, beneath, above or adjacent to the targeted, entrained deposit is used to advantage to mobilize a substantial portion of the previously immobile hydrocarbons.

Even when considerable permeability is present, as much as 70% of hydrocarbon present in a conventional hydrocarbon formation present is unproducible using conventional methods. For unconventional formations (i.e. heavy oil, tight shale gas and tar sands), the percentage is even higher. Moreover, the vast majority of this recalcitrant hydrocarbon remains non-producible even with the most effective secondary recovery technologies, such as hydraulic fracturing, steam flooding and other viscosity-lowering strategies. The present invention provides the means to restore productivity to a large percentage of spent hydrocarbon deposits and to achieve efficient in situ production from a variety of unconventional hydrocarbon formations.

In this example, permeability surrounding a heavy oil deposit is used to advantage to deliver mobilizing heat to substantially immobile materials comprising such deposits.

If the hydrocarbon production process results in lowering the temperature in the FBHF aquifer enough so that some of the hydrocarbon products condense from a vapor to a liquid phase in the porous rock, then the less efficient two-phase (i.e. gas/vapor and liquid oil) flow results. Furthermore, if some of the water vapor condenses to create liquid water, in addition to the hydrocarbon liquids, then three-phase (i.e., gas, oil, and water) flow of low efficiency results with consequent large, non-producible, by-passed, residual oil left in the porous aquifer/reservoir rocks. The means of changing from three-phase or two-phase production flow to a single-phase flow is one of the most important components of this invention.

The use of water vapor as a constituent in the thermal energy carrier fluid (TECF) provides water molecules for hydrocracking reactions to increase the more desirable and valuable hydrocarbon product yields. Furthermore, product control granular catalysts may be used in the frac proppant around either or both the injection wells and the production wells to optimize the value of product produced from this in-situ retorting/cracking/refining operation. Also, liquid or vapor catalysts or reactants (such as molecular hydrogen, oxidizing or reducing agents) may be added for these purposes. By controlling the pressure, temperature, and residence time, while using selected catalysts or additives, the produced products can be optimized for highest value and special needs.

In certain examples, a cooling gradient exists along the hydrodynamic flow path in a permeable zone of a fixed bed hydrocarbon deposit. The high temperature end of the gradient is located at or near at least one injection well, or former injection well, and exhibits a temperature of about 1,200° F. (+/−200° F.). The lower temperature end of the gradient is located at or near one at least one production well, and exhibits a temperature of about 6600° F. to 800° F., or 400° F. (+/−200° F.). In the high temperature areas, near the injection wells, the mobilized hydrocarbons will undergo substantial thermal cracking or hydrocracking to produce an increase in the abundance of producible short-chain hydrocarbons having one to three carbon atoms. Cracking reactions may also increase the abundance of producible $C_3$ to $C_6$ hydrocarbons. Cracking may further increase the abundance of moderate length, $C_6$ to $C_{12}$ hydrocarbon chain products. Further downstream, along this cooling temperature gradient in the hydrodynamic flow path, near the production wells, much less thermal cracking and hydrocracking occurs. In the absence of added reactants or catalysts, average molecular weight of formation hydrocarbons derived from these areas will be higher, due to the limited level of thermal cracking.

Along the TECF and product flow path, an effective miscible flood production process is established by the lower molecular weight $C_1$ to $C_{12}$ fractions diluting and dissolving, the heavy oil products (i.e. $C_{14}$ and heavier), forming a miscible front pushing the heavier fractions toward the production wells and the abundant upstream high temperature cracked $C_3$ to $C_6$ very volatile light ends completing the miscible flood displacement process. The non-condensable gases of methane, ethane, and some of the TECF products energize this miscible flood production process.

In many formations, the early stages of hot TECF injection into the cold water saturated natural aquifers, results in complex multi-phase flow with substantial interfingering of flow paths due to a number of fluid effects. First, the initial flow simply by-passes significant sections of the aquifer due to porosity variation, as well as interfacial and surface tension effects. Moreover, the stratigraphic layering of 1 to 5 darcy high permeability salt leached zones separated by some 50 to 100 md moderate permeability zones and some $1/10^{th}$ md to 10 and low permeability zones, each ranging in thickness from a fraction of an inch to a few inches to a few feet, will create substantial TECF injection by-passed zones. Together with the difference in viscosity between the TECF, deposited hydrocarbon and the formation water, these complexities can combine to produce an unstable displacement flood within each permeability zone.

However, the thermal conductivity heat flow out from each displacement finger in each TECF invaded zone creates a much more uniform thermal front than the TECF multi-phase fluid flow displacement front. Over these short distances the steep temperature gradient may cause the thermal conductivity heat flow front to advance cross-formationally at rates ranging from several inches per day to a fraction of an inch per day. Within days, weeks or months, the thermal conductivity heat flow increases the temperature of the fluid-flow, by-passed areas and zones to nearly the same temperature as the TECF invaded areas and zones. Consequently, a short distance behind the TECF interfingering fluid displacement front all of the natural aquifer areas and zones will have very little temperature difference between the TECF fluid flow invaded areas and the fluid flow by-passed areas. The advancing thermal front will be far more uniform than the TECF displacement front, at least in the initial stages of heating.

After the thermal front arrives at the production wells, the TECF injection rate is adjusted until the temperature of the produced TECF, plus mobilized hydrocarbon and/or other products, is stabilized at a desired level. Depending upon the operator's objectives for product value, this production well temperature may be about 300° F. to 600° F., or at least 300° F. to 800° F. below the injection well TECF temperature (often about 1,200° F.). After this temperature gradient along the TECF flow path has been stabilized for a period of time, the operator may choose to reverse the flow direction by injecting the TECF into the prior production wells and producing the TECF, plus mobilized or retorted products, out of the prior injection wells. This reverse flow can continue until the reverse flow temperature gradient along the aquifer flow path has been stabilized at its desired value. Then the flow direction can be reversed back to its original direction. This reversal of flow direction can be repeated as desired by the operator to manage the rate and quality of retorted product produced or until the zone between adjacent aquifer injection zones has been retorted and the production of this resource zone is depleted.

Typically, the vertical space between all such TECF horizontal flow paths (i.e., the combination of naturally occurring permeable aquifers and the propped-frac-created permeable zones) may range from about 30 ft to 100 ft. This 30 ft to 100 ft vertical space between such TECF horizontal flow paths will then be retorted or otherwise produced by thermal conductivity heat flow conducted from one or more adjacent TECF-based in situ heating element. This cross-formational heat flow out of the TECF flow paths results in the gradual decrease of temperature along the flow path of the TECF. Whereas the temperature of the TECF flowing from the injection wells may be about 1,100° F. or 1,200° F., the TECF heat loss along the flow path may result in cooling the TECF to about 600° F. or 800° F., or 400° F.+/−200° F., at the production wells. In some hydrocarbon mobilization embodiments, the temperature differential between the injection wells and production wells is, on average, about 300° F. to 600° F. In an embodiment, the TECF temperature at or near the injection well is about 900° F.+/−200° F. and the temperature of TECF-containing formation fluids at/or near the production well is 300° F.+/−100° F. In yet another embodiment, the TECF temperature at or near the injection well is about 600° F.+/−2.00° F. and the temperature of TECF-containing formation fluids at the production well is 200° F.+/−100° F.

The dimensions and well separations described provide a considerable formation treatment area By way of illustration, if the space between adjacent wells in an oil shale treatment area in both the injection well line and the production well line is about 330 ft and the space between the injection well line and production well line is about ½ mile (i.e. 2,640 ft), then the TECF flow aquifer surface area for outward heat flow will be about 2,640 ft×330 ft×2 wings×2 surfaces or about 3,500,000 square ft per each injection well. It is this large 3,500,000 square foot surface area of TECF flow path per injection well available for heat flow by thermal conductivity into the adjacent retortable oil shale or hydrocarbon-containing rocks that provides for large enough production rates needed for commercial production operations. In other typical examples, the space between wells in each line and also the distance between injection well lines and production well lines are increased, resulting in even larger square feet of TECF surface area per each injection well and consequent larger production rates and larger TECF injection rates per each well. In other examples, the well separation distances are decreased.

By using long horizontal well bores for both injection and production wells instead of the previously described vertical well bores, the spacing between the well-bore lines on authorized road/pipeline rights-of-way may be increased from about ½ mile up to 1 mile or possibly up to 2 miles. For example, these well bores may be drilled from drill sites spaced about 660 ft (i.e. $1/8^{th}$ mile) apart along a road/pipeline right-of-way. Alternatingly, every second drill site in the line is an injection well and each in-between drill site is a production well. At each drill site location, a 16" diameter vertical well bore is drilled to a depth of about 300 ft above the zone targeted for in-situ retorting development. Then a 13⅜" O.D. surface casing is set to this depth and cemented back to the surface. Subsequently, a 12¼"-diameter hole is drilled out from under this 13⅜" O.D. casing. This 12¼"-diameter hole is directionally drilled along a 300-foot turning radius until it reaches horizontal at depth of the targeted zone and then is drilled horizontally for about ½ mile to 1 mile within this retortable targeted zone. This horizontal well bore may be operated as an open-hole completion, if the well-bore walls are mechanically stable. If the formation is mechanically unstable, then a perforated or slotted liner may be inserted for protection against hole-collapse.

In the oil shale retorting operation, the TECF is injected through each horizontal injection well at a temperature of about 1,100° F. to 1,200° F. and at a pressure about equal to original virgin pressure of the formation water in the aquifer at that location. This injected TECF will then flow out from the horizontal injection well bore toward the two adjacent near parallel horizontal production well bores located about 660 ft away from and on opposite sides of the injection well bore. The hot TECF will retort, crack, and refine the shale oil retorted from the kerogen within this aquifer. Consequently, there will be a heat flow by thermal conductivity from the surface area of this heated aquifer out into the adjacent unretorted oil-shale rocks to cause their pyrolization/retorting.

By using these horizontal injection and production well bores, ranging from ½ mile to 1 mile length, the operator will be able to retort/crack/refine the shale oil from all of the oil-shale rocks between such nearly parallel road/pipeline rights-of-way spaced from 1 mile to 2 miles apart. This provides a minimum of surface environmental disturbance for this economic production of high value, in-situ, cracked/refined, shale-oil products derived from these in-situ TECF heated aquifer hydrodynamic flow paths.

Example 6

Regional Water Control Operations

To prevent in-situ retorted hydrocarbon products from detrimentally contaminating the regional ground waters and the river waters draining therefrom, the oil shale in-situ retorted and other hydrocarbon mobilization zones are controllably operated as a regional groundwater hydrodynamic sink surrounded by a protective hydrodynamic ridge and covered by a multi-layered protective hydrodynamic cap rock. The unitized in-situ oil shale retorting area of 130 square miles, illustrated in FIGS. 2 and 3 provides a working model for key aspects of water control, in which the protective hydrodynamic barrier of 35,840 acres represents about 30% of the total unit development area and the effective in-situ retorting area of 83,200 acres represents about 70% of the total unit development area.

The hydrodynamic flow of groundwater in any aquifer is controlled by the slope of the potentiometric surface from that aquifer. The potentiometric surface elevation at any location in the aquifer is the height above sea level to which water would rise in a well bore completed for production in that aquifer. A hydrodynamic sump area is an area in the aquifer wherein the potentiometric surface slopes inward from all directions toward an area where water is being removed by some mechanism, such as production of water retorted liquids and/or vapors, resulting in a depression of the potentiometric surface. In typical examples of this hydrodynamic sump created for environmental protection using this invention, the potentiometric surface depression may be about 200 ft to 500 ft below the regional potentiometric surface. For further environmental protection against hydrocarbon contamination migration in the surrounding groundwater, a hydrodynamic flow barrier, consisting of a potentiometric ridge of about 100 to 300 ft above the pre-existing regional potentiometric surface may be created by water injection all along the perimeter of the production sump. The linear velocity of water flow down the potentiometric surface slope in each aquifer zone from the hydrodynamic barrier into the sump area should be greater than the hydrocarbon contamination molecular diffusion rate in the water.

The retorting hydrodynamic sump area is covered by a multi-layered protective hydrodynamic cap rock created by water injection into both the naturally occurring aquifers and/or the propped-frac created aquifers. The fluid flow leakage along pre-existing vertical fractures through the cap rock zone are substantially reduced by the herein previously described injection of steam or other hot TECF into the fractures. This steam or hot TECF flow into the fractures results in the adjacent rock expanding by thermal expansion to narrow the fracture width. Also, the plastic flowage of the heat softened kerogen into the fractures may achieve substantial plugging of the fractures.

The retorting hydrodynamic sump zones below this hydrodynamic cap rock may have a depressed potentiometric surface about 200 ft to 500 ft below the normal pre-existing regional potentiometric surfaces in the cap-rock aquifers. For further environmental protection against possible leakage of any hydrocarbon contaminants into the groundwater of the aquifers above the cap rock, additional pressurized water can be injected into some of the cap-rock aquifers. Typically, this water injection is designed to increase the potentiometric surface elevation of these cap-rock aquifers to about 100 to 300 ft above the pre-existing normal regional potentiometric surface elevation of the water in these cap-rock aquifers. Consequently, essentially no water soluble hydrocarbon contaminants will be able to leak through this hydrodynamically controlled cap rock covering the potentiometric surface sump area of the in-situ retorting operation using this invention.

Example 7

Application of a Dual-Elevation, Horizontal Wells Matrix to the Recovery of Hydrocarbons from Oil Shale and Heavy Oil Deposits and from Depleted Oil and Gas Fields In a specific derivative of the horizontal well bore application discussed elsewhere herein, one or more horizontal wells is installed in one of the permeable layers shown in FIG. 5, such stratigraphic layers being described as A-Groove, B-Groove, A-Frace, B-Frac or L-2, L-3, L-4 and L-5. A second horizontal well(s) is installed in another permeable layer, typically the next permeable zone in the series of named strata, such as L-2 and L-3, respectively, in FIG. 5. The second horizontal well is positioned in the lateral position directly above or below the first well bore. Optionally, it may be offset by a lateral distance that is significantly less than the distance to which the horizontal well penetrates the permeable zone in the horizontal dimension. Optionally, a series of parallel or nearly parallel horizontal wells may be installed in each of the targeted permeable layers. Typically, the wells in a given lithologic layer will be at a similar depth and separated laterally by a distance of at least 300 ft, and preferably at least 600 ft. Horizontal penetration often is less than 5280 ft. In this example, the horizontal wells penetrate the permeable layer to about 2640 ft. In one example, shown in FIG. 10*b*, a series of 5 parallel horizontal wells are drilled at substantially similar depths and cased in layers L-2 and L-3, respectively. The wells are used according to the methods of this invention to mobilize hydrocarbons from low permeability, hydrocarbon-rich R-3 layer, as well as L-2 and/or L-3. In one embodiment, the horizontal wells in each layer may function initially as alternating injection and production wells. In another, fluid flow is established between the horizontal wells in L-2 and L-3 using methods known in the art.

In yet another example, TECF circulates within each permeable zone between at least one of the horizontal wells and at least one vertical well that contacts said permeable layer, and may circulate into or out of a well comprising a perforated portion of well that terminates in another zone of the formation. In other variations, the wells in a given zone are drilled in a different configuration, non-parallel pattern to achieve the mobilization objectives herein. By way of example, the illustrations in FIGS. 12*a* and 12*b* show a series of six production wells positioned in an equidistant 6-point pattern around a central injection well that supplies TECF to a series of 6 horizontal arms. Typically, the arms of the injection well are placed in a zone above or below that of the permeable zone comprising the horizontal production wells. Preferably, the role of the injection and production wells is reversible. In some examples, such patterns are used to achieve extremely high efficiency recovery of hydrocarbon with a single thick hydrocarbon deposit.

In another variation of the example, a series of wells are introduced into the permeable zone labeled L-2 (FIG. 5) along a one mile line of drill sites. Geosteerable drilling technology is used to introduce a series of eight parallel well bores at separation distances of 660 ft in the L-2 zone at a depth of approximately 1674 ft from the surface. The horizontal well bores are drilled so as to extend about 2640 ft into the L-2 zone and cased with high temperature rated steel casing. Preferably, perforated casing is installed along a substantial portion of the horizontal segment of the wells. A complementary and parallel set of 8 horizontal wells are installed in zone L-3 at a depth of approximately 1511 ft. While these wells may be introduced from the same drilling sites used for the L-2 well bores, in this example, the drilling sites for the L-3 horizontal wells are located along a one mile line opposite and parallel to those of the L-2 drilling sites. The surface well sites are separated laterally by about 660 ft and are positioned on the surface across from the mid-point of each pair of L-2 drilling sites, such that the individual well sites in the L-3 line are offset by about 330 ft from corresponding wells in the L-2 sites. The horizontal wells corresponding to each L-3 drill site also penetrate the permeable zone as parallel holes separated by about 660 ft within the permeable zone, and extending toward the L-2 line of wells in nearly perpendicular orientation. In this example, the L-3 wells are positioned so as to extend in parallel to the L-2 wells but are offset relative to the line of L-2 drill sites so as to achieve about 330 ft of lateral separation between corresponding drilling sites along the parallel L-2 and L-3 drilling sites lines. As with the L-2 wells, the L-3 well bores penetrate the L-3 zone horizontally to distances of about 2640 ft and are cased with high temperature rated steel casing and perforated along a substantial portion of the horizontal segment of the well bare. Again, perforated casing may be used along some, or all, of the horizontal portion of the well bore. Fluid (e.g. TECF) reservoirs, delivery pipes, heaters, as well as pressure, temperature and flow control equipment, monitoring devices and remotely controlled safety and control systems are installed at each of the surface drilling sites and/or in each well to allow for independent control of fluids, temperature and pressure on a well-to-well basis. This feature allows for integrated control of fluid and hydrocarbon production from the entire site. Hydrodynamic boundaries and water control wells are established around the perimeter of the formation to be treated as described elsewhere in this and affiliated disclosures.

Produced fluids are generally transported by pipe to one or more surface facilities or unit operations wherein separation of one or more commercially desired hydrocarbons from TECF occurs, and wherein TECF is prepared for recirculation into the formation. Separated (commercial) hydrocarbons may be stored in a single collection vessel, separate collection vessels or transported immediately off site by means of one or more pipelines or vehicles.

In this example, injection of heated TECF begins under conditions in which the potentiometric surface elevations in the L-3 wells are set to levels of about 200-600 ft below that of the L-2 wells. Injection of heated TECF into zone L-2 initiates the gradual heating of zones L-2, R-3 and L-3, respectively. Initial flow is cross-formational from L-2 to L-3 via naturally (or, when necessary, installed) fractures in the R-3 layer. To allow naturally occurring or non-propped fractures to remain open during the initial stages, heating occurs slowly as TECF injection temperature is ramped gradually from about 250° F. to 400-500° F. This initial heating drives producible hydrocarbons contained in the three target zones into the fluid flow path, and allows production of these hydrocarbons at the L-3 well outlets (i.e. L-3 drill sites) along with TECF. Whereas heating of the rock results in a reduction in the permeability of the R-3 mineral layer, this reduction is offset in part by the release of entrained hydrocarbons from the same zone(s) during the slow heating process. The net result is a preservation of significant permeability within the layer. As the injection temperature ramps-up (to >500° F.), and the formation temperature increases to temperatures above about 480° F. (which may take a period of months) a small degree of pyrolysis activity may begins. Pyrolysis activity continues to increase as temperatures increase, generally reaching high levels at TECF injection temperatures of 750-1100° F. Over this ramp-up period, there is a dramatic and progressive increase in pyrolysis activity in the heated area, resulting in a multi-modal increase in hydrocarbon production.

An operator may alter the chemical composition of the produced hydrocarbons and minerals by altering the rate of temperature ramp-up, the flow path of fluid within the treated area, the maximum temperature achieved within the treated area, the flow direction, the differential pressures, the TECF properties or composition, the average residence time of the TECF within the treated areas or any combination of these. A skilled operator may also elect to block or suspend injection or production from certain wells so as to alter the directional flow or time-temperature history of mobilized hydrocarbons within the formation. Such adjustments provide for an increase in hydrocarbon productivity, a beneficial change in hydrocarbon chemistry and an economically important adjustment to the system as it continues produce commercial hydrocarbons from one or more of the wells in the targeted formation. These and many other adjustments will be evident to one of skill in the arts of reservoir engineering and petrochemical processing.

In this example, the pyrolysis chemistry described above will generally account for a substantial portion of the hydrocarbon production from a treated zone, such as the L-2:R-3:L-3 illustrated in this example.

While this example describes the utility of the invention in one well characterized oil shale formation, it will be evident to one of skill in the art that the same principles and operations are applicable to producing commercial quantities of hydrocarbon from other complex formations such as heavy oil and tar sands, and even coal and lignite deposits. In one modification of the previous example, a set of vertically separated horizontal well bores (equivalent to L-2 and L-3 in the example) may be installed within, or above and below, a permeable oil and gas formation. Methods similar to those described herein for oil shale may be used to enhance recovery of hydrocarbon from such a formation. In a particularly preferred embodiment, a previously produced oil and gas formation is restored to production using the methods of this invention. The methods of this example are particularly useful in such applications. When applied to conventional, permeable formations (or permeable heavy oil formations) the maximum temperature required to achieve peak productivity is often significantly lower than that described in the oil shale example. In some cases, maximum productivity occurs between 400 and 700° F., due to the depositional and compositional differences between kerogen (i.e. oil shale hydrocarbons) and petroleum or heavier bituminous materials. In one example, over 50% residual hydrocarbon is recovered from a depleted petroleum formation at TECF injection temperatures of <500° F. In another example, over 30% of residual hydrocarbon is recovered from a depleted petroleum formation at TECF injection temperatures of >250° F.

Kerogen deposits are characterized by very high molecular weight hydrocarbons similar in chemistry to polyethers. They are insoluble in most organic solvents and extremely viscous upon melting. Moreover, they are often recoverable from rock only by pyrolytic decomposition at high temperatures. In contrast, petroleum deposits and heavier bituminous (asphaltene) materials exhibit somewhat lower molecular weight than kerogen. They tend to be deposited as gel-phase or sand-bound droplets, and are soluble in most organic solvents. For these reasons, a lower degree of pyrolysis is required to achieve the desired enhancement in transmissibility for petroleum- and bitumen-related materials. The release of low molecular weight hydrocarbons from, or in close proximity to such droplets, result in a variety of physical changes that serve to increase mobility. These include a significant local increase in hydrocarbon pressure, an increase of solvating activity (e.g. mediated by lower molecular weight hydrocarbons) and a reduction in average molecular weight. These all work to increase the production of formation hydrocarbons under milder heating conditions than is required for oil shale.

When simultaneously retorting both a carbonaceous deposit and the Nahcolite-salt crystals, the Nahcolite ($NaHCO_3$) contained in it, the Nahcolite decomposes into sodium hydroxide (NaOH), plus $CO_2$, at relatively low temperatures. Then, at moderate temperature, the sodium hydroxide (NaOH) melts into a liquid, and at higher temperature, it may vaporize. The NaOH liquid and/or vapors can then be produced along with the oil-shale, retorted, hydrocarbon liquids, vapors, and gases through the hydraulic fractures and up to the surface through the producing wells. Upon cooling in the distillation column, the NaOH liquids and crystallized solids can separate from the hydrocarbon products to be marketed as a separate by-product of value.

In a similar manner, a mineral in the oil shale called Dawsonite ($NaAl(OH)_2CO_3$) (or $Na_3Al(CO_3)_3.2Al(OH)_3$) may undergo partial decomposition into liquid and/or vapor fractions in the 1,000° F. to 1,400° F.-temperature, cross-formational heat flow. These Dawsonite, thermal-decomposition products may be recovered through the hydraulic fractures along with the oil-shale-retorted, hydrocarbon liquids, vapors, and gases. This recovery of Dawsonite decomposition products, containing aluminum, may provide additional by-products of value.

Example 8

Formation Regulation and Other Further Embodiments

Certain embodiments may include raising, lowering and/or maintaining a pressure and/or potentiometric surface(s) in an FBCD formation and/or in one or more aquifer layers with which the FBCD formation has direct contact. A formation pressure may be, for example, controlled within a range of about 30 psi absolute to about 300 psi absolute. For example, a preferred process comprises controlling at least one pressure and/or potentiometric surface(s) within a substantial portion of a selected formation subjected to a retorting or other pyrolysis-based process. In an example, the controlled pressure and/or potentiometric surface is maintained at a level of greater than about 30 psi absolute during a pyrolysis treatment. In an alternate embodiment, an in situ conversion process for hydrocarbons may include raising and maintaining the pressure in the formation within a range of about 300 psi absolute to about 600 psi absolute. In some embodiments, hydrostatic or geostatic pressure differences (e.g. differentials)—such as between injection wells and production wells—are applied beneficially to influence, circulate or stimulate movement of one or more sub-surface fluids in the formation. In preferred embodiments, at least one formation pressure differential is under the control of an operator or intelligent operating system. In preferred embodiments, an operator uses one or more pressure differentials between wells to advantage in a selected portion of a formation to enhance production of a formation fluid, and/or to influence, circulate or stimulate movement of at least one hydrocarbon, TECF or other formation fluid toward a desired location in the formation. In preferred embodiments, one or more pressure differential is used to limit migration of formation fluids from a portion of the formation, or to contain formation fluids within a selected portion of a formation. When pressure differentials are used to control material flow, a pressure difference of at least 5 psi or higher may be used to establish flow rates and/or direction. In preferred embodiments and examples, pressure differentials of greater than 5 psi, 10 psi, or 20 psi, 30 psi, 100 psi, 300 psi, 500 psi, or higher may be used to advantage to establish a rate, direction or pressure of flow of one or more formation fluids.

Treating an oil shale or other FBCD formation with a TECF may result in mobilization of hydrocarbons in the formation by a number of means. In an embodiment, said mobilization results from displacement or extraction of adsorbed material from the subterranean strata. In a preferred embodiment a displaced or extracted material may comprise adsorbed methane and/or other hydrocarbons, and may be produced from the formation. In another embodiment, said mobilization is by a method comprising pyrolysis of one or more carbonaceous materials found within the formation. In another embodiment, a method of treating a formation may include injecting a thermal energy carrier fluid into a formation, circulating the carrier fluid in the formation such that heat from the TECF is dynamically transferred to one or more selected first segment(s) of the formation. The method(s) further comprises use of said heat energy to mobilize at least one carbonaceous material found within a selected first portion of a FBCD formation. Alternatively, the method(s) further comprises use of said heat energy to mobilize and pyrolyze at least one carbonaceous material found within a selected first portion of a FBCD formation. Optionally, the material mobilized from the selected first portion of the FBCD formation undergoes pyrolysis in a second portion of the FBCD formation.

In an embodiment, the method for treating the formation comprises the production of mobile (e.g. flowable) hydrocarbons from one or more solid phase, carbon-based materials, the method comprising pyrolysis. In an embodiment, the method for treating the formation comprises the further in situ cracking, and/or pyrolysis, and/or chemical modification of mobile hydrocarbons generated within the formation. In preferred embodiments, the invention provides an in situ method for synthesizing (e.g. by decomposition of a carbonaceous material) and/or transforming hydrocarbons within a carbonaceous geological formation, the method comprising, contacting (directly or indirectly) in situ said carbonaceous geological material with heat provided by any means through an opening in the formation, subjecting a portion of the carbonaceous material in the formation to at least a plurality of pyrolytic decomposition steps that provide one or more hydrocarbons having an average carbon number of <20, and preferably, <12, and producing at least a portion of the synthesized hydrocarbon through an opening in the formation. In other preferred embodiments, at least two of the pyrolysis reactions occur at physically distinct locations within said formation. In further preferred embodiments, at least one of the pyrolysis reactions occurs in a fluid phase comprising formation fluids and/or a thermal energy carrier fluid.

Thermal energy sufficient to cause pyrolysis of at least one carbonaceous material within a formation is referred to herein in as pyrolysis heat. In the systems and methods of this invention, pyrolysis heat may be delivered directly to (and, optionally, from) a carbonaceous material present in a formation by direct contact of the carbonaceous material with a TECF circulating through a permeable portion of the formation at a temperature exceeding a pyrolysis temperature of one or more carbonaceous species found in the carbonaceous material. In addition, pyrolysis heat may delivered indirectly by heat conducted through a secondary medium before being delivered to the target hydrocarbon. In an embodiment, pyrolysis heat is supplied to a formation by means of an in situ heating element and transferred through at least one zone having substantially lower permeability than the in situ heating element. In an embodiment, the lower permeability zone transfers heat to a fixed bed carbonaceous deposit primarily by means of thermal conductivity. Mobilization of hydrocarbon from such deposits may occur by any number of modalities described herein. These modalities may include phase change, melting, viscosity or surface tension reduction, decomposition, emulsification, solubility alteration, changes in local vapor pressures and chemical alteration. Often, mobilization is by a process comprising pyrolysis of one or more hydrocarbon species within the FBCD. Production of mobilized hydrocarbon from the lower permeability zone occurs through one or more production wells in fluid communication with the lower permeability or substantially impermeable zone. Such fluid communication may be natural or artificial, as occurs when hydraulic fracturing and other related technologies are used to increase fluid flow in a formation. In an embodiment, the hydrocarbon production well is in fluid communication with a TECF injection well and co-produces TECF along with hydrocarbon mobilized from the lower permeability zone. In another embodiment, the hydrocarbon production well is not in fluid communication with a TECF injection well and does not co-produce TECF with hydrocarbon mobilized from the lower permeability zone. In yet another embodiment, the hydrocarbon production well may be controlled by an operator to allow either TECF co-production or not allow co-production of TECF with the hydrocarbon mobilized from the lower permeability zone. The methods of the present invention may employ an array of heaters, pressure valves, compression systems, pressurization, flow control and other adjustment devices to allow individual or group-focused well control. One objective of such control is to modulate or direct the flow of TECF and mobilized hydrocarbons within the formation. Such modulation provides for adjustments in hydrocarbon chemistry and production rate over the life of the production operation. Such control also allows for high level of control of formation water and flow patterns to provide for high levels of environmental protection.

Example 9

Dynamic Uses and Operation of In Situ Heating Elements

In the methods of this invention, an in situ heating element comprises a substantially heated portion of a geological formation containing at least one selected permeable zone through which heated TECF flows, (or may flow, or has previously flowed) between at least about one injection opening and at least about one production opening. Alternatively, an in situ heating element may comprise a single injection opening with a plurality of production openings, a plurality of injection openings with a single production opening. In some cases an approximately parallel series of injection and production openings (e.g. wherein each pair used initially to create an in situ heating element) may function in concert, so as to provide the effect of a single very large in situ heating element network comprised of an array of production and injection wells. In some cases, in situ heating elements may overlap one another to create super-heated zones. In most embodiments, the openings (e.g. inlet, outlet, etc) comprise wells. Typically, the wells are introduced into the formation using conventional drilling, casing and well completion operations. In a typical embodiment, an in situ heating element provides a means of receiving, storing and transferring heat delivered to a formation by a means comprising injection of one or more TECF. In situ heating elements may be maintained in a formation for very long periods of time (e.g. from months to years or even a decade or more). The heat stored in the in situ heating element is useful for conducting physical and chemical work both underground and above-ground.

By way of illustration, a typical in situ heating element comprises a selected permeable zone of a geological formation that is bounded on at two ends by an injection inlet and a production outlet. It is further bounded on at least one side by a portion of the selected geological formation having substantially lower permeability than the selected permeable zone. The heating further comprises fluid communication between the injection opening and the production opening, a carrier fluid capable of carrying thermal energy (TECF) into or out of the formation by a process comprising circulation between the injection and production openings. Often, the in situ heating element is bounded on at least two sides (e.g. above and below) by portions of the geological formation having substantially lower permeability than the selected permeable zone. The in situ heating element is typically supplied with heat by flowing heated thermal energy fluid injected into the permeable zone from an injection well equipped to manage injection temperature, pressure and flow. Heated TECF flows through the selected permeable zone so as to transfer thermal energy to one or more mineral components of the formation. As such, an in situ heating element also typically comprises a heated TECF in the permeable zone between the inlet and outlet and lower permeability boundaries. An opening in an in situ heating element may serve as either an inlet, an outlet, or interchangeably, as both. Most often the inlet and outlets comprise wells or well bores. Due to its volume and stability, the in situ heating elements does not require a continuous feed of energy (e.g. flow of heated TECF) to remain functional as a heating element over extended periods of time. Moreover, its outer dimensions and/or volume tend to expand with increased injection of heated TECF due to a gradual increase in porosity or permeable of the formation that may occur near its edges. The growth and dimensions of an in situ heating element may change over time in response to a number of factors such as: rate of heat and/or fluid injection; permeability of the formation; rate of heat deposition or transfer; rate of production of TECF, hydrocarbons and/or other formation fluids; differential pressure between the TECF treated zone and surrounding formation fluids; pressure gradients in the formation; injection or production rates of perimeter control wells; and other operational factors. Expansion occurs, for example, when the in situ heating element is positioned next to a lower permeability portion of the formation, as the lower permeability portion containing one or more carbonaceous materials increases in permeability. Contraction may occur during a cooling or heat extraction phase.

Over time, using the methods described elsewhere herein, hydrocarbons and other materials are mobilized from the lower permeability portion, causing an increase in its permeability. This process allows a portion of the formation not initially contained in an in situ heating element to be assimilated into a heating element. Thus, an in situ heating element is not fixed by the presence of a well casing or well bore annulus, but tends to expand or contract in response to the rate and temperature of TECF injection and production. Thermodynamic and kinetic properties of the TECF also play a substantial role in permitting or restricting release of thermal energy to (or, optionally, from) an in situ heating element. The flowing of TECF in an in situ heating element, therefore, also provides a means of conducting heat sufficient to pyrolyze or mobilize hydrocarbons within the formation. The parameters that allow an operator to adjust the heating, hydrodynamic and flow properties of a TECF flowing in an in situ heating element may also provide a means by which the operator controls hydrocarbon mobilization, pyrolysis and cracking operations across a portion of the formation that is substantially larger than the in situ heating element itself. Adjustments and controls of various systems are discussed elsewhere herein and are may apply interchangeably to an in situ heating element as well as other aspects and embodiments of the present invention.

As described above, an in situ heating element is characterized by a predominantly horizontal flow between injection and production openings positioned at similar depths in a naturally permeable stratigraphic layer of a formation. Such horizontal permeability also may be created or enhanced through formation fracturing, as by hydraulic or explosive means. In some embodiments, the flow of TECF is predominantly vertical. In some embodiments, TECF is conducted between a variety of injection and production openings within a formation by selective adjustment of pressures, temperatures, flow rates and TECF chemistry through means employed at either injection or production wells, or both. In addition, hydrodynamic gradients may be created or reinforced through intermediary wells, water injection or other perimeter control wells in or around a treated segment of a formation. Adjustment of flow direction and vertical orientation may also be adjusted within and between stratigraphic layers within a formation. Cross-formation permeability, including interlayer TECF flow, may be established or enhanced through both hydraulic and explosive fracturing as well as thermal decomposition, solubilization and vaporization of hydrocarbons and rock matrix materials from low permeability strata within the formation.

In an advanced example of the invention, TECF is injected at a first vertical depth into a first permeable layer of the formation. Typically, the TECF is injected at a temperature substantially in excess of the formation temperature typically found at the injection depth. Most often, the injection temperature is in excess of 400° F. The carrier fluid circulates in the first permeable layer of the formation with at least a portion of the carrier fluid circulating cross-formationally through at least one adjacent lower permeability zone before passing into a second permeable layer and being produced from a production opening positioned at a second vertical depth in the formation. Typically, the first and second vertical depths differ by at least 50 ft, or are in distinct stratigraphic layers of the formation, or both. By varying pressures, temperatures, flow rates, hydrodynamic gradients or other fluid properties under operator control, a skilled operator may achieve TECF flow from a specific injection opening in the formation toward a specific production opening, allowing systematic recovery of hydrocarbons between a flow path linking the injection and production openings. The methods of this example allow for the installation of an in situ heating element between injection and production openings at substantially different depths. They further allow for formation of stable or transient in situ heating elements within a conventional or fixed bed hydrocarbon formation between wells at differing depths, and between wells in distinct stratigraphic layers.

A heating element may further be generated by a method comprising contacting and pyrolyzing at least one carbonaceous material found in a permeable zone with heated TECF (e.g. using the methods of this invention). At least a portion of an in situ heating element may exhibit a temperature above a pyrolysis temperature of at least one carbonaceous material found in the formation. In some embodiments of the invention, pyrolysis heat is delivered by transferring thermal energy from an in situ heating element.

In addition to storing thermal energy, the in situ heating element provides a means of supplying heat sufficient to mobilize hydrocarbons from other portions of a formation. In some examples, these additional portions of the formation are adjacent to (e.g. contacting) the in situ heating element and the heat is transferred by thermal conductivity through lower permeability rock until reaching mobilizable hydrocarbons imbibed in or otherwise present in the lower permeability zone. In other examples, the additional portions of the formation may be separated from the in situ heating element by significant distances, requiring heat to be transferred by fluid means, either directly or indirectly.

Often, an in situ heating element is developed using certain geological information related to local depositional patterns and permeabilities. Such information is often readily available from local or national databases; public and/or university libraries; and regional or national repositories of geological records. Such records often describe permeability and depositional characteristics of a formation, as well as information related to depth, local outcroppings, aerial extent, drainage patterns, and other characteristics of a formation that are useful in the present invention. Where such records are not available, the information is readily obtainable using methods well known in the art of drilling, formation evaluation and geological analysis.

Further Examples and Embodiments

In another embodiment, the invention comprises an in situ fluid hydrocarbon production system, the system comprising: a) at least one substantially immobile carbonaceous material or FBCD deposited within a hydrocarbon formation between at least a first permeable portion of the formation and at least a second permeable portion of the formation, b) a source of mobilizing heat, c) an opening in the first permeable portion of the formation through which mobilizing heat is delivered to the first permeable portion of the formation, d) a means to deliver mobilizing heat from at least the first permeable portion of the formation to the substantially immobile carbonaceous material in the formation, e) a means to conduct mobilized hydrocarbon from the substantially immobile carbonaceous material through the second permeable portion of the formation, and to an outlet for producing fluids from the formation, f) a means to produce fluids from the production outlet, and g) means to remove at least one hydrocarbon from the produced fluids. Optionally, the system further includes a means for recycling a portion of the produced fluids back into the formation. The system may further comprise establishing fluid communication between said first and second permeable locations, and, optionally, between said second location and a third location, such as an in situ treatment site or second production outlet. In an embodiment of the system, said means to deliver mobilizing heat from the first permeable portion of the formation to the substantially immobile carbonaceous material comprises a thermal energy carrier fluid. In a further embodiment, said means to deliver mobilizing heat from the first permeable portion of the formation to the substantially immobile carbonaceous material comprises thermal conduction. In an embodiment, the means to deliver mobilized hydrocarbon from the substantially immobile carbonaceous material to the second permeable portion of the formation and to the production opening comprises a pressure differential. In another embodiment, the means to conduct mobilized hydrocarbons from the substantially immobile carbonaceous material to the second permeable portion of the formation and to the production opening comprises a thermal energy carrier fluid. In a further embodiment, the means to conduct mobilized hydrocarbon from the substantially immobile carbonaceous material to the second permeable portion of the formation and to the production opening comprises a formation fluid. In a particularly preferred embodiment, operational linkages between the injection opening, the first permeable portion of the formation and the substantially immobile carbonaceous material, the second permeable portion of the formation and the production opening are established by means of one or more TECF. In another preferred embodiment, operational linkages between the injection opening, the first permeable portion of the formation and the substantially immobile carbonaceous material, the second permeable portion of the formation and the production opening are established by means of one or more pressure differentials. In a further embodiment, at least one fluid flow parameter, one heating parameter, one pressure parameter or one production parameter is under the control of an operator or intelligent operating system. In a more preferred embodiment, at least one of each of these parameters is under the control of an operator or intelligent operating system. Alterations in such parameters may be communicated to the system by any means, but preferably by a fluid means and, more preferably by a means comprising the heating, cooling, pressurization of depressurization of a fluid. In another preferable embodiment, at least one process control parameter is adjusted by increasing or decreasing the flow rate of a fluid flow in an in situ heating element. In some embodiments, an operator or intelligent operating system modifies the output of at least one hydrocarbon by modifying a temperature, a pressure, an injection rate, or a flow rate in the system. An operator or intelligent operating system may further modify output by modifying a plurality of these, and/or other parameters. Typically, such modifications are communicated by electronic means to remotely operated valves, switches, manifolds, pumps, heaters and other equipment.

In a further embodiment, the invention comprises an in situ fluid hydrocarbon production system, the system comprising: a) at least one substantially immobile carbonaceous material or FBCD deposited within a hydrocarbon formation between at least a first permeable portion of the formation and at least a second permeable portion of the formation, b) a source of pyrolysis heat, c) an opening in the first permeable portion of the formation through which pyrolysis heat is delivered to the first permeable portion of the formation, d) a means to deliver pyrolysis heat from at least the first permeable location in the formation to the substantially immobile carbonaceous material in the formation, e) a means to conduct mobilized hydrocarbon from the substantially immobile carbonaceous material through the second permeable location in the formation, and to an outlet for producing fluids from the formation, f) a means to produce fluids from the production outlet, and g) means to remove at least one hydrocarbon from the produced fluids. Optionally, the system further includes the means from recycling a portion of the produced fluids back into the formation. The system may further comprise establishing fluid communication between said first and second locations, and, optionally, between said second location and a third location, such as an in situ treatment site or second production outlet. In an embodiment of the system, said means to deliver pyrolysis heat from the first permeable portion of the formation to the substantially immobile carbonaceous material comprises a thermal energy carrier fluid. In an embodiment, said means to deliver pyrolysis heat from the first permeable portion of the formation to the substantially immobile carbonaceous material comprises thermal conduction. In a further embodiment, the means to conduct mobilized hydrocarbon from the substantially immobile carbonaceous material to the second permeable portion of the formation and to the production opening comprises a pressure differential. In another embodiment, the means to conduct mobilized hydrocarbon from the substantially immobile carbonaceous material to the second permeable portion of the formation and to the production opening comprises a thermal energy carrier fluid. In a further embodiment, the means to conduct mobilized hydrocarbon from the substantially immobile carbonaceous material to the second permeable portion of the formation and to the production opening comprises a formation fluid. In many embodiments, operational linkages between the injection opening, the first permeable portion of the formation and the substantially immobile carbonaceous material, the second permeable portion of the formation and the production opening are established by means of one or more TECF. In another preferred embodiment, operational linkages between the injection opening, the first permeable portion of the formation and the substantially immobile carbonaceous material, the second permeable portion of the formation and the production opening are established by means of one or more pressure differentials. In a further embodiment, at least one fluid flow parameter, one heating parameter, one pressure parameter or one production parameter is under the control of an operator or intelligent operating system. In a more preferred embodiment, at least one of each of these parameters is under the control of an operator or intelligent operating system. Alterations in such parameters may be communicated to the system by any means, but preferably by a fluid means and, more preferably by a means comprising the heating, cooling, pressurization, depressurization of a fluid. In another preferable embodiment, at least one process control parameter is adjusted by increasing or decreasing the flow rate of a fluid flow in an in situ heating element. In some embodiments, an operator or intelligent operating system modifies the output of at least one hydrocarbon by modifying a temperature, a pressure, an injection rate, or a flow rate in the system. An operator or intelligent operating system may further modify output by modifying a plurality of these, and/or other parameters. Typically, such modifications are communicated by electronic means to remotely operated valves, switches, manifolds, pumps, heaters and other equipment.

Many variations of the system are possible within the scope of this invention. The examples set forth herein are meant far the purpose of illustrating and not limiting the operation of the invention.

The invention claimed is:

1. A method of producing hydrocarbons and a selected metal from a mixture of inorganic minerals in situ from a fixed-bed hydrocarbon formation, the hydrocarbon formation disposed below a ground surface and having a substantially horizontal, lower permeability zone adjacent to, substantially parallel to, and between a top higher permeability zone and a bottom higher permeability zone, the steps comprising:

providing at least one injection well in the bottom higher permeability zone of the formation, the injection well having a first vertical depth;

providing a first production well in the bottom higher permeability zone of the formation, the first production well having a second vertical depth, the depth of the injection well and the first production well providing fluid communication therebetween in the bottom higher permeability zone;

providing a second production well in the top higher permeability zone of the formation, the second production well having a third vertical depth, the depth of the injection well and the second production well providing limited fluid communication between the bottom higher permeability zone and the top higher permeability zone;

injecting a heated thermal-energy carrier fluid (TECF) from the ground surface into the injection well;

circulating the thermal-energy carrier fluid (TECF) through the bottom higher permeability zone;

creating a substantially horizontal in situ heating element (ISHE) in the bottom higher permeability zone and between the injection well and the first production well;

mobilizing hydrocarbons and the mixture of selected inorganic minerals in the adjacent lower permeability zone in situ by heating the bottom higher permeability zone and the adjacent lower permeability zone along an interface extending substantially between the injection well to the first production well;

producing at least a portion of the mobilized hydrocarbons and the metal by flowing the carrier fluid with the mobilized hydrocarbons through the first production well to the ground surface and removing at least one selected hydrocarbon and the selected metal held in the carrier fluid; and producing at least a portion of the mobilized hydrocarbons and the selected metal by flowing the carrier fluid with the mobilized hydrocarbons and selected metal through the second production well to the ground surface.

2. The method as described in claim 1 further including the step of removing at least one selected mobilized hydrocarbon and the selected metal from the carrier fluid produced from the second production well.

3. The method as described in claim 1 further including the step of providing a plurality of injection wells having a vertical portion and a horizontal portion with perforations therein for injecting the heated thermal-energy carrier fluid (TECF) therethrough and circulating the thermal-energy carrier fluid through the bottom higher permeability zone to the first production well.

4. The method as described in claim 1 further including the step of providing a plurality of spaced apart injection wells in the bottom higher permeability zone and a plurality of spaced apart third production wells in the bottom higher permeability zone, the injection wells and the third production wells having a vertical portion and a horizontal portion with perforations therein, the horizontal portion of the third production wells disposed above the horizontal portion of the injection wells in the bottom higher permeability zone.

5. The method as described in claim 4 further including the steps of turning the third production wells into new injection wells and the injection wells into new production wells by injecting the heated thermal-energy carrier fluid (TECF) into the new injection wells, circulating the thermal-energy carrier fluid (TECF) through the bottom higher permeability zone, producing at least a portion of the mobilized hydrocarbons by flowing the carrier fluid with the mobilized hydrocarbons through the new production wells to the ground surface and removing at least one selected hydrocarbon and the selected metal held in the carrier fluid.

6. The method as described in claim 1 further including the steps of turning the second production well into a new injection well and the injection well into a new production well by injecting the heated thermal-energy carrier fluid (TECF) into the new injection well, circulating the thermal-energy carrier fluid (TECF) through the higher permeability zone, producing at least a portion of the mobilized hydrocarbons by flowing the carrier fluid with the mobilized hydrocarbons through the new production well to the ground surface and removing at least one selected hydrocarbon and the selected metal held in the carrier fluid.

7. The method as described in claim 1 further including the step of providing a plurality of second production wells in the top higher permeability zone of the formation, the second production wells having a vertical portion extending into the top higher permeability zone and a horizontal portion, with perforations therein, extending along a length of the top higher permeability zone for receiving carrier fluid with mobilized hydrocarbons therein.

8. The method as described in claim 1 further including the step of circulating the thermal-energy carrier fluid (TECF) through the lower permeability zone, mobilizing hydrocarbons in the lower permeability zone and flowing the carrier fluid and mobilized hydrocarbons and the selected metal through the second production well to the ground surface.

9. The method as described in claim 1 wherein the carrier fluid is circulated continuously through the ISHE during the production of mobilized hydrocarbons from the second production well.

10. The method as described in claim 9 wherein the production of the mobilized hydrocarbons through the second production well is intermittent during the heating of the lower permeability zone.

11. The method as described in claim 1 wherein the carrier fluid is circulated intermittently through the ISHE during the production of mobilized hydrocarbons from the second production well.

12. The method as described in claim 1 wherein the production of the mobilized hydrocarbons through the second production well is continuous during the heating of the lower permeability zone.

13. A method of producing hydrocarbons and a selected metal from a mixture of inorganic minerals in situ from a fixed-bed hydrocarbon formation, the hydrocarbon formation disposed below a ground surface and having a substantially horizontal, lower permeability zone adjacent to, substantially parallel to, and between a top higher permeability zone and a bottom higher permeability zone, the steps comprising:

providing a plurality of injection wells having a vertical portion and a horizontal portion with perforations therein for injecting a heated thermal-energy carrier fluid (TECF) therethrough and circulating the thermal-energy carrier fluid through the bottom higher permeability zone;

providing a first production well in the bottom higher permeability zone of the formation, the first production well having a second vertical depth, the depth of the injection wells and the first production well providing fluid communication therebetween in the bottom higher permeability zone;

providing a second production well in the top higher permeability zone of the formation, the second production well having a third vertical depth, the depth of the injection wells and the second production well providing limited fluid communication between the bottom higher permeability zone and the top higher permeability zone;

injecting the heated thermal-energy carrier fluid (TECF) from the ground surface into the injection wells;

circulating the thermal-energy carrier fluid (TECF) through the bottom higher permeability zone;

creating a substantially horizontal in situ heating element (ISHE) in the bottom higher permeability zone and between the injection wells and the first production well;

mobilizing hydrocarbons and the mixture of selected inorganic minerals in the adjacent lower permeability zone in situ by heating the bottom higher permeability zone and the adjacent lower permeability zone along an interface extending substantially between the injection wells to the first production well;

producing at least a portion of the mobilized hydrocarbons and the metal by flowing the carrier fluid with the mobilized hydrocarbons through the first production well to the ground surface and removing at least one selected hydrocarbon and the selected metal held in the carrier fluid; and producing at least a portion of the mobilized hydrocarbons and the selected metal by flowing the carrier fluid with the mobilized hydrocarbons and selected metal through the second production well to the ground surface.

14. The method as described in claim 13 further including the steps of turning the second production well into a new injection well and the injection wells into new production wells by injecting the heated thermal-energy carrier fluid (TECF) into the new injection well, circulating the thermal-energy carrier fluid (TECF) through the higher permeability zone, producing at least a portion of the mobilized hydrocarbons by flowing the carrier fluid with the mobilized hydrocarbons through the new production wells to the ground surface and removing at least one selected hydrocarbon and the selected metal held in the carrier fluid.

15. The method as described in claim 13 further including the step of providing a plurality of second production wells in the top higher permeability zone of the formation, the second production wells having a vertical portion extending into the top higher permeability zone and a horizontal portion, with perforations therein, extending along a length of the top higher permeability zone for receiving the carrier fluid with mobilized hydrocarbons therein.

16. The method as described in claim 13 further including the step of circulating the thermal-energy carrier fluid (TECF) through the lower permeability zone, mobilizing hydrocarbons in the lower permeability zone and flowing the carrier fluid and mobilized hydrocarbons and the selected metal through the second production well to the ground surface.

17. A method of producing hydrocarbons and a selected metal from a mixture of inorganic minerals in situ from a fixed-bed hydrocarbon formation, the hydrocarbon formation disposed below a ground surface and having a substantially horizontal, lower permeability zone adjacent to, substantially parallel to, and between a top higher permeability zone and a bottom higher permeability zone, the steps comprising:

providing a plurality of injection wells in the bottom higher permeability zone of the formation, the injection wells having a vertical portion and a horizontal portion with perforations therein;

providing a first production well in the bottom higher permeability zone of the formation, the first production well having a second vertical depth, the depth of the injection wells and the first production well providing fluid communication therebetween in the bottom higher permeability zone;

providing a second production well in the top higher permeability zone of the formation, the second production well having a third vertical depth, the depth of the injection wells and the second production well providing limited fluid communication between the bottom higher permeability zone and the top higher permeability zone;

providing a plurality of spaced apart third production wells in the bottom higher permeability zone, the third production wells having a vertical portion and a horizontal portion with perforations therein, the horizontal portion of the third production wells disposed above the horizontal portion of the injection wells in the bottom higher permeability zone;

injecting a heated thermal-energy carrier fluid (TECF) from the ground surface into the injection wells;

circulating the thermal-energy carrier fluid (TECF) through the bottom higher permeability zone;

creating a substantially horizontal in situ heating element (ISHE) in the bottom higher permeability zone and between the injection wells and the first production well;

mobilizing hydrocarbons and the mixture of selected inorganic minerals in the adjacent lower permeability zone in situ by heating the bottom higher permeability zone and the adjacent lower permeability zone along an interface extending substantially between the injection wells to the first production well;

producing at least a portion of the mobilized hydrocarbons and the metal by flowing the carrier fluid with the mobilized hydrocarbons through the first production well to the ground surface and removing at least one selected hydrocarbon and the selected metal held in the carrier fluid; and producing at least a portion of the mobilized hydrocarbons and the selected metal by flowing the carrier fluid with the mobilized hydrocarbons and selected metal through the second production well to the ground surface.

18. The method as described in claim 17 further including the steps of turning the third production wells into new injection wells and the injection wells into new production wells by injecting the heated thermal-energy carrier fluid (TECF) into the new injection wells, circulating the thermal-energy carrier fluid (TECF) through the bottom higher permeability zone, producing at least a portion of the mobilized hydrocarbons by flowing the carrier fluid with the mobilized hydrocarbons through the new production wells to the ground surface and removing at least one selected hydrocarbon and the selected metal held in the carrier fluid.

19. The method as described in claim 17 further including the step of providing a plurality of second production wells in the top higher permeability zone of the formation, the second production wells having a vertical portion extending into the top higher permeability zone and a horizontal portion, with perforations therein, extending along a length of the top higher permeability zone for receiving carrier fluid with mobilized hydrocarbons therein.

20. The method as described in claim 17 further including the step of circulating the thermal-energy carrier fluid (TECF) through the lower permeability zone, mobilizing hydrocarbons in the lower permeability zone and flowing the carrier fluid and mobilized hydrocarbons and the selected metal through the second production well to the ground surface.

* * * * *